US009089195B2

(12) United States Patent
Mizuno et al.

(10) Patent No.: US 9,089,195 B2
(45) Date of Patent: Jul. 28, 2015

(54) AUTOMATIC HAIR WASHING APPARATUS

(75) Inventors: Osamu Mizuno, Osaka (JP); Soichiro Fujioka, Osaka (JP); Tohru Nakamura, Osaka (JP); Akinobu Okuda, Nara (JP); Tsuyoshi Tojo, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 255 days.

(21) Appl. No.: 13/816,979

(22) PCT Filed: Aug. 15, 2011

(86) PCT No.: PCT/JP2011/004581

§ 371 (c)(1),
(2), (4) Date: Feb. 14, 2013

(87) PCT Pub. No.: WO2012/023278

PCT Pub. Date: Feb. 23, 2012

(65) Prior Publication Data

US 2013/0145540 A1 Jun. 13, 2013

(30) Foreign Application Priority Data

Aug. 18, 2010 (JP) ..... 2010-182695

(51) Int. Cl.
*A45D 19/14* (2006.01)
*A45D 19/02* (2006.01)
*A45D 19/00* (2006.01)

(52) U.S. Cl.
CPC ..... *A45D 19/14* (2013.01); *A45D 19/02* (2013.01); *A45D 2019/005* (2013.01)

(58) Field of Classification Search
CPC ..... A45D 19/14
USPC ..... 4/488–513
See application file for complete search history.

(56) References Cited

U.S. PATENT DOCUMENTS 6,526,605 B2 3/2003 Shimizu
2002/0050005 A1 5/2002 Shimizu

FOREIGN PATENT DOCUMENTS

CN 1350821 A 5/2002
JP 49-115198 U 10/1974

(Continued)

OTHER PUBLICATIONS

Chinese Office Action and Search Report for corresponding Chinese Application No. 2011800039867.2 issued on Nov. 3, 2014 and English translation of Search Report.

(Continued)

*Primary Examiner* — Lori Baker
(74) *Attorney, Agent, or Firm* — Renner, Otto, Boisselle & Sklar, LLP

(57) ABSTRACT

Provided is an automatic hair washing apparatus for washing person's hair in a safe and effective manner without applying a straining force on person's neck. An automatic hair washing apparatus 100 comprises a bowl 101 having a head support 11; washing units 12L and 12R arranged with the head support 11 interposed therebetween, the support shafts thereof being attached to the bowl 101; a driving section for rotating the washing units 12L and 12R about the respective support shafts 104L and 104R; and a control section for controlling the driving of the driving section; wherein each of the washing units 12L and 12R comprises a plurality of contacts 109 on a surface opposite to the surface supported by the support shaft 104L and 104R.

14 Claims, 37 Drawing Sheets

(56) References Cited

FOREIGN PATENT DOCUMENTS

| | | | |
|---|---|---|---|
| JP | 50-41800 | U | 4/1975 |
| JP | 59-197208 | A | 11/1984 |
| JP | 2001-149133 | A | 6/2001 |
| JP | 2009-078180 | A | 4/2009 |
| KR | 100813634 | B1 | 3/2008 |

OTHER PUBLICATIONS

International Search Report for corresponding International Application No. PCT/JP2011/004581 mailed Nov. 22, 2011.

International Preliminary Report on Patentability for corresponding International Application No. PCT/JP2011/004581 mailed Mar. 28, 2013.

*Fig.17*

901L

| $\theta_{SL}$ | $\theta_{PL}$ |
|---|---|
| 0° | 11.5° |
| 5° | 12.0° |
| : | : |
| : | : |
| : | : |
| 125° | 10.5° |
| 130° | 9.0° |

*Fig.18*

902L

| $\theta_{SL}$ \ $\theta_{PL}$ | 0° | 5° | 10° | 15° | 20° |
|---|---|---|---|---|---|
| 0° | 1.5 | 1.2 | 1.5 | 1.3 | 1.4 |
| 5° | 1.2 | 0.9 | 0.9 | 1.0 | 1.1 |
| : | : | : | : | : | : |
| : | : | : | : | : | : |
| : | : | : | : | : | : |
| 125° | -1.2 | -1.0 | -0.8 | -0.9 | -1.0 |
| 130° | -1.6 | -1.3 | -1.5 | -1.2 | -1.0 |

40

AUTOMATIC HAIR WASHING APPARATUS

FIELD OF THE INVENTION

The present invention relates to an automatic hair washing apparatus for use in a medicare or hairdressing and beauty industry.

BACKGROUND ART

In the hairdressing and beauty industry, the laborious head and/or hair washing has been desired to be automated. Also in the medicare industry, the laborious hair washing services for the inpatients have been expected to be automated.

There has been known an apparatus disclosed in JP 2001-149133 (A), for example, for washing person's hair automatically, which is schematically illustrated in FIG. 44. As shown in the drawing, the automatic hair washing apparatus comprises an arcuate washing unit 1 or nozzle unit. The washing unit 1 comprises a number of comb-like projections 2 mounted at regular intervals on an inner arcuate surface thereof and a number of hair washing nozzles 1*a* each provided between the neighborhood projections 2. Each projection 2 comprises a scalp washing nozzle 2*a* supported at an end thereof. The nozzles 1*a* and 2*a* are fluidly connected through liquid passages (not shown) mounted within the interior of the washing unit 1 to the switching unit 3 for supplying the liquid selectively to either or both of the nozzles 1*a* and 2*a* so that the washing agent or liquid is ejected through either or both of the nozzles 1*a* and 2*a* toward the scalp and hair for the washing thereof.

The washing unit 1 is designed so that, by the driving of reciprocating drive unit 4, the washing unit 1 moves in a direction indicated by an arrow 4*c* through a rack 4*a* and a pinion 4*b*. This arrangement allows the washing unit 1 to broaden a scalp/hair washing range thereof. The washing unit 1, the switching unit 3, and the reciprocating drive unit 4 are supported by a unit support 5. The unit support 5 is designed so as to be driven by a rotational drive unit 6 through a gear assembly 8 to rotate about the support shaft 7, allowing the washing unit 1 to wash the entirety of person's scalp/hair. According to the hair washing apparatus so constructed, the switching unit 3, the reciprocating drive unit 4, and rotational drive unit 6 are driven in combination for the scalp/hair washing. Accordingly, person's scalp/hair is wholly washed automatically, which eliminates laborious human works.

Disadvantageously, the above-described automatic head washing apparatus employs a single washing unit for washing person's scalp/hair by moving the washing unit, which causes a force in the direction of washing unit movement, which is a force in the direction of the person's neck twisting, to apply on the person's head during the washing and as a result, the straining force is applied on person's neck.

The present invention is to solve this problem and provide an automatic hair washing apparatus for washing person's hair in a safe and effective manner without applying a straining force on person's neck.

SUMMARY OF THE INVENTION

In order to achieve the above object, there is provided an automatic hair washing apparatus comprising: a base having a head support for supporting a person's head; first and second washing units for washing the person's head, being arranged with the head support interposed therebetween, and the support shafts thereof being attached to the base; a driving section for rotating the first and second washing units about the respective support shafts; and a control section for controlling the driving of the driving section; wherein each of the first and second washing units comprises a plurality of contacts on a surface opposite to the surface supported by the support shaft.

According to the hair washing apparatus of the present invention, in which the first and second washing units are arranged with the head support interposed therebetween, person's hair can be washed in a safe and effective manner by the left and right washing unit 12L and 12R without a straining force applied on person's neck.

BRIEF DESCRIPTION OF THE DRAWINGS

FIG. 17 is a schematic view showing an embodiment of a first table of the pressure control calculating unit in the control device of the automatic hair washing apparatus according to the first embodiment.

FIG. 18 is a schematic view showing an embodiment of a second table of the pressure control calculating unit in the control device of the automatic hair washing apparatus according to the first embodiment.

DESCRIPTION OF THE EMBODIMENTS

Figure 1:
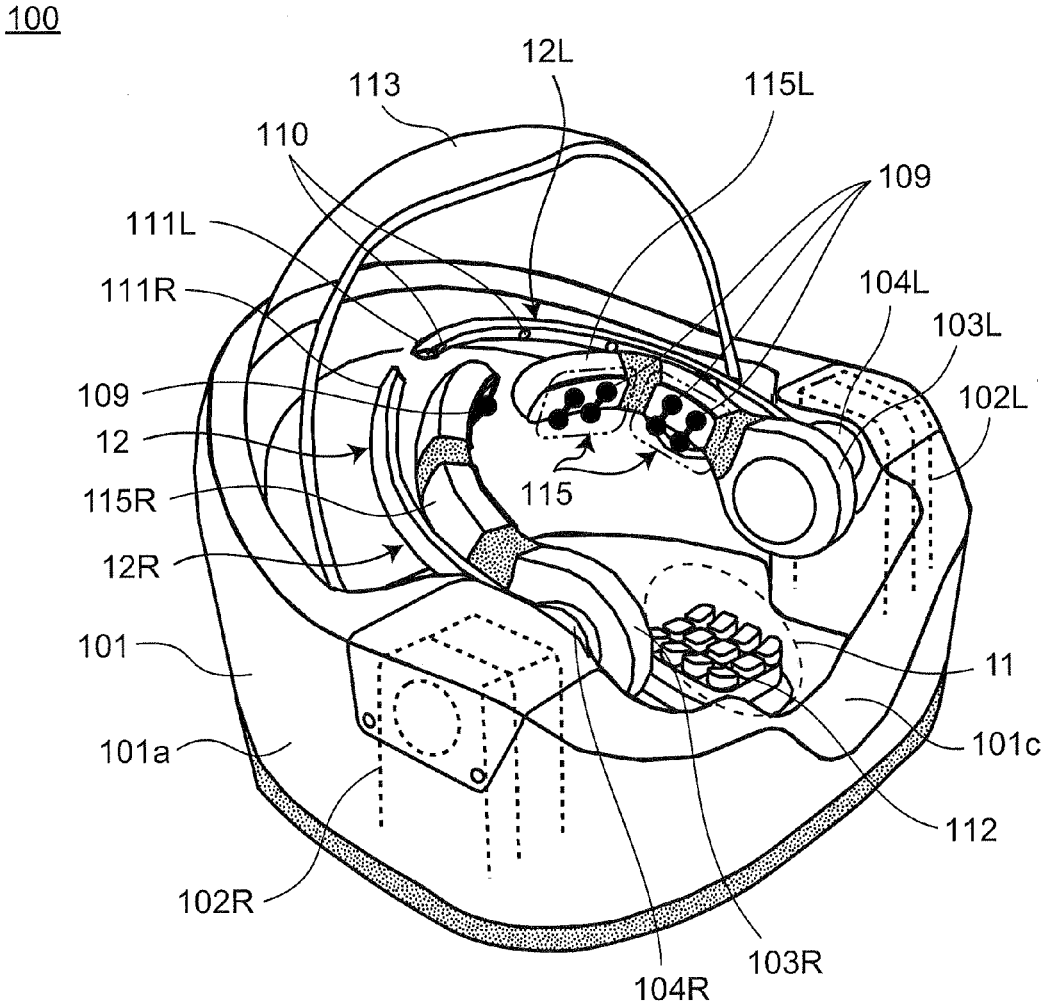
FIG. 1 is a diagram showing a schematic configuration of an automatic hair washing apparatus according to a first embodiment of the present invention.

With reference to the accompanying drawings, several embodiments according to the invention will be described hereinafter. Like elements are denoted by like reference numerals to avoid duplicate descriptions. Also, each drawing mainly shows structural element or elements schematically for the better understanding thereof.

First Embodiment

Figure 2:
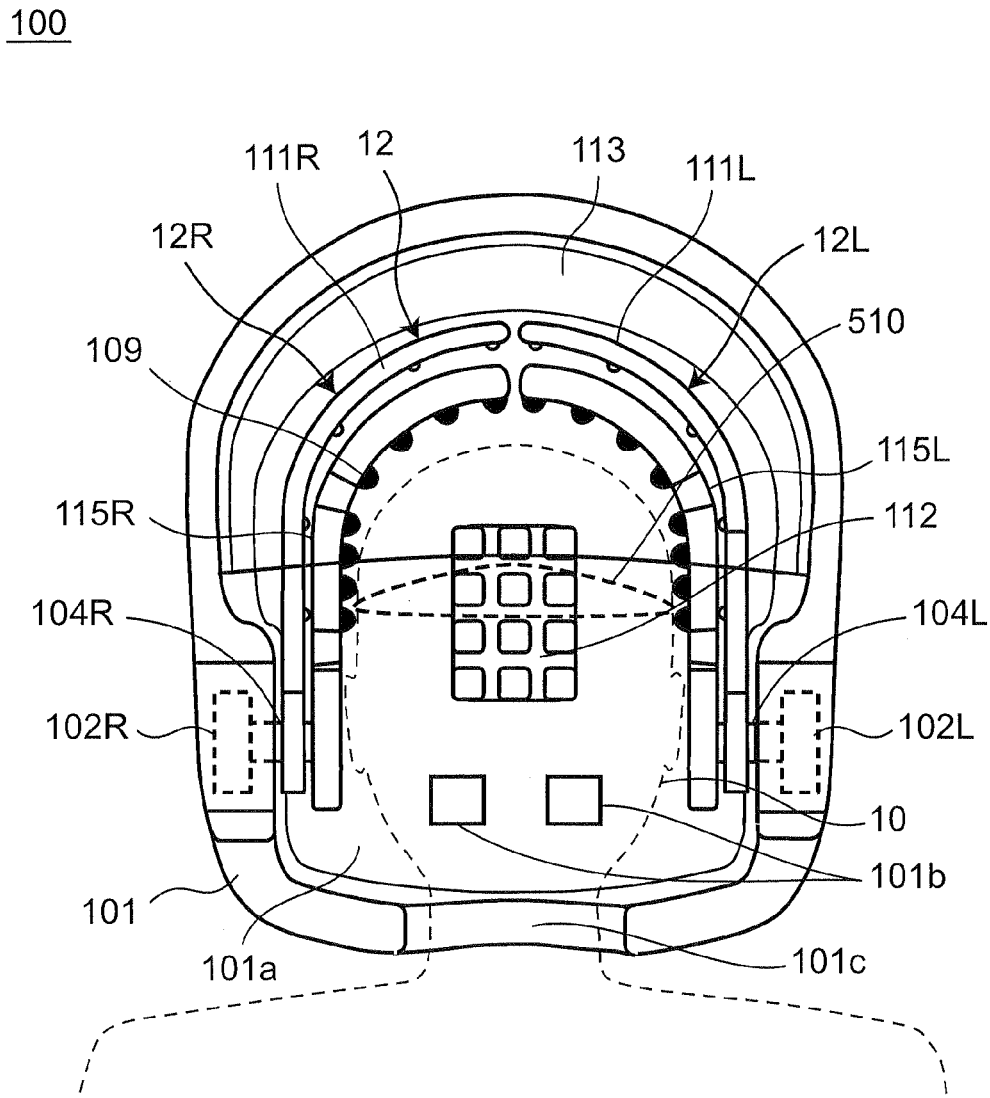
FIG. 2 is a plan view showing a schematic configuration of the automatic hair washing apparatus according to the first embodiment.
Figure 3:
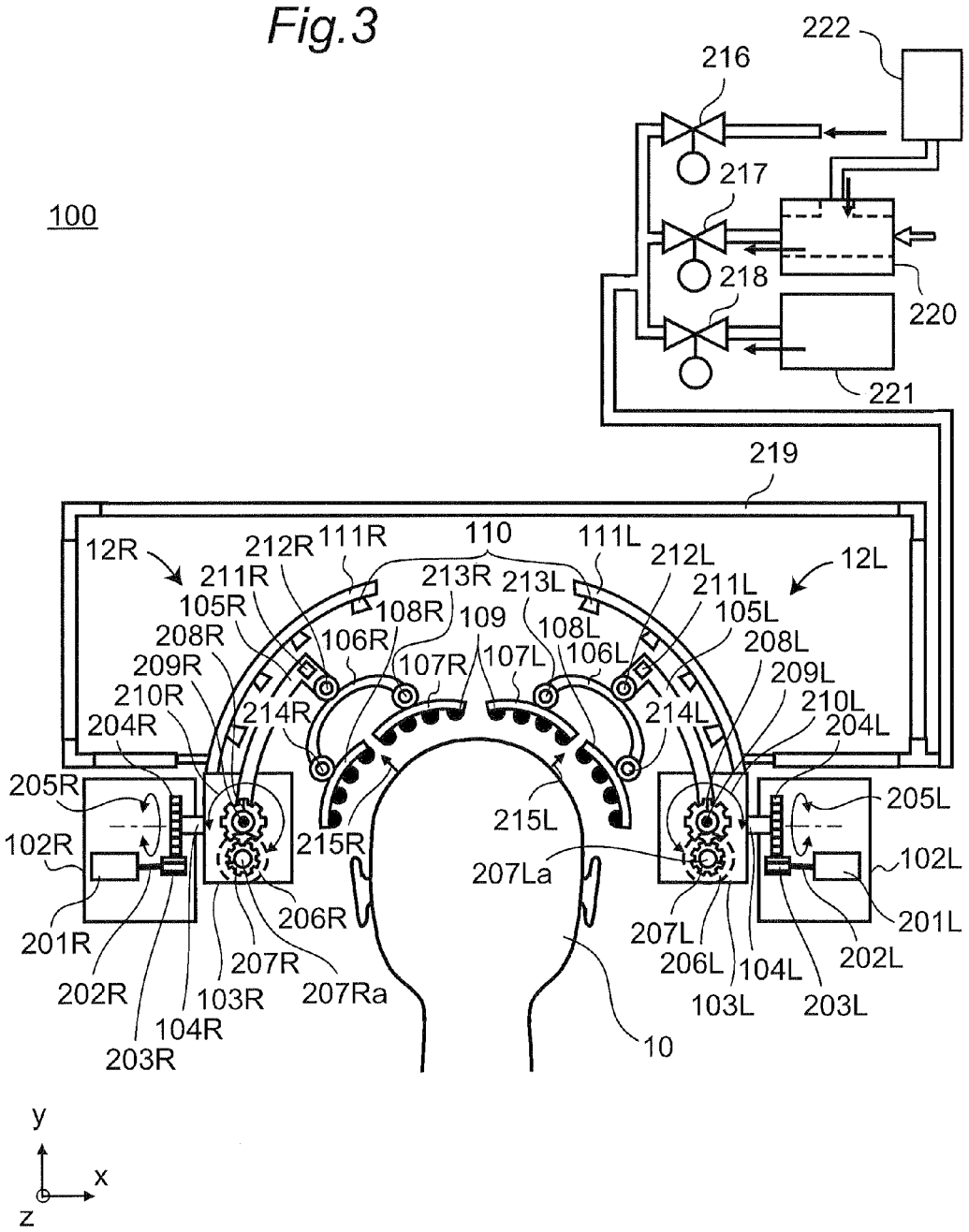
FIG. 3 is a diagram showing a first part of the drive mechanism of the automatic hair washing apparatus according to the first embodiment.
Figure 4:
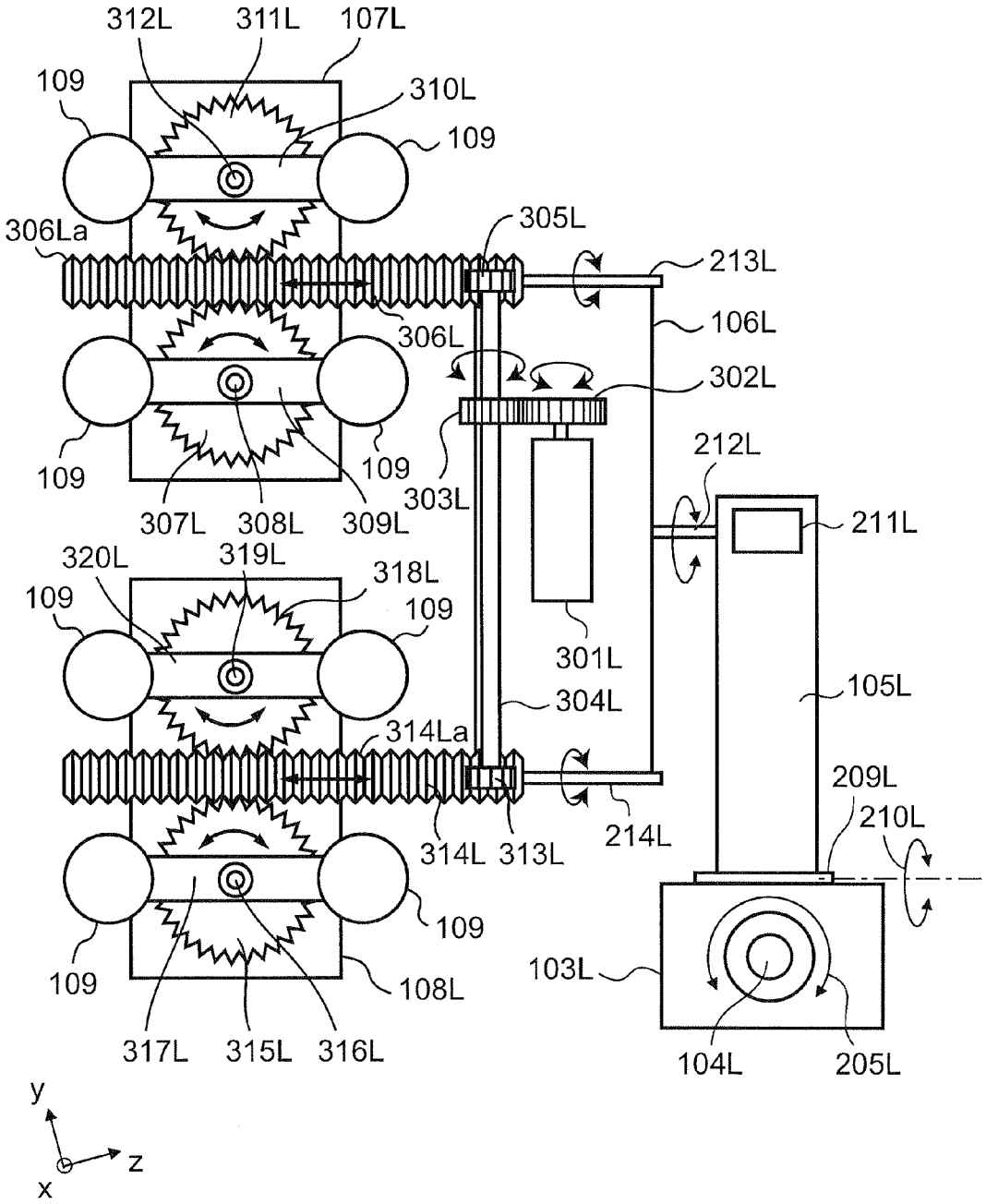
FIG. 4 is a diagram showing a second part of the drive mechanism of the automatic hair washing apparatus according to the first embodiment.

FIG. 1 is a perspective view schematically showing a general construction of an automatic hair washing apparatus according to the first embodiment of the invention. FIG. 2 is a plan view schematically showing a general construction of the automatic hair washing apparatus according to the first embodiment. FIG. 3 is a diagram showing a first part of drive mechanism of the automatic hair washing apparatus according to the first embodiment. FIG. 4 is a diagram showing a second part of the drive mechanism of the automatic hair washing apparatus according to the first embodiment. It should be noted that in FIGS. 3 and 4 a vertical direction is indicated as Z-axis and two horizontal orthogonal directions are indicated as X- and Y-axes.

As shown in FIG. 1 and FIG. 2, the automatic hair washing apparatus 100 according to the first embodiment comprises a base or bowl 101. The bowl 101 is shaped and sized to surround substantial back half of a person's (user's) head 10 and has head support 11 for supporting the head 10. The bowl 101 has a housing 101*a* which encloses support columns 102L and 102R mounted thereinside on the left and right sides of the head support 11 to oppose each other through the head support 11. The support columns 102L and 102R are arranged with the head support 11 interposed therebetween.

The automatic hair washing apparatus 100 comprises a pair of washing units 12 provided inside the bowl 101 for washing person's head 10 positioned within the bowl 101. In the embodiment, the washing units 12 are made of left washing unit 12L and right washing unit 12R. The left washing unit 12L is an example of first washing unit, and the right washing unit 12R is an example of second washing unit.

The left washing unit 12L has a support shaft 104L coupled to the support column 102L so that it rotates about the support shaft 104L. Likewise, the right washing unit 12R has a support shaft 104R coupled to the support column 102R so that it rotates about the support shaft 104R.

As shown in FIG. 3, the left washing unit 12L comprises arms 105L, 106L, 107L, and 108L and a pipe 111L, which are positioned to oppose the head support 11. The arms 105L, 106L, 107L, and 108L are formed into a substantially arcuate or linear shape. The pipe 111L is formed into a substantially arcuate shape.

The pipe 111L of the left washing unit 12L comprises a plurality of nozzles 110 for ejecting at least one of cold water, hot water, washing agent, and conditioner. The nozzles 110 are mounted on a surface opposing the head support 11 of the pipe 111L. The pipe 111L is attached to an arm base 103L fixed to the support shaft 104L, so as to rotate with the rotation of the arm base 103L about the support shaft 104L.

The arms 105L, 106L, 107L, and 108L are attached to the arm base 103L fixed to the support shaft 104L. The first arm 105L is attached to the arm base 103L to rotate with the rotation of the arm base 103L about the support shaft 104L.

The first arm 105L rotatably supports the second arm 106L which in turn rotatably supports two third arms 107L and 108L each carrying a plurality of contacts 109 on a surface opposite to the surface supported by the support shaft 104L (a surface opposing the person's head 10 supported by the head support 112), the contacts 109 being adapted to make contacts with person's head 10. For this purpose, the contacts 109 are made of flexible rubber material.

The first to third arms 105L, 106L, 107L and 108L are accommodated within an arm housing 115L and the contacts 109 are arranged at the exterior of the arm housing 115L. The second and third arms 106L, 107L and 108L may be supported by the first and second arms 105L and 106L, respectively, so that the arms 106L, 107L and 108L take respective balanced positions automatically.

As shown in FIG. 3, a motor 201L is arranged within an interior of the support column 102L so that a rotation of the motor 201L is transmitted to the support shaft 104L through a gear 203L mounted on the output shaft 202L of the motor 201L and a gear 204L mounted on the support shaft 104L, which causes the arm base 103L on the support shaft 104L to rotate in a direction indicated by an arrow 205L.

A motor 206L is mounted within an interior of the arm base 103L so that a rotation of the motor 206L is transmitted to the first arm 105L through a gear 207L mounted on the motor output shaft 207La and a gear 208L mounted on an arm shaft 209L of the first arm 105L, which causes the first arm 105L to rotate about the shaft 209L in a direction indicated by an arrow 210L.

The first arm 105L comprises a pressure sensor 211L for detecting a force to be applied on the head 10 and rotatably supports the second arm 106L through the support shaft 212L. The second arm 106L rotatably supports the third arms 107L and 108L through the support shafts 213L and 214L.

FIG. 4 is a diagram showing the third arms 107L and 108L viewed in the normal direction 215L from the head 10, in which an arrangement of the arm base 103L, the first arm 105L, and the second arm 106L is schematically indicated for the purpose of describing a drive transmission system.

As shown in the drawing, a motor 301L is mounted within an interior of the second arm 106L so that a rotation of the motor 301L is transmitted to a drive shaft 304L through a gear 302L mounted on the motor's output shaft and a gear 303L mounted on the drive shaft 304L, which allows the drive shaft 304L to be rotated by the driving of the motor 301L.

A rotation of a gear 305L attached to one end of the drive shaft 304L is transmitted through a cylindrical rack 306L to gears 307L and 311L mounted on the third arm 107L. The cylindrical rack 306L is designed to move along the support shaft 213L, so that the movement of the cylindrical rack 306L causes the gears 307L and the 311L to rotate about the rotational shafts 308L and 312L, respectively. The cylindrical rack 306L is rotatably supported by the second arm 106L through the support shaft 213L to move in a direction parallel to the support shaft 213L.

The cylindrical rack 306L is formed cylindrically in its entirety to comprise rack mechanisms 306La defined on its longitudinal opposite side surfaces in a symmetric manner with respect to the longitudinal axis of the rack. The cylindrical rack 306L is designed so that the rack mechanism 306La engages with the gear 305L mounted on the drive shaft 304L and the gears 307L and 311L.

The gear 307L carries the fourth arm 3 L and two contacts 109 connected by the arm 309L so that the contacts 109 move with the rotation of the gear 307L. Likewise, the gear 311L carries another fourth arm 310L and two contacts 109 connected by the arm 310L so that the contacts 109 move with the rotation of the gear 311L.

A rotation of a gear 313L attached to the other end of the drive shaft 304L is transmitted through a cylindrical rack 314L to gears 315L and 318L mounted on the third arm 108L. The cylindrical rack 314L is designed to move along the support shaft 214L, so that the movement of the cylindrical rack 314L causes the gears 315L and the 318L to rotate about the rotational shafts 316L and 319L, respectively. The cylindrical rack 314L is formed cylindrically in its entirety to comprise rack mechanisms 314La defined on its longitudinal opposite side surfaces in a symmetric manner with respect to the longitudinal axis of the rack and is rotatably supported by the second arm 106L through the support shaft 214L to move in a direction parallel to the support shaft 214L.

The gear 315L carries the fourth arm 317L and two contacts 109 connected by the arm 317L so that the contacts 109 move about the rotational shaft 316L with the rotation of the gear 315L. Likewise, the gear 318L carries another fourth arm 320L and two contacts 109 connected by the arm 320L so that the contacts 109 move about the rotational shaft 319L with the rotation of the gear 318L.

Figure 5A:
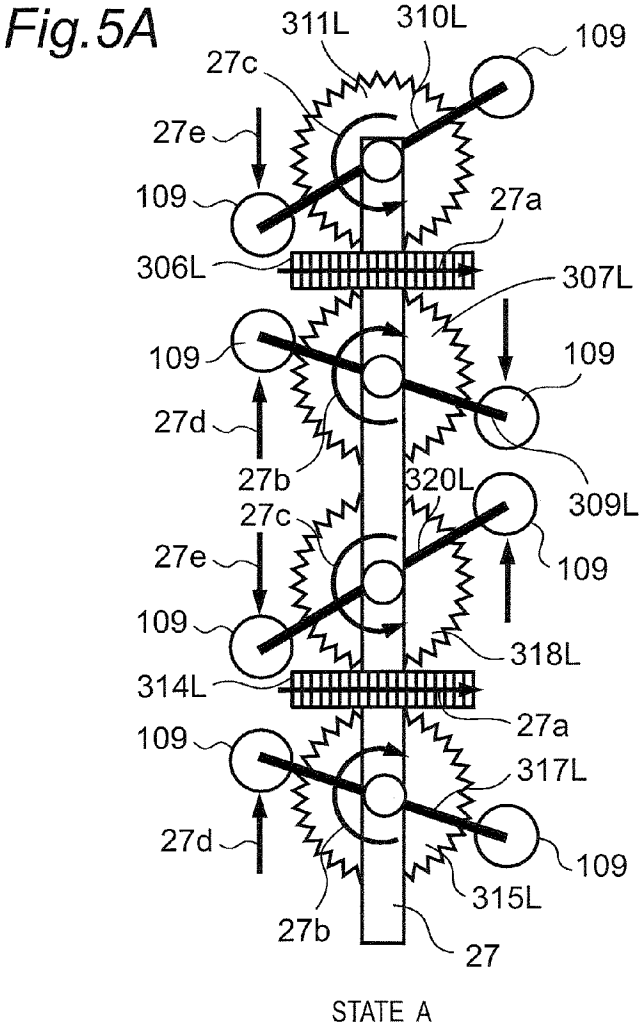
FIGS. 5A and 5B are diagrams showing a third part of the drive mechanism of the automatic hair washing apparatus according to the first embodiment.
Figure 5B:
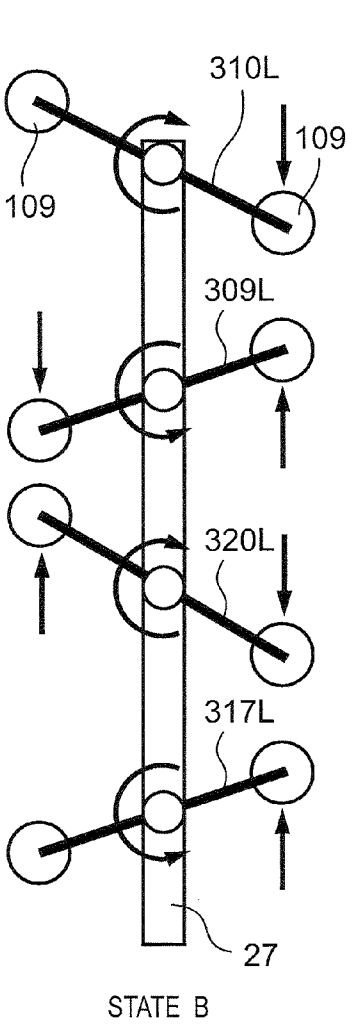

FIGS. 5A and 5B are diagrams describing an operation of a third part of a drive mechanism of the automatic hair washing apparatus according to the first embodiment. In the drawings, illustrated are the cylindrical racks 306L and 314L supported by the second arm 106L, the gears 307L, 311L, 315L, and 318L attached to the third arms 107L and 108L, the fourth arms 309L, 310L, 317L, and 320L, and the contacts 109. In the drawings, the second arm 106L and the third arms 107L and 108L are indicated as solid bars 27.

As shown in FIG. 5A, in the left washing unit 12L, the gears 307L and 311L provided adjacent to and on opposite sides of the cylindrical rack 306L are rotated in the direction indicated by arrows 27*b* and 27*c*, respectively, when the cylindrical rack 306L is moved in the direction indicated by arrow 27*a*. Simultaneously with this, the contacts 109 attached to the gears 307L and 311L through the fourth arms 309L and 310L are moved in opposite directions indicated by arrows 27*d* and 27*e*, respectively.

Likewise, the cylindrical rack 314L is moved in the direction indicated by arrow 27*a* with the movement of the cylindrical rack 306L, which causes the gears 315L and 318L provided adjacent to and on opposite sides the cylindrical rack 314L to rotate in the directions indicated by arrows 27*b* and 27*c*, respectively. Simultaneously with this, the contacts 109 attached to the gears 315L and 318L through the fourth arms 317L and 320L are moved in opposite directions indicated by arrows 27*d* and 27*e*, respectively.

When the cylindrical racks 306L and 314L are moved in the direction indicated by arrow 27*a*, the adjacent gears 307L and 318L, which are attached to the different third arms 107L and 108L provided adjacent to each other, are rotated in the opposite directions to each other. The contacts 109 attached to the gears 307L and 318L through the fourth arms 309L and 320L are moved in opposite directions indicated by arrows 27*d* and 27*e*. Thus, when the cylindrical racks 306L and 314L are moved in the direction indicated by arrow 27*a*, the two contacts 109 opposed in a direction orthogonal to the longitudinal axes of the cylindrical racks 306L and 314L are moved to and away from each other, in the directions indicated by arrows 27*d* and 27*e*.

If the cylindrical racks 306L, 314L are moved in the direction indicated by the arrow 27*a* as the contacts 109 are kept in contact with the scalp of a person, the units of the scalp under the contacts 109 are frictionally forced to and away from each other, which ensures that person's scalp skins are contracted and stretched and massaged by the contacts.

If the cylindrical racks 306L, 314L are moved in the direction indicated by the arrow 27*a* as the contacts 109 are kept in contact with the hair of a person, the hair between the contacts 109 is pushed and pulled by the contacts 109, which ensures that person's hair is displaced in various directions and massaged by the contacts.

As shown in FIG. 5B, when the cylindrical racks 306L and 314L are moved in the direction opposite to that indicated by arrow 27*a*, the gears 307L, 311L, 315L, and 318L and the contacts 109 are moved in the directions opposite to respective directions shown in FIG. 5A. The contacts 109 of the left washing unit 12L are rotated alternately between a position in a state A shown in FIG. 5A and a position in a state B shown in FIG. 5B by moving the cylindrical racks 306L and 314L in the directions indicated by the arrow 27*a* and opposite to the arrow 27*a* alternately. As a result, the massaging can be performed to the person's head 10 by rotating the contacts 109.

The right washing unit 12R is similar in construction to the left washing unit 12L. The right washing unit 12R comprises arms 105R, 106R, 107R, and 108R and a pipe 111R. The arms 105R, 106R, 107R, and 108R and the pipe 111R are positioned to oppose the head support 11. The pipe 111R is similar in construction to the pipe 111L, and is attached to the arm base 103R fixed to the support shaft 104R.

The arms 105R, 106R, 107R, and 108R are attached to the arm base 103R fixed to the support shaft 104R. The first arm 105R is attached to the arm base 103R to rotate with the rotation of the arm base 103R about the support shaft 104R.

The first arm 105R rotatably supports the second arm 106R which in turn rotatably supports two third arms 107R and 108R each carrying a plurality of contacts 109 adapted to make contacts with person's head 10. The first to third arms 105R, 106R, 107R and 108R are accommodated within an arm housing 115R and the contacts 109 are arranged at the exterior of the arm housing 115R.

As shown in FIG. 3, a motor 201R is arranged within an interior of the support column 102R so that a rotation of the motor 201R is transmitted to the support shaft 104R through a gear 203R mounted on the output shaft 202R of the motor 201R and a gear 204R mounted on the support shaft 104R, which causes the arm base 103R on the support shaft 104R to rotate in a direction indicated by an arrow 205R.

A motor 206R is mounted within an interior of the arm base 103R so that a rotation of the motor 206R is transmitted to the first arm 105R through a gear 207R mounted on the motor output shaft 207Ra and a gear 208R mounted on an arm shaft 209R of the first arm 105R, which causes the first arm 105R to rotate about the shaft 209R in a direction indicated by an arrow 210R.

The first arm 105R comprises a pressure sensor 211R for detecting a force to be applied on the head 10 and rotatably supports the second arm 106R through the support shaft 212R. The second arm 106R rotatably supports the third arms 107R and 108R through the support shafts 213R and 214R.

Each of the third arms 107R and 108R carries two gears designed to engage with a cylindrical rack. The gear carries a fourth arm and two contacts 109 connected by the fourth arm so that the contacts 109 move with the rotation of the gear by the driving of a motor 301R (see FIG. 14) mounted within an interior of the second arm 106R. The cylindrical rack of the right washing unit 12R is rotatably supported by the second arm 106R through the support shafts 213R or 214R to move in a direction parallel to the support shaft 213R or 214R.

Figure 6:
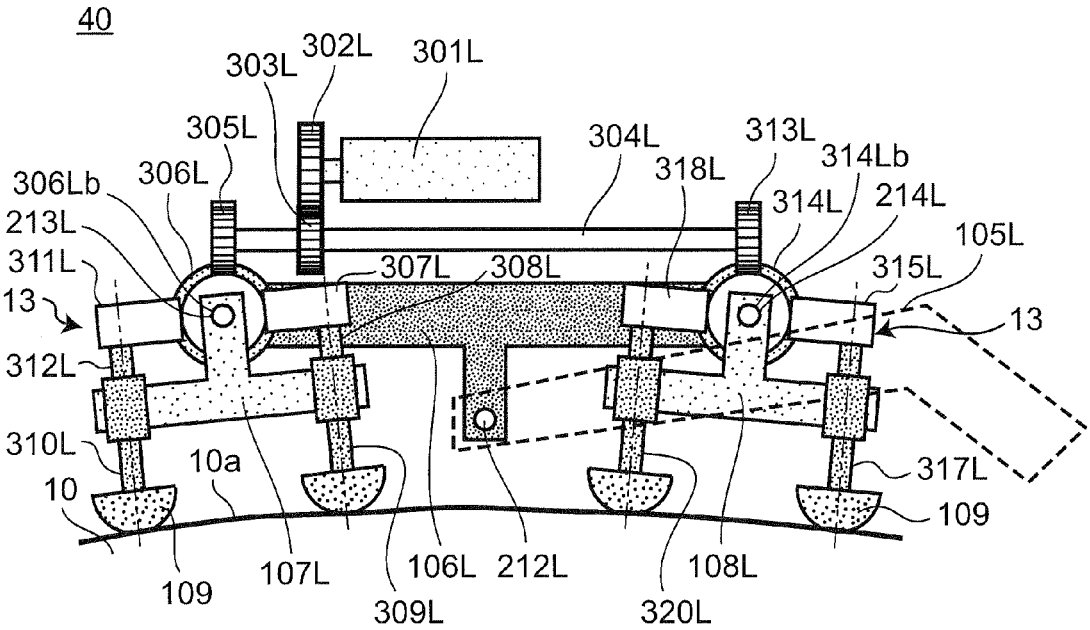
FIG. 6 is a diagram showing a second part of the drive mechanism of the automatic hair washing apparatus according to the first embodiment.
Figure 7:
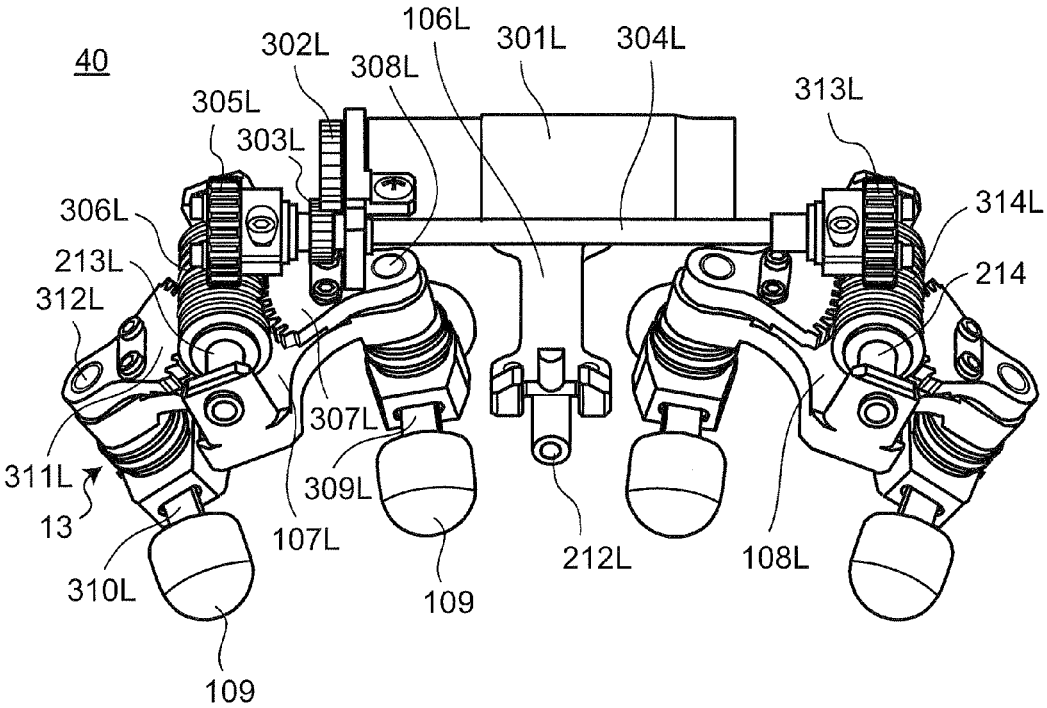
FIG. 7 is a diagram showing a second part of the drive mechanism of the automatic hair washing apparatus according to the first embodiment.

The second part of the drive mechanism of the automatic hair washing apparatus according to the first embodiment will be further described. FIG. 6 is a side view showing the second part of the drive mechanism of the automatic hair washing apparatus according to the first embodiment. FIG. 7 is a perspective view showing the second part of the drive mechanism of the automatic hair washing apparatus according to the first embodiment. FIGS. 6 and 7 show one example of a head care unit constructed mainly from the second arm and the third arms. In FIGS. 6 and 7, the second arm and the third arms are formed into a substantially liner shape and the gears mounted on the third arms are formed into a fan shape.

As shown in FIGS. 6 and 7, a head care unit 40 of the automatic hair washing apparatus 100 is constructed mainly from the second arm 106L, the third arms 107L and 108L. The head care unit 40 comprises the drive shaft 304L for transmitting the rotation of the motor 301L mounted within the second arm 106L, two cylindrical racks 306L and 314L respectively engaging with the gear 305L and 313L mounted on both ends of the drive shaft 304L, and the third arms 107L and 108L rotatably supported by the support shaft 213L and 214L that coincide with the central axes 306Lb and 314Lb of the two cylindrical racks 306L and 314L, respectively.

In the head care unit 40, the rotation output of the motor 301L is transmitted through the gears 305L and 313L mounted on both ends of the drive shaft 304L and the cylindrical racks 306L and 314L to the gears 307L, 311L, 315L, and 318L attached to the third arms 107L and 108L. The gears 307L, 311L, 315L, and 318L are rotated by the driving of the rotation of the motor 301L, which causes the two contacts 109 attached to each gear 307L, 311L, 315L, 318L to move with the rotation of each gear 307L, 311L, 315L, 318L.

The two cylindrical racks 306L and 314L are rotatably supported by the second arm 106L through the support shafts 213L and 214L. The gear 307L engaged with the cylindrical rack 306L is fixed to a rotational shaft 308L supported rotatably by the third arm 107L. A fourth arm 3 L connecting the two contacts 109 is connected to the rotational shaft 308L. Thus, the gear 307L and the contacts 109 are integrally rotated about the rotational shaft 308L. The rotational shaft 308L is adapted to maintain the state in which the cylindrical rack 306L engages with the gear 307L. For example, the rotational shaft 308L may be provided with two flanges located above and below the third arm 107L to sandwich the third arm 107L.

The gears 311L, 315L, and 318L are similar in construction to the gear 307L. The gears 311L, 315L, and 318L are adapted to rotate integrally with the contacts carried by the respective gears 311L, 315L, and 318L about the respective gears 311L, 315L, and 318L. In the head care unit 40, which serves as a head care system, the gear 307L, the rotational shaft 308L, the fourth arm 309L, and the contacts 109 attached to the third arm 107L compose a contact unit 13 that makes contact with person's head 10. The contact unit 13 comprises gear 307L having a central axis for rotating the two contacts 109 positioned at the distal end of the fourth arm 309L.

Figure 8A:
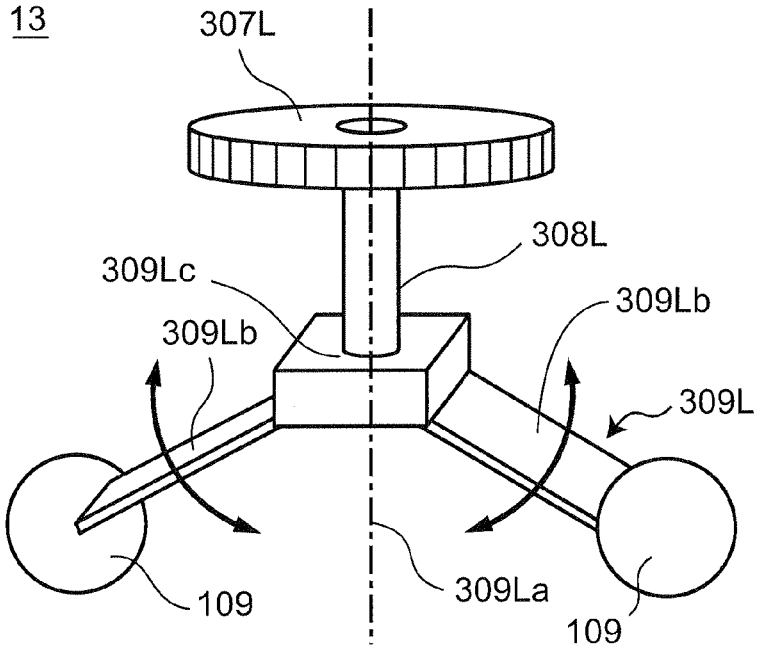
FIGS. 8A and 8B are diagrams showing a schematic configuration of a contact unit of the automatic hair washing apparatus according to the first embodiment.
Figure 8B:
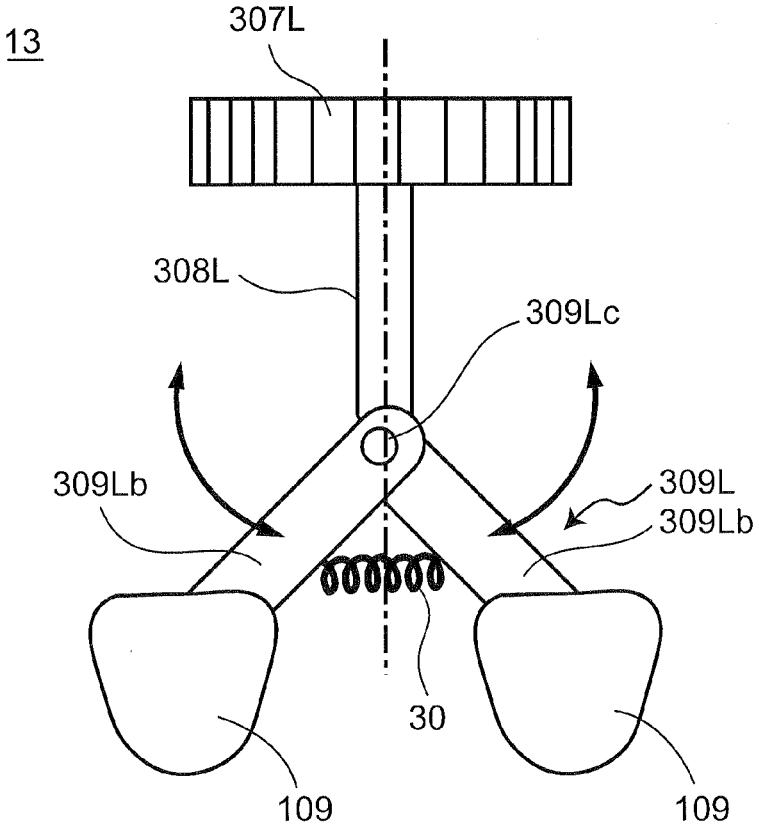

FIGS. 8A and 8B are diagrams showing a schematic configuration of the contact unit of the automatic hair washing apparatus according to the first embodiment. In the drawings, the gear 307L attached to the third arm 107L is shown as a circular gear for the better understanding of the contact unit. As shown in FIG. 8A, the fourth arm 309L of the contact unit 13 is formed into a substantially V-shape and comprises two contacts 109 that make contact with the person's head 10 at the end thereof. In the contact unit 13, an axis of symmetry 309La of the fourth arm 309L is arranged to coincide with an axis of the rotational shaft 308L fixed to the gear 307L.

As described above, the gear 307L and the contacts 109 of the contact unit 13 are integrally rotated about the rotational shaft 308L. In the contact unit 13, the two contacts 109 are rotated about the rotational shaft 308L. Alternatively, the two contacts 109 may be designed to move in a direction along a line connecting the two contacts 109 or to move in a direction orthogonal to the line.

The fourth arm 309L comprises a pair of branches 309Lb and a connection 309Lc for connecting the two branches 309Lb. Each branch 309Lb comprises the contact 109 at the end thereof. The two branches 309Lb are arranged in a V-shape and positioned in a symmetric manner with respect to the axis 309La. The two branches 309Lb are connected to the connection 309Lc at a vertex of the two branches 309Lb. The connection 309Lc is fixed to the rotational shaft 308L.

In the contact unit 13, the fourth arm 309L is configured to include an elastic body in at least one part of a region from the vertex of the branches 309Lb arranged in a V-shape to the contact 109. In the fourth arm 309L of the contact unit 13 shown in FIG. 8A, the branch 309Lb is configured by a plate spring.

In the contact unit 13, when the pushing force of the contact unit 13 applied on a person's head 10 becomes large, the distance between the vertex of the two branches 309Lb arranged in a V-shape and the person's head 10 becomes small and the distance between two contacts 109 becomes large. When the pushing force of the contact unit 13 applied on a person's head 10 becomes small with the two contacts 109 brought into contact with the person's head 10, the distance between the vertex of the two branches 309Lb arranged in a V-shape and the person's head 10 becomes large and the distance between two contacts 109 becomes small.

Thus, when the pushing force of the contact unit 13 on the person's head 10 is changed with the two contacts 109 brought into contact with the person's head 10, the distance between the vertex of the two branches 309Lb arranged in a V-shape and the person's head 10 is changed and the distance between two contacts 109 is changed. In the automatic hair washing apparatus 100, the distance between two contacts 109 of the contact unit 13 can be adjusted by changing the pushing force of the contact unit 13 on the person's head 10, so that the washing of person's head 10 can be performed in an effective and reliable manner in accordance with the shape of the person's head 10.

When the contact unit 13 is moved along the person's head 10, the contacts 109 of the contact unit 13 are smoothly moved in an effective manner along the surface shape of the scalp 10*a* of the person's head 10. The contact 109 applies a shearing force to the scalp 10*a* by the movement thereof along the scalp 10*a* and applies a pressing force in a perpendicular direction to the scalp 10*a* by the pressing thereof against the scalp 10*a*. In the automatic hair washing apparatus 100, the washing can be performed while slightly changing the position of the contact 109 in accordance with the shape of the person's head 10. This ensures the hair washing apparatus 100 to wash the entire person's head 10 in a uniform and effective manner.

In the contact unit 13, when the contact 109 is pressed against a person's head 10, the axis of symmetry 309La of the fourth arm 309L carrying the contacts 109 is directed toward the center of the person's head 10 and the contact 109 is positioned on a line normal to the person's head 10 with the contact 109 kept in contact with the person's head 10.

When the contacts 109 are pressed against a person's head, the contacts 109 are forced in the direction of the center of the person's head 10 by elastic force of the branch 309Lb formed as a plate spring and the contacts 109 can be accurately positioned in accordance with the surface shape of the scalp 10*a* of the person's head 10. Thus, the person's head 10 can be smoothly washed in a effective manner.

The contact unit 13 may comprise an opening angle adjustment mechanism adapted to be capable of changing an opening angle between the pair of V-arranged branches 309Lb. The opening angle between the pair of branches 309Lb can be elastically maintained in a predetermined angular range by the opening angle adjustment mechanism. The opening angle adjustment mechanism is preferably adapted to adjust the opening angle between the pair of branches 309Lb within an angular range from 60° to 150°.

In the contact unit 13 shown in FIG. 8A, the pair of branches 309Lb of the fourth arm 309L is configured by a plate spring. Alternatively, as shown in FIG. 8B, the pair of branches 309Lb may be adapted to rotate about a connection 309Lc at a vertex of the two branches 309Lb with the two branches 309Lb connected by a coil spring 30.

In the head care unit 40 comprising the contact units 13 so constructed, each of the third arms 107L and 108L rotatably supports the two contacts units 13 and the third arms 107L and 108L are rotatably supported by the second arm 106L through the respective support shaft 213L and 214L.

The second arm 106L is rotatably supported by the first arm 105L through the support shaft 212L. The second arm 106L moves in the direction approaching the person's head 10, when the first arm 105L rotates about the support shaft 212L in a direction approaching the person's head 10, which causes the contacts 109 carried by the third arm 107L and 108L to make contact with the person's head 10.

Figure 9A:
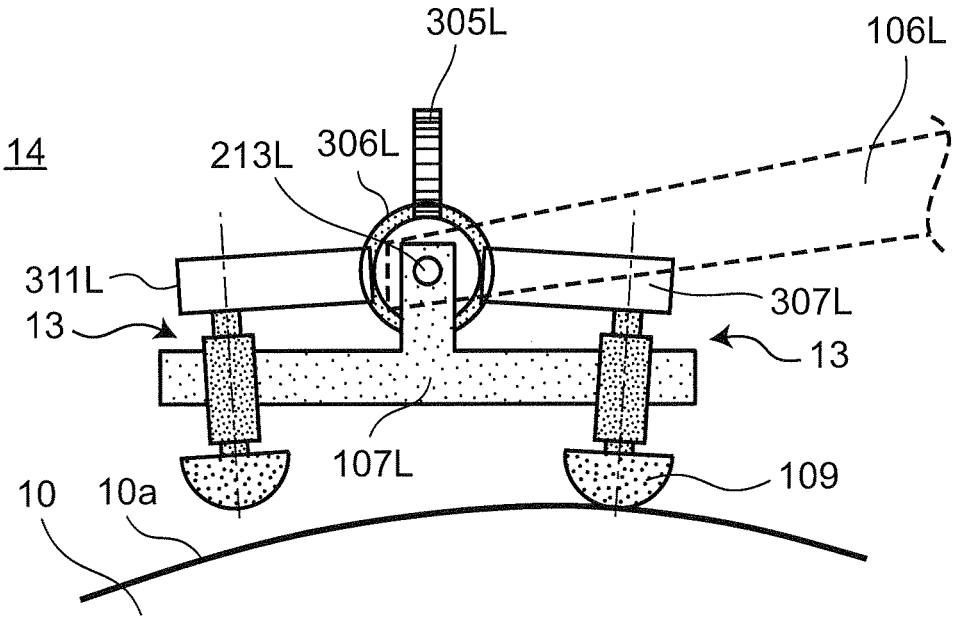
FIGS. 9A and 9B are diagrams describing an operation of a fourth part of a driving mechanism of the automatic hair washing apparatus according to the first embodiment.
Figure 9B:
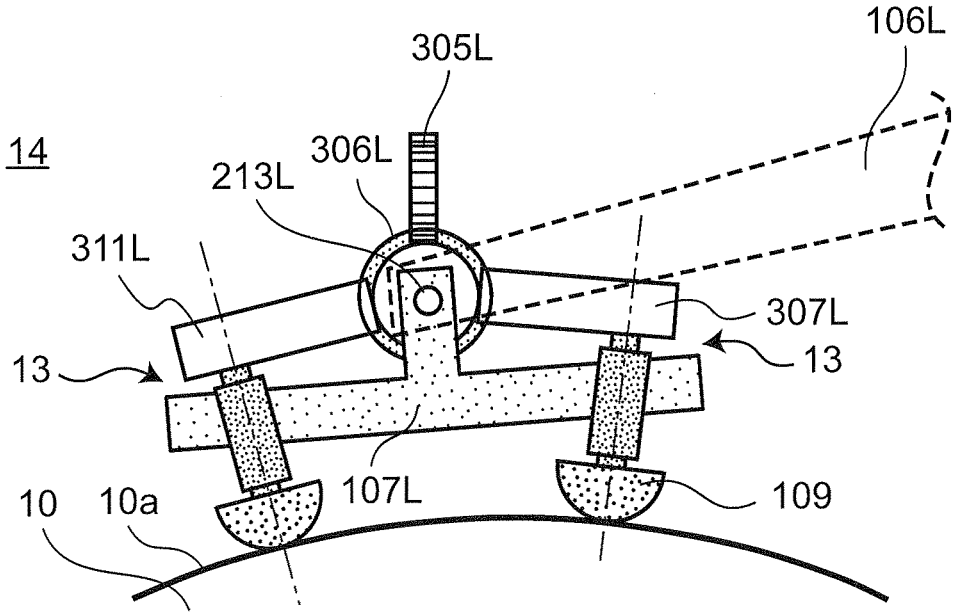

FIGS. 9A and 9B are diagrams describing an operation of a fourth part of a driving mechanism of the automatic hair washing apparatus according to the first embodiment. In the drawings, illustrated are the contacts 109 of the two contact units 13, making contact with the scalp 10*a* of person's head 10. As shown in FIGS. 9A and 9B, one split unit 14 is constructed mainly from the two contact units 13, the third arm 107L to which the two contact units 13 are attached, and the cylindrical rack 306L connected to the third arm 107L through the support shafts 213L and supported by the second arms 106L. In the drawings, illustrated is also the gear 305L that engages with the cylindrical rack 306L.

As shown in FIG. 9A, the third arm 107L moves in the direction approaching the person's head 10, when the second arm 106L moves in a direction approaching the person's head 10, which causes one of the two contact units 13 attached to the third arm 107L to press against the scalp 10*a* of the person's head 10. The movement of the second arm 106L in the direction approaching the person's head 10 is caused by the movement of the first arm 105L in the direction approaching the person's head 10, and the movement of the first arm 105L is caused by controlling the driving of the motor 206L.

When one of the two contact units 13 attached to the third arm 107L is pressed against the scalp 10*a* of the person's head 10, the two contacts 109 of the one contact unit 13 are moved away from each other in a direction orthogonal to a direction in which the two contacts 109 is pressed against the scalp 10*a* of the person's head 10. In FIGS. 9A and 9B, illustrated are the two contacts 109 of the contact unit 13, arranged in a direction perpendicular to the sheet on which FIGS. 9A and 9B is drawn, and overlapped.

Furthermore, when the second arm 106L is moved in the direction approaching the person's head 10, the pushing force of the contact unit 13 applied on the person's head 10 is increased, which causes the third arm 107L to be tilted, as the one contact unit 13 is kept in contact with the scalp 10*a* of the person's head 10, as shown in FIG. 9B. The tilting of the third arm 107L causes the other of the two contact unit 13 attached to the third arm 107L to be pressed against the scalp 10*a* of the person's head 10. The engagement of the cylindrical rack 306L and the gears 307L and 311L is maintained when the third arm 107L is tilted.

Back to FIG. 3, in the automatic hair washing apparatus 100, the pushing force of the contact unit 13 applied on the person's head 10 can be changed by controlling the driving of the motor 206L. The motor 206L serves as a pushing actuator for changing the pushing force. The driving of the motor 206L can be controlled based on a force applied on the person's head 10 detected by the pressure sensor 211L and 211R so that a predetermined pressure is applied on the person's head 10. The contacts 109 are optimally positioned to press against the person's head 10 in accordance with the shape of various units of the person's head 10, and the person's hair can be washed while applying an optimum contact force on the person's head 10.

The contacts 109 may comprise a pressure sensor for detecting the contact thereof with the person's head 10 so that the driving of the motor 206L may be controlled based on a detection signal from the pressure sensor. The third arm 107L and 108L of the split unit 14 may comprise a distance sensor for detecting a distance with the person's head 10 so that the driving of the motor 206L may be controlled based on a detection signal from the distance sensor.

In the head care unit 40, the second arm 106L rotatably supports the third arms 107L and 108L through the support shafts 213L and 214L and rotatably supports the two split units 14 in a longitudinal direction of the left washing unit 12L. The second arm 106L is rotatably supported by the first arm 105L through the support shaft 212L.

In the head care unit 40, when the second arm 106L is moved in a direction approaching the person's head 10, the third arm 107L is moved in the direction approaching the person's head 10, which causes one of the two split units 14 attached to the second arm 106L to be pressed against the scalp 10*a* of the person's head 10. Furthermore, when the second arm 106L is moved in the direction approaching the person's head 10, the other of the two split units 14 is pressed against the scalp 10*a* of the person's head 10. In this way, the respective contacts 109 of the two split units 14 on a side opposing the head support 11 thereof make contacts with scalp 10*a* of the person's head 10.

As above, a head care unit according to the present embodiment comprises the contact unit 13 having a plurality of contacts 109 at the end thereof and having the gears 307L, 311L, 315L, and 318L, the third arms 107L and 108L, the support shafts 213L and 214L, the cylindrical racks 306L and 314L, and a motor 301L. The gears 307L, 311L, 315L, and 318L may be rotation gears having respective central axes thereof for rotating the plurality of contacts 109. The third arms 107L and 108L may be tilt stages rotatably supports the contact units 13. The support shafts 213L and 214L may be tilt stage rotational shafts on which the third arms 107L and 108L are rotatably mounted. The cylindrical rack 306L and 314L is supported so as to be movable along the support shafts 213L and 214L. The movement of the cylindrical rack 306L and 314L along the support shafts 213L and 214L rotates the gears 307L, 311L, 315L, and 318L of the contact units 13. The motor 301L may be a oscillating actuator for oscillate the contacts 109 by moving the cylindrical rack 306L and 314L along the support shafts 213R and 214R, which rotates the gears 307L, 311L, 315L, and 318L and thereby rotate the contacts 109.

The head care system 40 comprises a pushing mechanism for moving the support shafts 213L and 214L in a direction approaching person's head 10. The support shafts 213L and 214L are moved in the direction approaching person's head 10 by the pushing mechanism and the contacts 109 are oscillated by the driving of the motor 301L, so that the contacts 109 applies a pressing force on the person's head 10. The pushing mechanism is constructed by the motor 206L, the gears 207L and 208L, the first arm 105L, and the second arm 106L.

Thus, the scalp and hair of person's head 10 can be washed in an effective and reliable manner in accordance with the shape of the person's head 10 in any shape of person's head. According to the arrangement, the usage of water, shampoo and the like can be reduced, and the amount of unclean water in the washing can be reduced.

The head care unit 40 comprises two third arms rotatably supporting the contact units 13, but is not limited to such arrangement, may comprise three or more third arms. As above, the head care unit 40 comprises a plurality of third arms. This makes it possible to wash a wide range of person's head 10 and wash person's head 10 in an effective manner.

In the head care unit 40, the contacts units 13 provided on opposite sides of the cylindrical racks 306L and 314L are horizontally positioned. This makes it possible to thin the head care unit 40 in a thickness direction thereof and make the head care unit 40 smaller.

Furthermore, as shown in FIG. 3, the automatic hair washing apparatus 100 comprises a water system valve 216, a washing agent system valve 217 and a conditioner system valve 218. The output ports of the water system valve 216, the washing agent system valve 217 and the conditioner system valve 218 are connected in parallel, and are connected to the pipes 111L and 111R through the piping 219.

The water system valve 216 comprises an input port connected to a water system supplying unit (not shown), so that cold water or hot water can be supplied in the water system valve 216 from the water system supplying unit. The washing agent system valve 217 comprises an input port connected to a mixing unit 220 so that the foam washing agent can be supplied in the washing agent system valve 217. The mixing unit 200 form the foam washing agent by mixing a washing liquid from the washing liquid supplying unit 222 for supplying the washing liquid such as shampoo and a compressed air. The conditioner system valve 218 comprises an input port connected to a conditioner supplying unit 221, so that the conditioner from the conditioner supplying unit 221 can be supplied in the conditioner system valve 218.

In the automatic hair washing apparatus 100, at least one of cold water, hot water, foam washing agent and conditioner can be ejected through a plurality of nozzles 110 mounted on the pipes 111L and 111R by appropriately controlling the water system valve 216, the washing agent system valve 217, and the conditioner system valve 218.

In the automatic hair washing apparatus 100, the washing unit 12 can be operated in accordance with the shape of the person's head 10, and thereby the person's head 10 can be washed in an effective manner. This makes it possible to reduce the usage of water, shampoo and the like and to reduce the amount of unclean water.

The water system supplying unit and the water system valve 216 constructs a water supplying unit for supplying cold water or hot water to the pair of washing units 12. The washing liquid supplying unit 222, the mixing unit 220 and the washing agent system valve 217 constructs a washing agent supplying unit for supplying the washing agent to the pair of washing units 12. The conditioner supplying unit 221 and the conditioner system valve 218 constructs a conditioner supplying unit for supplying the conditioner to the pair of washing units 12.

In the automatic hair washing apparatus 100, two drain outlets 101*b* are formed in the bottom of the bowl 101. The water and the like used for washing is discharged from the drain outlets 101*b*. The drain outlet 101*b* is connected to a drain pipe (not shown), so that the water and the like can be discharged outside the apparatus 100 through the drainpipe for effluent treatment.

The bowl 101 has a cutout 101*c* for supporting a person's neck. The bowl 101 is provided with a head support 112 for supporting the back of the person's head 10. The head support 112 is designed to move up, down, left and right for positioning. The head support 112 can be positioned based on the position of person's head 10 detected by a position detecting means such as a camera for detecting the position of person's head 10.

The head support 112 is preferably positioned so that the support shafts 104L and 104R of the washing units 12L and 12R are located near person's ear. In particular, the support shafts 104L and 104R are arranged parallel to a centerline of the head support 112 in a location near person's ear. The straining force applied on person's neck can be suppressed by driving the washing units 12L and 12R about the location near person's ear. The automatic hair washing apparatus may be provided with a mechanism for detecting the shape of person's head 10 supported by the head support 112 and position the support shaft 104L and 104R near the person's ear in accordance with the detected shape, which causes the support shafts 104L and 104R to position near person's ear in any shape of person's head. The head support 112 may be designed to wash the back of person's head 10 supported by the head support 112.

The support columns 102L and 102R arranged within the bowl 101 is designed so that the support column 102L and 102R move in the axial direction of the support shafts 104L and 104R coupled to the support columns 102L and 102R. This makes it possible to adjust the distance between the person's head 10 and the arm base 103L and 103R in accordance with the size of the person's head 10 supported by the head support 112.

The bowl 101 is provided with a removable hood 113 for preventing water, shampoo and the like from spattering out of the apparatus 100 during the washing, the hood 113 being adapted to be openable and closable. The hood 113 is preferably made of transparent material so as to give the washed person feelings of pressure and apprehension as little as possible during the washing.

As shown in FIG. 1, the automatic hair washing apparatus 100 may comprise a cover 115 for covering the contacts 109 of the pair of washing unit 12. The cover 115 may be designed to cover one contact 109 or a plurality of contacts 109.

The attachment of the cover 115 to the contacts 109 prevents water, shampoo, dirt and the like, from attaching directly to the contacts 109. When the cover 115 becomes dirty, the cover 115 is replaced. This makes it possible to keep the contact units of the contacts 109 with the person's head 10 clean. The cover 115 may be replaced every time a person to be washed is changed. This makes it possible to wash the person's head 10 while always keeping the contact units of the contacts 109 with the person's head 10 clean.

In the automatic hair washing apparatus 100, the person's head 10 is washed with a water shield 510 attached to the person's head 10.

Figure 10A:
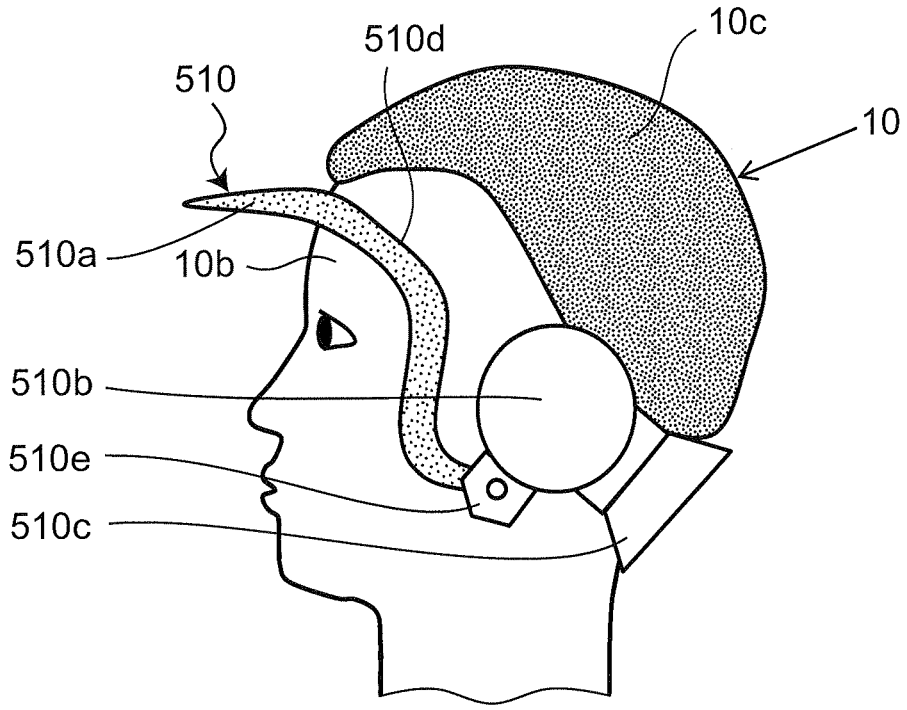
FIGS. 10A and 10B are side views showing a state in which a water shield used in the automatic hair washing apparatus according to the first embodiment is attached to the person's head.
Figure 10B:
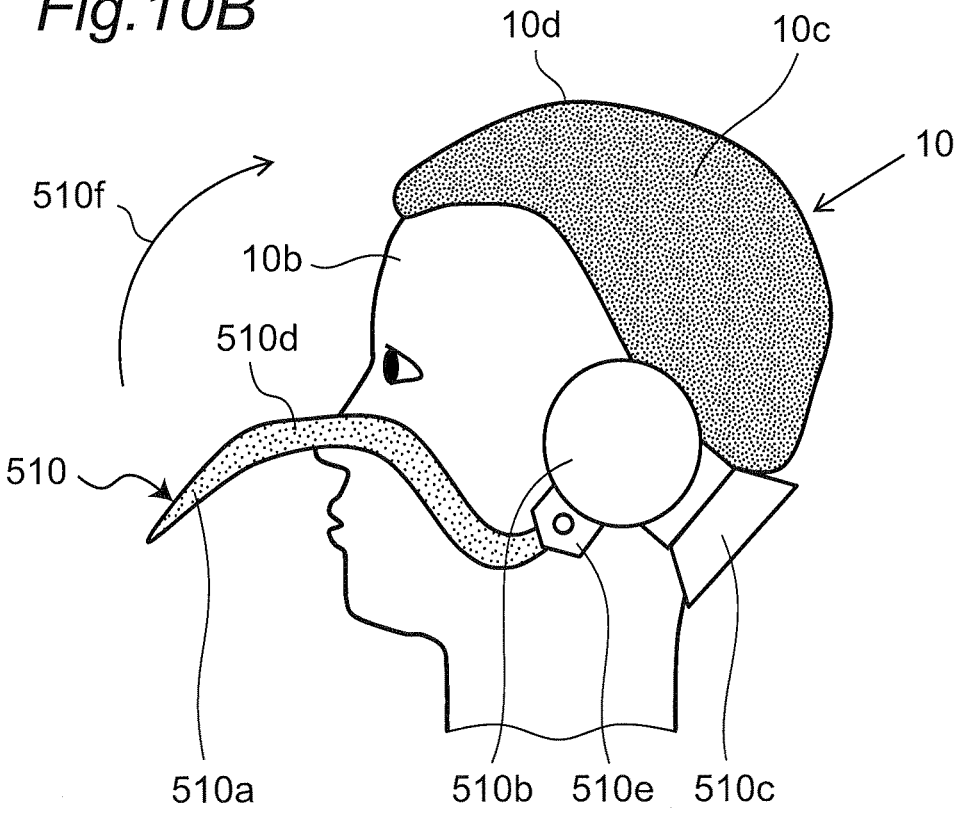

FIGS. 10A and 10B are side views showing a state in which the water shield used in the automatic hair washing apparatus according to the first embodiment is attached to the person's head.

As shown in FIG. 10A, the water shield 510 is comprised of a guard 510*a* for preventing water and the like from getting on the person's face 10*b*, an ear cover 510*b* for preventing water and the like from getting in the ear, and a back cover 510*c* for preventing water and the like from getting on the neck from the back of the person.

The guard 510*a* of the water shield 510 is positioned to prevent water and the like from entering from a region of the person's scalp and hair to a region of the person's face 10*b*. The guard 510*a* prevents water and the like used for washing from entering the region of the person's face 10*b* beyond a curve 510*d* of the guard 510*a* in contact with the person's head 10 as a boundary line. The guard 510*a* is rotatably supported by a holding unit 510*e* fixed to the ear cover 510*b*.

When wearing the water shield 510 on the person's head 10, the water shield 510 is worn on the person's head 10, as shown in FIG. 10B. After that, the guard 510*a* is moved in a direction indicated by an arrow 510*f*. Thus, as shown in FIG. 10A, the water shield 510 is set on the person's head 10.

When the water shield 510 is worn on the person's head 10, the front hair of the person's head 10 is moved toward the back of the person's head 10 by the guard 510*a*. As a result, the front hair of the person's head 10 is moved on the curve 510*d* of the guard 510*a* to put the person's hair 10*c* together. This makes it easy to wash the entirety of person's hair 10*c*. The back cover 510*c* of the water shield 510 is positioned to cover the back of person's head adjacent to person's hair 10*c* without overlapping person's hair 10*c*.

The water shield 510 is designed so that the region of person's hair 10*c* is remained open when the water shield 510 is worn on person's head 10. Thus, the washing of person's hair 10*c* is performed without the interruption of the water shield 510. The open region of person's hair 10*c* ensures a space of easily washing person's head 10 when person's head 10 being washed by moving the pair of washing units 12.

The water shield 510 so constructed is mounted on person's head 10. This makes it possible to prevent water and the like from entering to person's face 10*b* in washing person's head 10, and hence wash person's head 10 comfortably.

When detaching the water shield 510 from person's head 10, the guard 510*a* is moved from a position shown in FIG. 10A to a position shown in FIG. 10B so that the guard 510*a* is positioned on the lower side of person's face 10*b*. After that, the entirety of the water shield 510 is moved in a direction of the top 10*d* of person's head 10 so that the entirety of the water shield 510 is detached from person's head 10.

The automatic hair washing apparatus 100 comprises a control device 700 for comprehensively controls operation of the entire automatic hair washing apparatus 100, as described later. The control device 700 can independently drive the left and right washing units 12L and 12R. The control device 700 controls various operations such as operations of the motors 201L and 201R for rotating the washing units 12L and 12R about the support shafts 104L and 104R, the motors 206L and 206R for rotating the washing units 12L and 12R about the arm shafts 209L and 209R, and the motor 301L for rotating the contacts 109.

The automatic hair washing apparatus 100 according to the first embodiment, in addition to being used as an apparatus for automatically washing person's head 10, can be used as an apparatus for automatically massaging person's head 10 by the contact 109 when water, shampoo and the like are not ejected through the pipes 111L and 111R.

As described above, the automatic hair washing apparatus 100 according to the first embodiment comprises the bowl 101 having the head support 11, the left washing unit 12L and the right washing unit 12R, the motors 201L, 203L, 204L, 201R, 203R, and 204R, and the control device 700 for controlling the driving of the motors 201L, 203L, 204L, 201R, 203R and 204R. Each of the left and right washing unit 12L and 12R has a plurality of split units 14 in the longitudinal direction of the respective washing units 12L and 12R. Each split unit 14 comprises a plurality of contacts 109 on the side opposing the head support 11. The head support 112 is for supporting person's head 10. The left and right washing units 12L and 12R are arranged with the head support 11 interposed therebetween, and the support shafts 104L and 104R thereof are attached to the bowl 101. The motors 201L, 203L, 204L, 201R, 203R and 204R rotate the washing units 12L and 12R about the support shafts 104L and 104R thereof. The bowl 101 is one example of a base, each motor is one example of a driving section, and control device 700 is one example of a control section.

As above, in the automatic hair washing apparatus, the left and right washing units 12L and 12R are arranged with the head support 11 interposed therebetween. This makes it possible to wash person's hair in a safe and effective manner by the left and right washing unit 12L and 12R without a straining force applied on person's neck.

The definition of the operating direction of the automatic hair washing apparatus 100 and the like will now be described with reference to FIGS. 11-13.

Figure 11:
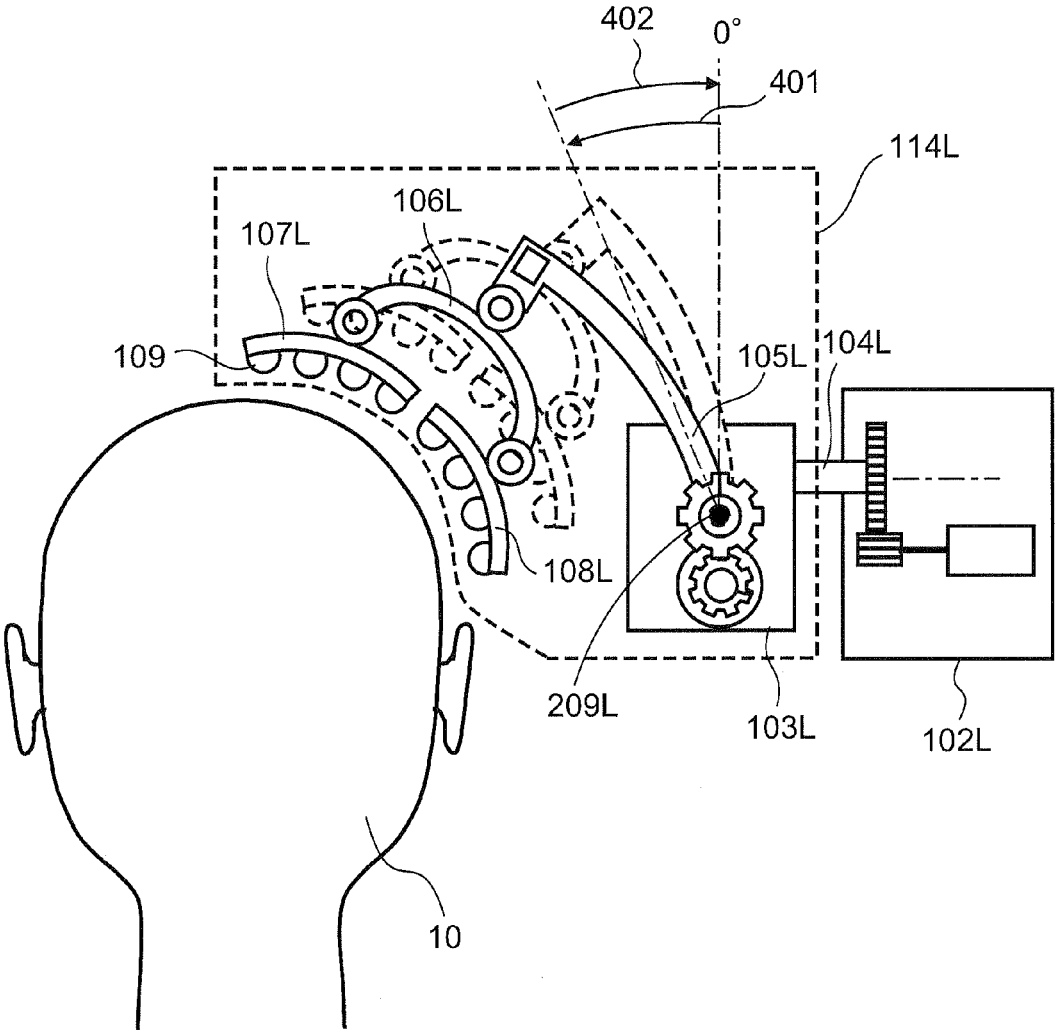
FIG. 11 is a diagram describing a first operating direction of the automatic hair washing apparatus according to the first embodiment.

FIG. 11 is a diagram describing a first operating direction of the automatic hair washing apparatus according to the first embodiment. As shown in FIG. 11, in the left washing unit 12L of the automatic hair washing apparatus 100, the arm base 103L, the first arm 105L, the second arm 106L, the third arms 107L and 108L, the plurality of contacts 109, and the like are collectively referred to as "left arm 114L". The plurality of contacts 109 attached to the third arms 107L and 108L is referred to as "contact group L".

As shown in FIG. 11, the rotating of the left arm 114L to approach to or separate away from the surface of the person's head 10 about the arm shaft 209L is referred to as "push-rotating". The direction where the left arm 114L approaches the head 10 is referred to as "pushing direction" (direction of arrow 401). The direction where the left arm 114L separates away from the head 10 is referred to as "release direction (direction of arrow 402)". The angle position where the left arm 114L is separated away from the head 10 the most is 0 degree, and the pushing direction is defined as the forward direction.

Figure 12:
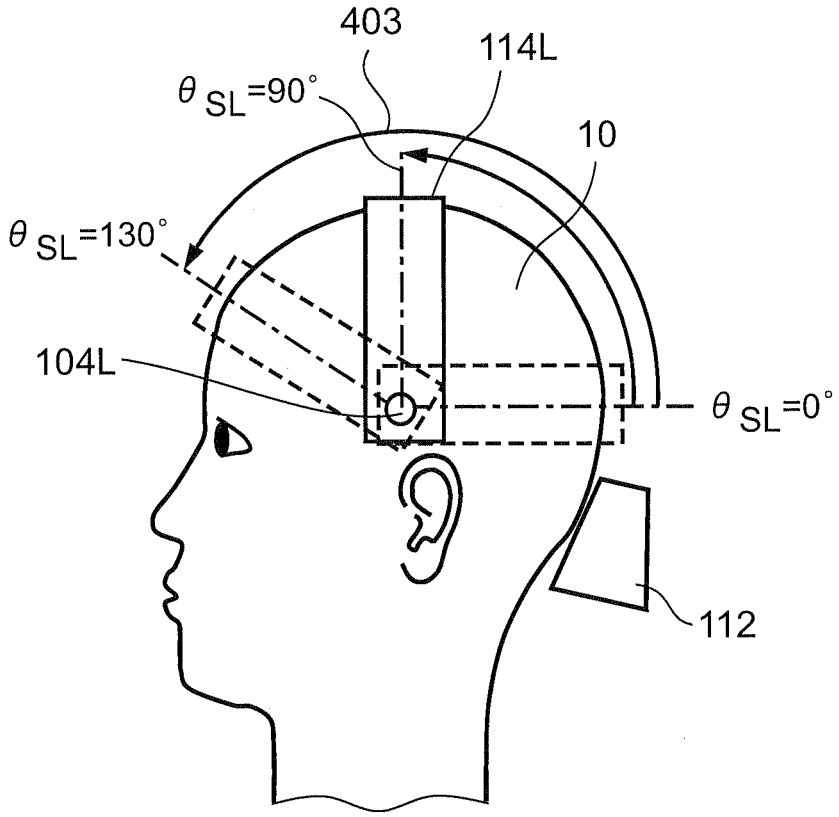
FIG. 12 is a diagram describing a second operating direction of the automatic hair washing apparatus according to the first embodiment.

FIG. 12 is a diagram describing a second operating direction of the automatic hair washing apparatus according to the first embodiment. As shown in FIG. 12, in the automatic hair washing apparatus 100, the rotating of the left arm 114L to the front and back of the head 10 about the support shaft 104L is referred to as "swing-rotating". The angle position of the back side of the head 10 is 0 degree, and the direction towards the front side of the head 10 (direction of arrow 403) is the forward direction. In the first embodiment, the left arm 114L is configured to be able to swing-rotate to 130°.

Figure 13:
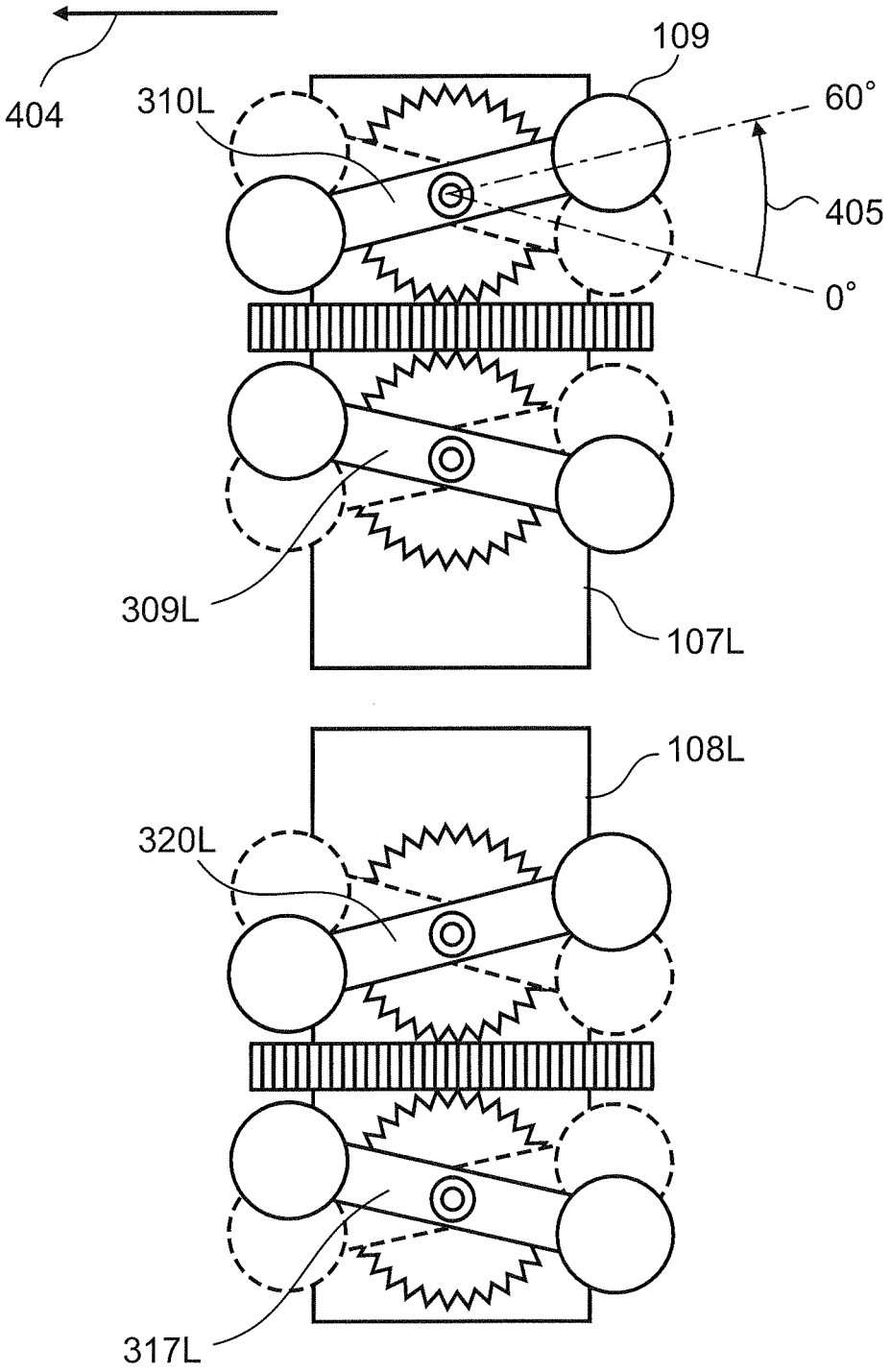
FIG. 13 is a diagram describing a third operating direction of the automatic hair washing apparatus according to the first embodiment.

FIG. 13 is a diagram describing a third operating direction of the automatic hair washing apparatus according to the first embodiment. As shown in FIG. 13, in the automatic hair washing apparatus 100, the plurality of contacts 109 are attached to the third arms 107L and 108L configuring one part of the left arm 114L. When seen from the third arms 107L and 108L, the direction indicated by arrow 404 is the direction where the left arm 114L is swing-rotated to the front side of the head 10.

In FIG. 13, the position angle of the contact group L shown with a broken line is 0°, and the direction indicated by arrow 405 is the forward direction. The contact group L can rotate to a state shown with a solid line, and can be configured to rotate up to 60° in the first embodiment. The rotating of the fourth arms 309L, 310L, 317L, and 320L, in which two contacts 109 are attached as a pair, about the rotational shafts 308L, 312L, 316L, and 319L is referred to as "massage-rotating".

Similarly for the right washing unit 12R of the automatic hair washing apparatus 100, the arm base 103R, the first arm 105R, the second arm 106R, the third arms 107R and 108R, the plurality of contacts 109, and the like are collectively referred to as "right arm 114R" when seen from the support shaft 104R. The plurality of contacts 109 attached to the third arms 107R and 108R are referred to as "contact group R", and the rotating direction is similarly defined.

Figure 14:
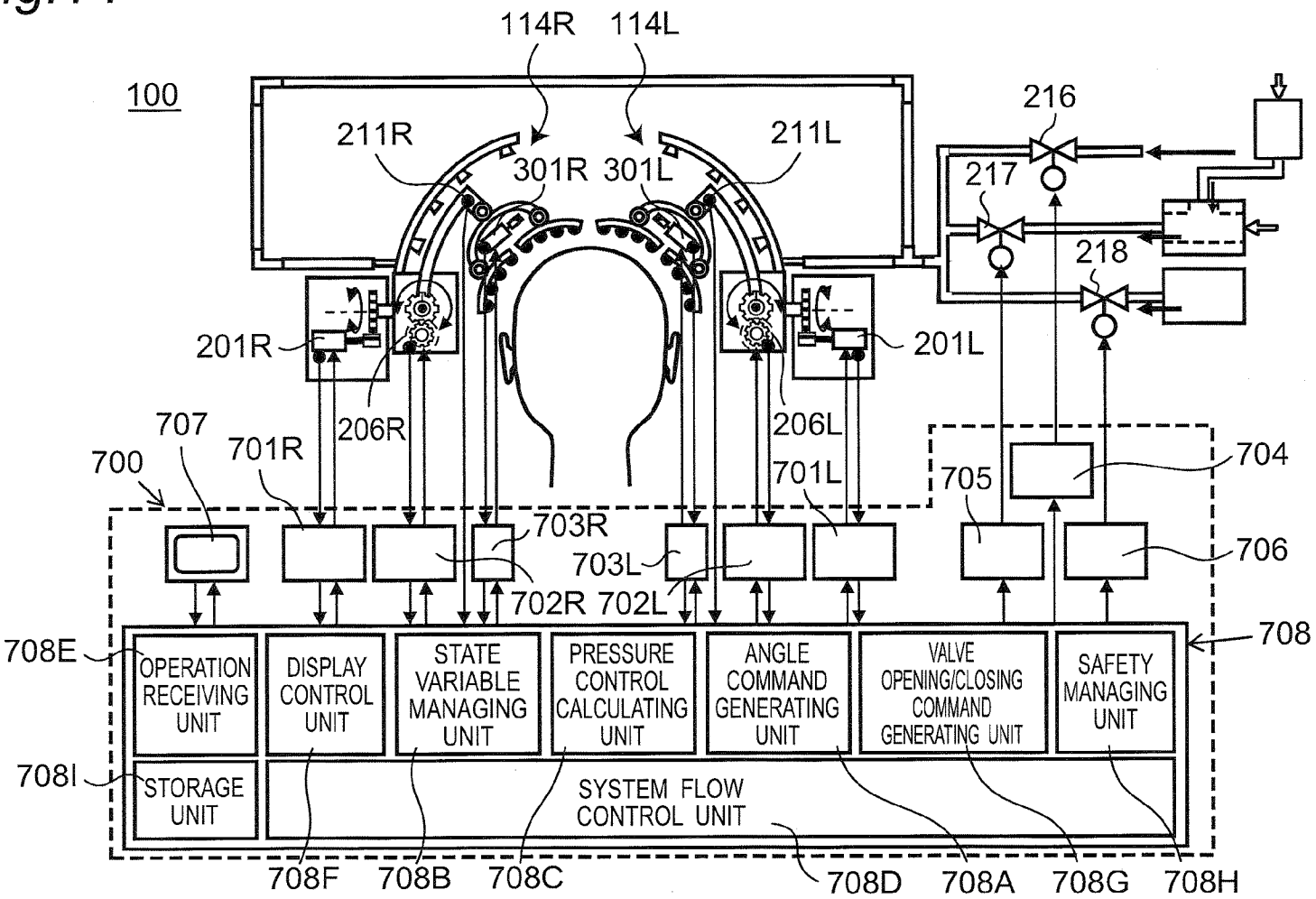
FIG. 14 is a diagram showing a construction of a control device of the automatic hair washing apparatus according to the first embodiment.

FIG. 14 is a diagram showing a construction of a control device of the automatic hair washing apparatus according to the first embodiment.

The control device 700 of the automatic hair washing apparatus 100 includes arm swing angle control sections 701L and 701R, arm pushing angle control sections 702L and 702R, and contact group angle control sections 703L and 703R. The arm swing angle control sections 701L and 701R, the arm pushing angle control sections 702L and 702R, and the contact group angle control sections 703L and 703R are all arranged for each of left and right arms 114L and 114R. The left arm swing angle control section 701L controls the swing-rotating angle of the left arm 114L. The right arm swing angle control section 701R controls the swing-rotating angle of the right arm 114R. The left arm pushing angle control section 702L controls the push-rotating angle of the left arm 114L. The right arm pushing angle control section 702R controls the push-rotating angle of the right arm 114R. The left contact group angle control section 703L controls the massage-rotating angle of the contact group L of the left arm 114L. The right contact group angle control section 703R controls the massage-rotating angle of the contact group R of the right arm 114R.

The control device 700 of the automatic hair washing apparatus 100 includes a water system valve control section 704 for controlling the opening/closing of the water system valve 216, a washing agent system valve control section 705 for controlling the opening/closing of the washing agent system valve 217, and a conditioner system valve control section 706 for controlling the opening/closing of the conditioner system valve 218. Furthermore, the control device 700 of the automatic hair washing apparatus 100 includes an operating section 707 for accepting the operation input of the user. The operating section 707 is a so-called touch panel type operating section, and has a function of displaying various types of operation states of the automatic hair washing apparatus 100. The control device 700 of the automatic hair washing apparatus 100, however, may include a display section for displaying the various types of operation states of the automatic hair washing apparatus 100, separate from the operating section 707.

Furthermore, the control device 700 of the automatic hair washing apparatus 100 includes a system control section 708. The system control section 708 comprehensively manages and controls each section (arm swing angle control sections 701L and 701R, arm pushing angle control sections 702L and 702R, contact group angle control sections 703L and 703R, water system valve control section 704, washing agent system valve control section 705, conditioner system valve control section 706, and operating section 707).

The system control section 708 includes an operation receiving unit 708E for processing the information of the user's operation input from the operating section 707, a display control unit 708F for controlling the display of various types of operation states in the operating section 707, and a storage unit 708I for storing various types of information input to the system control section 708. The system control section 708 includes a valve opening/closing command generating unit 708G for commanding the opening/closing of the water system valve 216, the washing agent system valve 217, and the conditioner system valve 218, and a safety managing unit 708H for checking and managing the various safeties.

The arm swing angle control sections 701L and 701R, the arm pushing angle control sections 702L and 702R, and the contact group angle control sections 703L and 703R control the driving of the corresponding motors 201L and 201R, 206L and 206R, and 301L and 301R according to an angle command value generated by an angle command generating unit 708A of the system control section 708.

Specifically, the arm swing angle control sections 701L and 701R, the arm pushing angle control sections 702L and 702R, and the contact group angle control sections 703L and 703R are configured to compare the angle command commanded by the angle command generating unit 708A and the rotation angle of the corresponding motors 201L and 201R, 206L and 206R, and 301L and 301R and supply the current corresponding to the error of the compared ones to the respective motor.

The configuration of the left and right arm swing angle control sections 701L and 701R is similar to each other. The configuration of the left and right arm pushing angle control sections 702L and 702R is similar to each other. The configuration of the left and right contact group angle control sections 703L and 703R is similar to each other.

Figure 15:
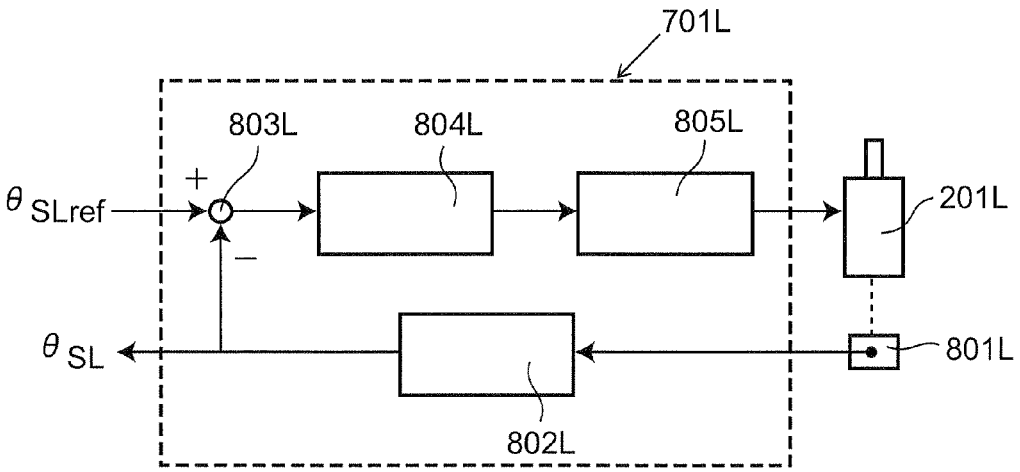
FIG. 15 is a block diagram showing a construction of an arm swing angle control section according to the first embodiment.

FIG. 15 is a block diagram showing a construction of the left arm swing angle control section 701L. The right arm swing angle control section 701R has a construction similar to the left arm swing angle control section 701L, and thus the detailed description thereof will be omitted.

In FIG. 15, an encoder 801L for generating a pulse in synchronization with the rotation angle of the motor 201L is incorporated in the motor 201L. The encoder 801L is configured so that a pulse having a phase difference of 90° is generated, and the detection of the rotation direction of the motor 201L is enabled. An angle detector 802L measures the pulse ENCL generated from the encoder 801L, and detects a rotation angle $\theta_{SL}$ of the motor 201L. The left arm swing angle control section 701L calculates an error by comparing the swing-rotating angle command value $\theta_{SLref}$ of the left arm 114L commanded by the angle command generating unit 708A with a motor rotation angle $\theta_{SL}$ of the motor 201L by a comparator 803L and carries out a PID calculation in accordance with the error calculated by a control calculating section 804L. The current in accordance with the result of the PID calculation is supplied to the motor 201L via a limiter 805L. The feedback control system is thus configured so that the swing-rotating angle $\theta_{SL}$ of the left arm 114L matches the swing-rotating angle command value $\theta_{SLref}$. The swing-rotating angle $\theta_{SL}$ of the left arm 114L measured by the angle detector 802L is provided to a state variable managing unit 708B of the system control section 708.

The control of the push-rotating angle of the left arm 114L will now be described. The control of the push-rotating angle of the right arm 114R is performed similar to the left arm 114L, and thus the detailed description thereof will be omitted.

A dual control system is configured for the control of the push-rotating angle of the left arm 114L. The first control system is a general angle command system that does not depend on the value of the pressure sensor 211L. This system is a system that outputs a command value $\theta_{1PLref}$ generated by the angle command generating unit 708A to the left arm pushing angle control section 702L as a command value $\theta_{PLref}$. The second system is a system that outputs a command value $\theta_{2PLref}$ generated by the calculation based on the pressure sensor 211L to the left arm pushing angle control section 702L as a command value $\theta_{PLref}$.

In FIG. 14, the pressure sensor 211L installed at the end of the first arm 105L detects the stress applied on the person's head 10 by the contact group L. The contact group L can be pushed against the head 10 at an appropriate stress by controlling the push-rotating angle of the motor 206L so that the detection value of the pressure sensor 211L is an appropriate predetermined value. The command value $\theta_{2PLref}$ for the pushing control is calculated by a pressure control calculating unit 708C of the system control section 708.

Figure 16:
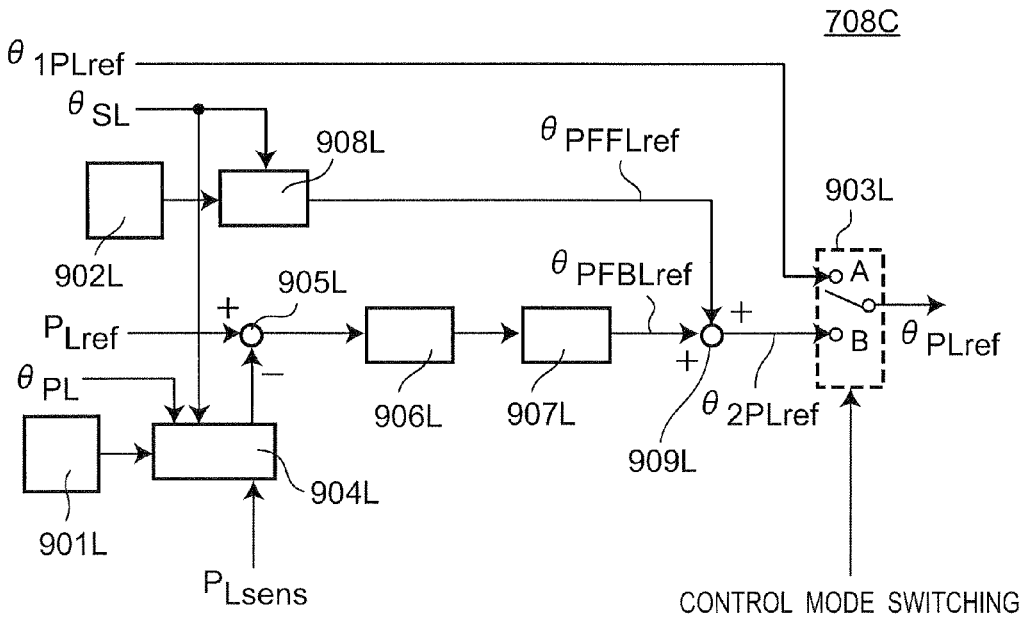
FIG. 16 is a block diagram showing a construction of a pressure control calculating unit according to the first embodiment.

FIG. 16 is a block diagram showing a construction of the pressure control calculating unit 708C.

First, the pressure control calculating unit 708C has a table 901L that holds the values of the push-rotating angle $\theta_{PL}$ of the left arm 114L with respect to the swing-rotating angle $\theta_{SL}$ of the left arm 114L for the time when the contact group L of the left arm 114L is pushed against the head 10 at predetermined pushing force. One example of the table 901L is shown in FIG. 17. The table 901L is obtained by scanning the push-rotating angle $\theta_{PL}$ while gradually increasing the swing-rotating angle $\theta_{SL}$ of the left arm 114L from 0° with the left arm 114L pushed against the head 10 at a substantially constant pressure, and acquiring the value of the push-rotating angle $\theta_{PL}$ with respect to each value of the swing-rotating angle $\theta_{SL}$.

The pressure control calculating unit 708C also has a table 902L that holds the values indicated by the pressure sensor 211L in a state where the contact group L is separated from the head 10 for a predetermined plurality of combinations of the swing-rotating angle $\theta_{sL}$ of the left arm 114L and the push-rotating angle $\theta_{PL}$. This is to respond to the influence of gravity on the output value of the pressure sensor 211L being changed by the position of the left arm 114L. Specifically, the pressure sensor 211L is subjected to the influence of weight of the members from the pressure sensor 211L to the head 10 since the pressure sensor 211L is configured to detect the stress applied on the head 10 through the second arm 106L, the third arms 107L and 108L and the other members. The degree of the influence changes according to the position (swing-rotating angle $\theta_{sL}$ and push-rotating angle $\theta_{PL}$) of the left arm 114L. Therefore, correction needs to be made such that the influence of the gravity, which is applied on the members interposed between the pressure sensor 211L and the head 10, exerted on the output value of the pressure sensor 211L is excluded in accordance with the combination of the swing-rotating angle $\theta_{sL}$ and the push-rotating angle $\theta_{PL}$. The table 902L is thus used. One example of the table 902L is shown in FIG. 18. The measurement of the value of the pressure sensor 211L in the table 902L is performed while changing the swing-rotating angle $\theta_{sL}$ and the push-rotating angle $\theta_{PL}$ without the head 10 inserted in the bowl 101. Specifically, the value of the pressure sensor 211L is acquired every time the swing-rotating angle $\theta_{sL}$ becomes a predetermined value while changing the swing-rotating angle $\theta_{sL}$ with the push-rotating angle $\theta_{PL}$ held at a predetermined fixed value. This detecting operation is repeated while sequentially changing the fixed value of the push-rotating angle $\theta_{PL}$ to obtain the table 902L. The table 902L is used to provide an offset value corresponding to various positions of the left arm 114L.

In FIG. 16, a control system switching section 903L is switch-controlled by a system flow control unit 708D of the system control section 708. When the control system switching section 903L is switch-controlled to a sign A side in FIG. 16, the system flow control unit 708D assumes the command value $\theta_{1PLref}$ generated by the angle command generating unit 708A as the command value $\theta_{PLref}$, and outputs the same to the left arm pushing angle control section 702L.

The control system in a case where the control system switching section 903L is switch-controlled to a sign B side in FIG. 16 by the system flow control unit 708D will now be described.

First, the comparator 905L compares the pushing force command $P_{Lref}$ with the "stress $P_L$ applied on the head 10 of the left arm 114L" detected by the pressure sensor 211L and corrected by a weight correcting section 904L to obtain a pushing force error. A first control calculating section 906L amplifies an error signal obtained by the comparator 905L at a predetermined gain. A stabilization compensator 907L arranged to stabilize the control system generates a command value $\theta_{PFBLref}$ that becomes the base of an angle command value $\theta_{2PLref}$, based on the output of the first control calculating section 906L. The stabilization compensator 907L is configured by an integrator and achieves stabilization of a series of pushing control systems.

The weight correcting section 904L calibrates and outputs the value of the pressure sensor 211L based on the table 901L. In other words, the weight correcting section 904L calculates an offset value of the pressure sensor 211L corresponding to the current position of the left arm 114L based on the combination of the swing-rotating angle $\theta_{SL}$ of the left arm 114L and the push-rotating angle $\theta_{PL}$ of the left arm 114L reported from the state variable managing unit 708B, and the value of the table 901L corresponding to the relevant combination. The offset value is then divided with the current value of the pressure sensor 211L and output.

A second control calculating section 908L calculates a command value $\theta_{PFFLref}$ serving as a target value of the push-rotating angle $\theta_{PL}$ of the left arm 114L in a case where the left arm 114L makes contact with the head 10, based on the swing-rotating angle $\theta_{SL}$ of the left arm 114L reported from the state variable managing unit 708B and the value of the push-rotating angle $\theta_{PL}$ of the table 902L corresponding to the swing-rotating angle $\theta_{SL}$. The system flow control unit 708D adds the command value $\theta_{PFBLre}$ and the command value $\theta_{PFFLref}$ by an adder 909L, and outputs the value obtained by the addition to the left arm swing-rotating angle control section 702L as a command value $\theta_{2PLref}$ of the push-rotating angle of left arm 114L.

Therefore, the pushing force of the contact group L applied on the head 10 is controlled to match the commanded pushing force command $P_{Lref}$. The command value $\theta_{PFBLref}$ is a rotating angle control operation amount by the feedback system and enhances the robustness of the entire control system. The command value $\theta_{PFFLref}$ is a rotating angle operation amount by an open feed forward system, and improves the responsiveness by the feedback system.

The control of the push-rotating angle of the right arm 114R is also configured with a dual control system, similar to the control of the push-rotating angle of the left arm 114L. Each control system of the right arm 114R is constructed similar to each control system of the left arm 114L. The detailed description on the control of the push-rotating angle of the right arm 114R is thus omitted.

The control device 700 of the automatic hair washing apparatus 100 so constructed cooperatively controls the swing-rotating angle and the push-rotating angle of the left arm 114L and the right arm 114R, the massage-rotating angle of the contact group L and the contact group R, as well as the opening/closing of the water system valve 216, the washing agent system valve 217, and the conditioner system valve 218 with the system flow control unit 708D based on an operation input of the user received by the operation receiving unit 708E. This realizes an automatic washing operation of the person's head 10.

The control operation of the swing-rotating and the push-rotating of the left arm 114L and the right arm 114R, as well as the massage-rotating of the contact group L and the contact group R by the control device 700 of the automatic hair washing apparatus 100 will be hereinafter described.

Figure 19:
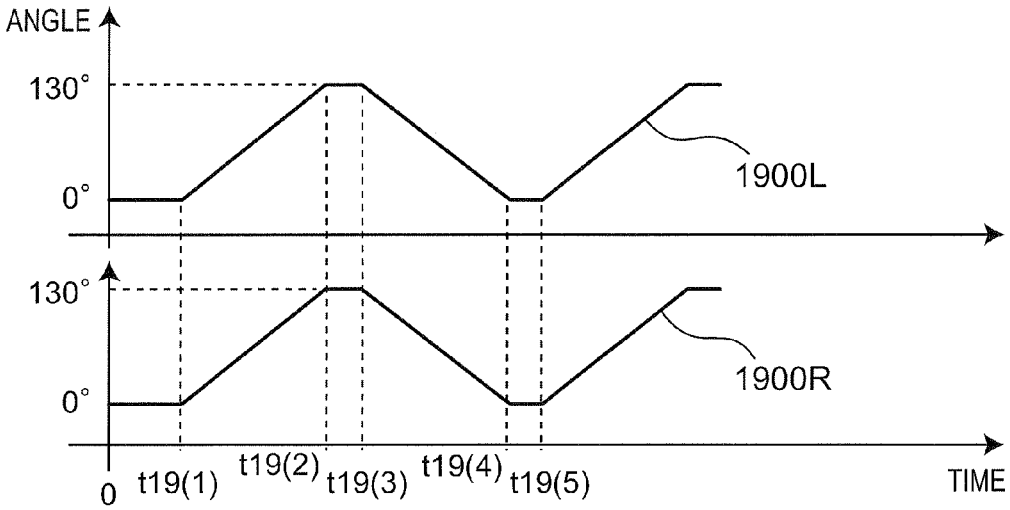
FIG. 19 is a first waveform diagram of a control command value generated in the control device of the automatic hair washing apparatus according to the first embodiment.
Figure 20:
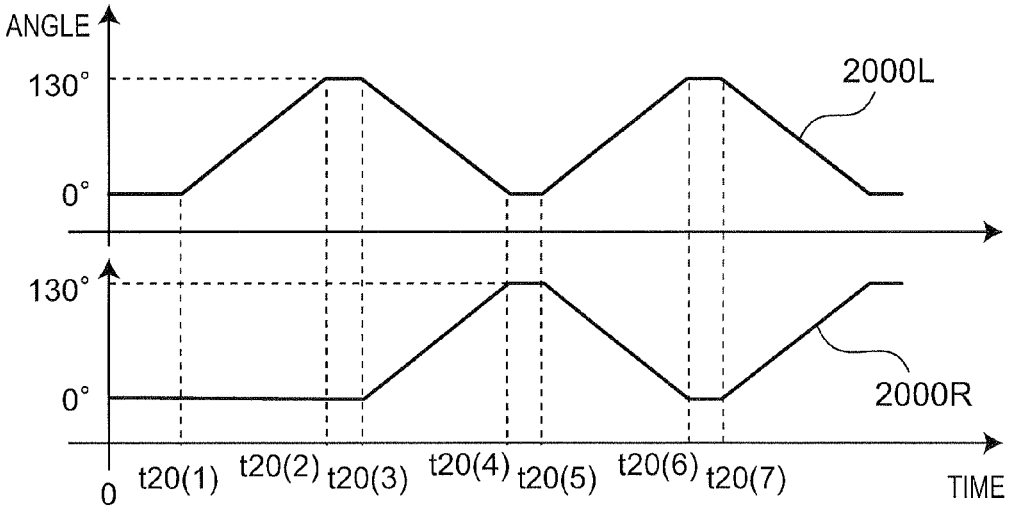
FIG. 20 is a second waveform diagram of a control command value generated in the control device of the automatic hair washing apparatus according to the first embodiment.
Figure 21:
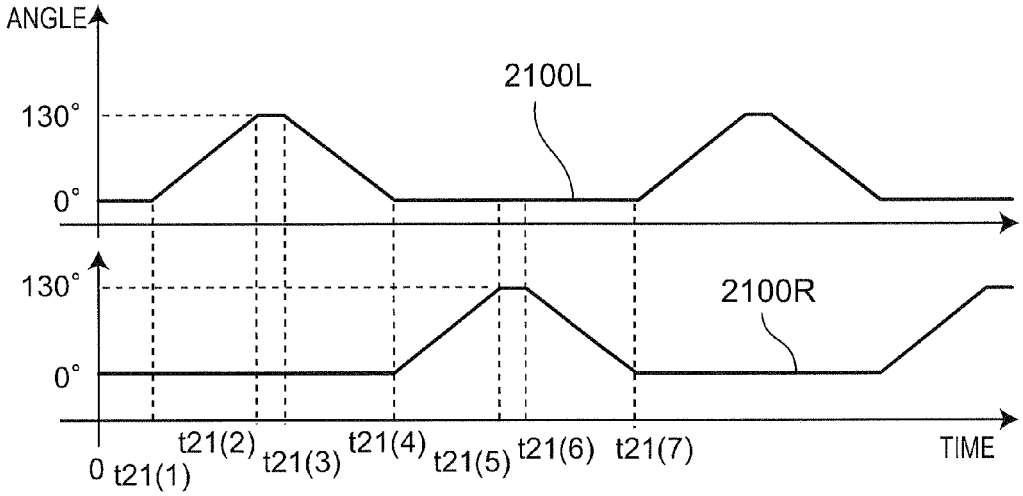
FIG. 21 is a third waveform diagram of a control command value generated in the control device of the automatic hair washing apparatus according to the first embodiment.

FIGS. 19-21 are timing diagrams showing examples of a mode of change in the command value of the swing-rotating angle of the left arm 114L and the right arm 114R generated by the system flow control unit 708D.

First, an example shown in FIG. 19 will be described. In FIG. 19, a waveform 1900L shows a mode of change in the command value $\theta_{SLref}$ of the swing-rotating angle of the left arm 114L and a waveform 1900R shows a mode of change in the command value $\theta_{SRref}$ of the swing-rotating angle of the right arm 114R.

As previously described above, the swing-rotating angle $\theta_{SL}$ of the left arm 114L and the swing-rotating angle $\theta_{SR}$ of the right arm 114R operate to substantially match each command value $\theta_{SLref}$ and $\theta_{SRref}$. This operation will be described using the timing diagram of FIG. 19.

In FIG. 19, the left arm 114L and the right arm 114R are both waited at an angle position of 0° (position of back side of head 10) from time 0 to t19(1), and are swing-rotated to an angle position of 130° towards the front side of the head 10 from time t19(1) to time t19(2). After a short wait from time t19(2) to time t19(3), the left arm 114L and the right arm 114R are swing-rotated to an angle position of 0° towards the back side of the head 10 from time t19(3) to time t19(4). Thereafter, the left and right arms 114L and 114R are shortly waited from time t19(4) to time t19(5), and a series of in-phase operation described above are repeated.

In the operation example shown in FIG. 19, the left arm 114L and the right arm 114R operate in phase from beginning to end. Thus, the stress can be applied on the head 10 from the left and the right by controlling each push-rotating angle of the left arm 114L and the right arm 114R in a direction of pushing the head 10 and simultaneously pushing the contact group L and the contact group R to the head 10. The strain on the neck thus can be alleviated compared to a technique of applying stress from one direction as in the related art. In this case, the unit where the stress is applied in the head 10 sequentially moves in the front and back direction of the person's neck while maintaining the left and right balance. Therefore, the sense of discomfort felt by the user from the local stress can be avoided.

The pipes 111L and 111R are swing-rotated with the arms 114L and 114R. Therefore, when the operation shown in FIG. 19 is performed, the pipes 111L and 111R are also swing-rotated in phase for the left and the right, similar to the arms 114L and 114R. Thus, the cold water or hot water, the washing agent, or the conditioner can be ejected in a balanced manner from the left and the right with respect to the head 10 by appropriately controlling the opening/closing of the water system valve 217, the washing agent system valve 218, and the conditioner system valve 216.

An example shown in FIG. 20 will now be described. In FIG. 20, a waveform 2000L shows a mode of change in the command value $\theta_{SLref}$ of the swing-rotating angle of the left arm 114L, and a waveform 2000R shows a mode of change in the command value $\theta_{SRref}$ of the swing-rotating angle of the right arm 114R. As described above, the swing-rotating angle $\theta_{SL}$ of the left arm 114L and the swing-rotating angle $\theta_{SR}$ of the right arm 114R operate to substantially match each command value $\theta_{SLref}$ and $\theta_{SRref}$. This operation will be described using the timing diagram of FIG. 20.

In FIG. 20, the left arm 114L and the right arm 114R are both waited at an angle position of 0° (position of back side of head 10) from time 0 to t20(1). From time t20(1) to time t20(2), only the left arm 114L is swing-rotated to an angle position of 130° towards the front side of the head 10. After a short wait from time t20(2) to time t20(3), the left arm 114L is swing-rotated to an angle position of 0° towards the back side of the head 10 and the right arm 114R is swing-rotated to an angle position of 130° towards the front side of the head 10 from time t20(3) to time t20(4). Thereafter, after a short wait from time t20(4) to time t20(5), the left arm 114L is swing-rotated to an angle position of 130° towards the front side of the head 10 and the right arm 114R is swing-rotated to an angle position of 0° towards the back side of the head 10 from time t20(5) to time t20(6). Thereafter, the left and right arms 114L and 114R are shortly waited from time t20(6) to time t20(7), and a series of in reverse phase operation described above are repeated.

In the operation example shown in FIG. 20, the left arm 114L and the right arm 114R operate in reverse phase from beginning to end after time t20(3). Thus, the stress can be applied on the head 10 from the left and the right by controlling each push-rotating angle of the left arm 114L and the right arm 114R in a direction of pushing the head 10 and simultaneously pushing the contact group L and the contact group R to the head 10. The strain on the neck thus can be alleviated compared to a technique of applying stress from one direction as in the related art. In this case, the unit where the stress is applied on both left and right sides of the head 10 sequentially moves in the twisting direction of the person's neck. Therefore, the sense of discomfort felt by the user from the local stress can be avoided.

The pipes 111L and 111R are swing-rotated with the arms 114L and 114R. Therefore, when the operation shown in FIG. 20 is performed, the pipes 111L and 111R are also swing-rotated in reverse phase for the left and the right, similar to the arms 114L and 114R. Thus, the cold water or hot water, the washing agent, or the conditioner can be ejected in a balanced manner from the front and the back of the head 10 by appropriately controlling the opening/closing of the water system valve 216, the washing agent system valve 217, and the conditioner system valve 218.

An example shown in FIG. 21 will now be described. In FIG. 21, a waveform 2100L shows a mode of change in the command value $\theta_{SLref}$ of the swing-rotating angle of the left arm 114L, and a waveform 2100R shows a mode of change in the command value $\theta_{SRref}$ of the swing-rotating angle of the right arm 114R. As described above, the swing-rotating angle $\theta_{SL}$ of the left arm 114L and the swing-rotating angle $\theta_{SR}$ of the right arm 114R operate to substantially match each command value $\theta_{SLref}$ and $\theta_{SRref}$.

In FIG. 21, the left arm 114L and the right arm 114R are both waited at an angle position of 0° (position of back side of head 10) from time 0 to t21(1). From time t21(1) to time t21(2), only the left arm 114L is swing-rotated to an angle position of 130° towards the front side of the head 10. After a short wait from time t21(2) to time t21(3), the left arm 114L is swing-rotated to an angle position of 0° on the back side of the head 10 from time t21(3) to time t21(4). Meanwhile, the right arm 114R remains waiting at a position (angle position of 0°) on the back side of the head 10. The right arm 114R is then swing-rotated to an angle position of 130° towards the front side of the head 10 from time t21(4) to time t21(5), and after a short wait from time t21(5) to time t21(6), swing-rotated to an angle position of 0° towards the back side of the head 10 from time t21(6) to time t21(7). During time t21(4) to time t21(7) in which the right arm 114R is being swing-rotated, the left arm 114L waits at an angle position of 0° towards the back side of the head 10. After time t21(7), the series of alternating operations of the left arm 114L and the right arm 114R are repeated.

Therefore, in the operation example shown in FIG. 21, the left arm 114L and the right arm 114R alternately operate, where the right arm 114R waits at the position (angle position of 0°) on the back side of the head 10 while the left arm 114L is being swing-rotated, and the left arm 114L waits at the position (angle position of 0°) on the back side of the head 10 while the right arm 114R is being swing-rotated. Therefore, the left arm 114L or the right arm 114R that is waiting can support the head 10 from below, thus alleviating the strain on the neck.

Figure 22:
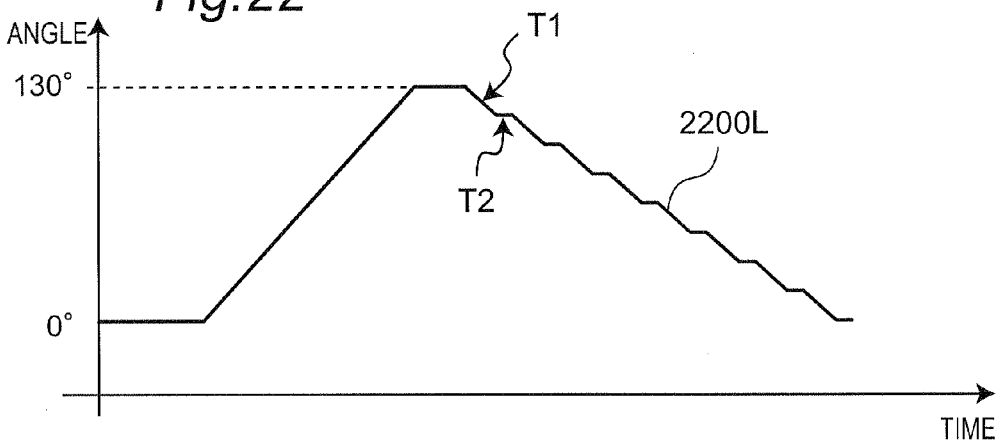
FIG. 22 is a fourth waveform diagram of a control command value generated in the control device of the automatic hair washing apparatus according to the first embodiment.
Figure 23:
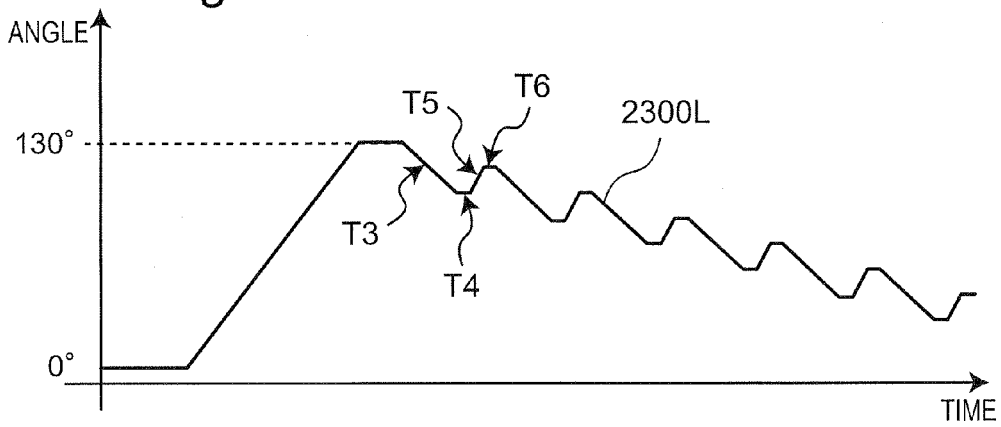
FIG. 23 is a fifth waveform diagram of a control command value generated in the control device of the automatic hair washing apparatus according to the first embodiment.

In FIGS. 19-21, a case of linearly increasing or decreasing the angle of swing-rotating of the left arm 114L and the right arm 114R has been illustrated, but the construction for increasing or decreasing the swing-rotating is not limited thereto. In the present invention, for example, the swing-rotating of the left arm 114L or the right arm 114R may be controlled, as shown in FIG. 22 and FIG. 23. A waveform 2200L of FIG. 22 and a waveform 2300L of FIG. 23 indicate a mode of change in the command value $\theta_{SLref}$ of the swing-rotating of the left arm 114L. Similar command is also made to the right arm 114R.

In the example shown in FIG. 22, the left arm 114L is swing-rotated while linearly increasing the angle to the angle position of 130° towards the front side of the head 10, and moved towards the back side (angle position of 0°) of the head 10 from the front side (angle position of 130°) of the head 10 after a short waiting time. When moving towards the back side, the left arm 114L repeats the swing-rotating of a short time for linearly decreasing the angle shown with a reference symbol T1, and the waiting of a short time shown with a reference symbol T2. During the swing-rotating of the short time shown with the reference symbol T1, the pushing force is set relatively low in the pressure control of the left arm 114L or the push-rotating angle is set to 0°, for example, so that the left arm 114L separates away from the head 10. During the waiting of a short time shown with the reference symbol T2, the pushing force is set relatively high in the pressure control of the left arm 114L. Thus, the operation like sequentially performing finger pressing from the front side towards the back side of the head 10 can be realized.

In the example shown in FIG. 23, the left arm 114L is swing-rotated while linearly increasing the angle to the angle position of 130° towards the front side of the head 10, and moved towards the back side (angle position of 0°) of the head 10 from the front side (angle position of 130°) of the head 10 after a short waiting time. When moving towards the back side, the left arm 114L repeats the swing-rotating to the back side for linearly decreasing the angle shown with a reference symbol T3, the waiting of a short time shown with a reference symbol T4, the relatively small swing-rotating in the opposite direction (towards front side) shown with a reference symbol T5, and the waiting of a short time shown with a reference symbol T6. The angle of the swing-rotating in the opposite direction shown with the reference symbol T5 is set smaller than the angle of the swing-rotating shown with the reference symbol T3. In any operation of reference symbol T3 to T6, the pushing state of the left arm 114L with respect to the head 10 is maintained. Thus, the operation of scrub-washing the head 10 as often performed by the hand of the person can be realized. When performing the massage washing by the hand of the person, it is generally easy for a person to move the left and right hands in phase or alternately, but difficult to move the left and right hands simultaneously in reverse phase. According to the present invention, the simultaneous scrub-washing by the left and right arms 114L and 114R that operate in reverse phase can be easily realized by having the operation phase of the right arm 114R in reverse phase with respect to the left arm 114L, as shown in FIG. 20, so that a new sense of washing operation can be provided.

One example of a cooperative control of the swing-rotating, the push-rotating, and the massage-rotating will now be described for the left arm 114L.

Figure 24:
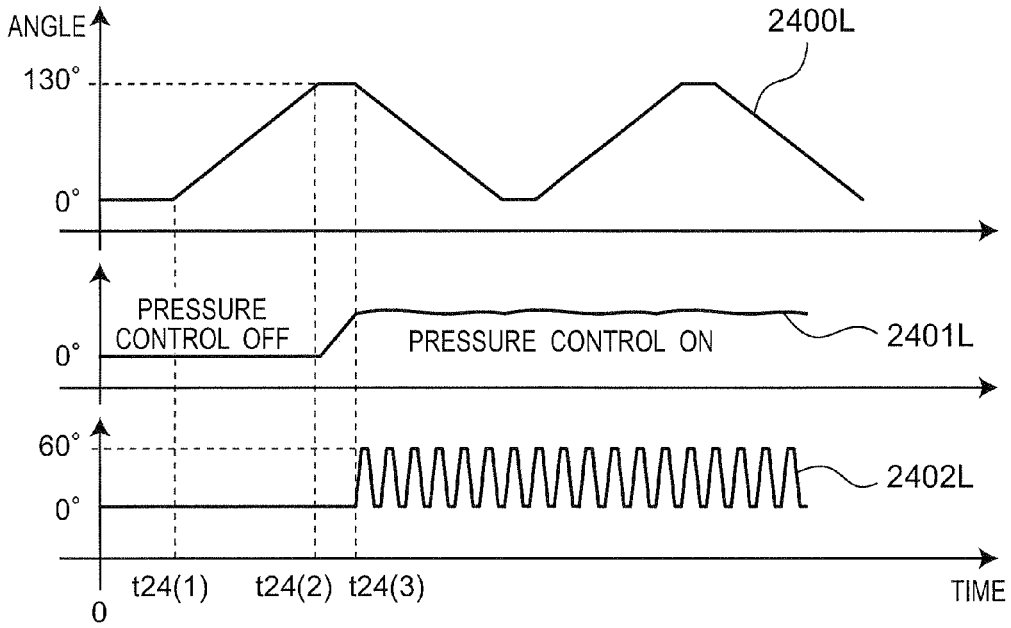
FIG. 24 is a sixth waveform diagram of a control command value generated in the control device of the automatic hair washing apparatus according to the first embodiment.
Figure 25:
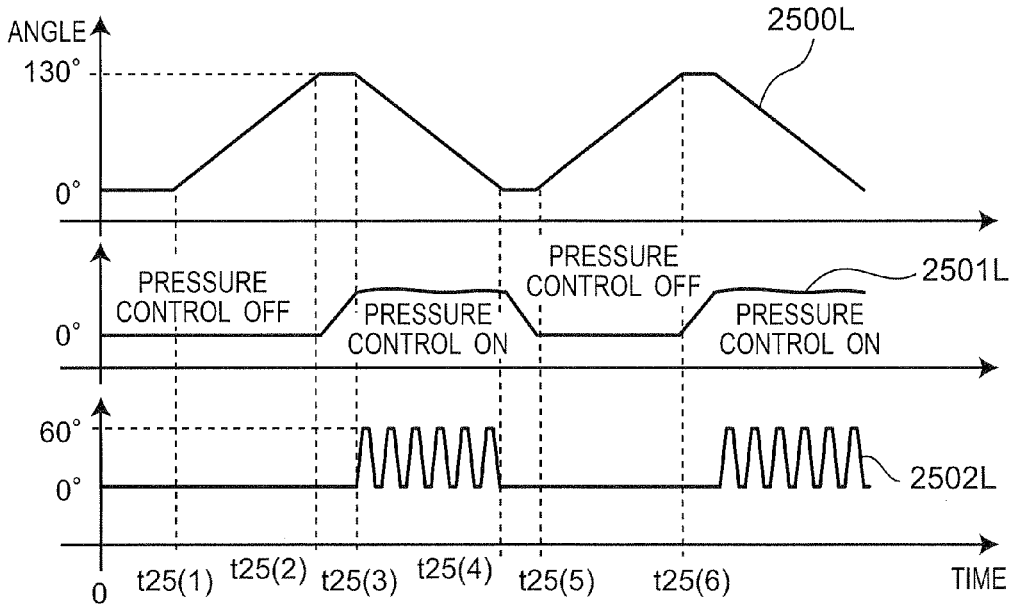
FIG. 25 is a seventh waveform diagram of a control command value generated in the control device of the automatic hair washing apparatus according to the first embodiment.
Figure 26:
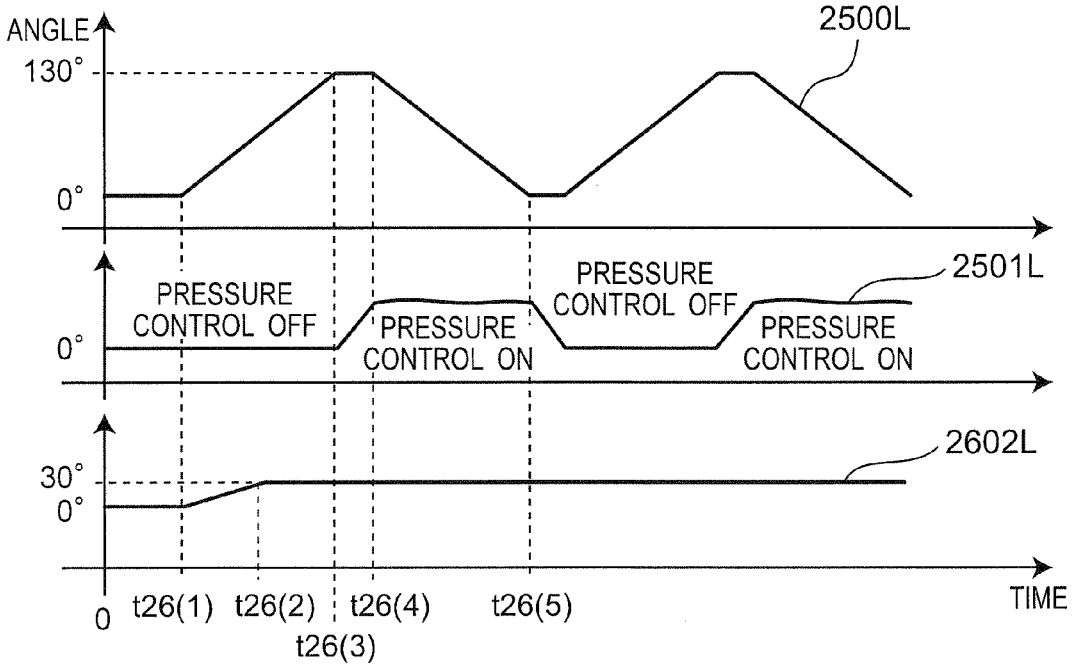
FIG. 26 is an eighth waveform diagram of a control command value generated in the control device of the automatic hair washing apparatus according to the first embodiment.

FIGS. 24-26 show one example of a timing diagram showing a mode of change of the command value of the swing-rotating angle, the command value of the push-rotating angle, and the command value of the massage-rotating angle associated with the left arm 114L generated in the system flow control unit 708D by the control device 700 of the automatic hair washing apparatus 100.

First, an example shown in FIG. 24 will be described. In FIG. 24, a waveform 2400L shows a mode of change in the command value $\theta_{SLref}$ of the swing-rotating angle of the left arm 114L, a waveform 2401L shows a mode of change in the command value $\theta_{PLref}$ of the push-rotating angle of the left arm 114L, and a waveform 2402L shows a mode of change in the command value $\theta_{ELref}$ of the massage-rotating angle of the contact group L mounted on the left arm 114L.

As described above, the swing-rotating angle $\theta_{SL}$ and the push-rotating angle $\theta_{PL}$ of the left arm 114L, and the massage-rotating angle $\theta_{EL}$ of the contact group L operate to substantially match each command value $\theta_{SLref}$, $\theta_{PLref}$, and $\theta_{ELref}$.

During time 0 to time t24(1), the left arm 114L waits at the position of swing-rotating angle 0° and push-rotating angle 0°. In other words, the left arm 114L is positioned on the back side of the head 10 and is waited in a state released from the head 10. Thus, the user can securely entrust the head 10 to the automatic hair washing apparatus 100. Meanwhile, the contact group L is positioned at an initial position of 0°.

During time t24(1) to time t24(2), the left arm 114L is swing-rotated to the angle position of 130° towards the front side of the head 10 while maintaining the arm push-rotating angle at 0° and the massage-rotating angle of the contact group L at 0°. In this case, a state in which the contact group L is distant from the head 10 can be maintained since the push-rotating angle is maintained at 0° Therefore, the left arm 114L can be safely swing-rotated to the front side of the head 10 without the contact group L reversely stroking the hair of the head 10.

Time t24(2) to time t24(3) is the waiting time of the swing-rotating. During this waiting period, the control mode switching section 903L switches the control loop to the reference symbol B side in FIG. 16, and turns ON the pushing control system. The waiting time from time t24(2) to time t24(3) is set to a time of the same extent as the time from when the push-rotating of the left arm 114L in the pushing direction is started until the contact group L is brought into contact with and stabilized at the head 10 with the instructed pushing force.

After the waiting time until time t24(3) is finished, the left arm 114L is swing-rotated towards the back side of the head 10 while pushing the contact group L against the head 10 with the instructed pushing force as the push-rotating angle is adjusted by the function of the control loop. Meanwhile, the contact group L reciprocates between the massage-rotating angle of 0° and 60° at a substantially constant period.

Thereafter, the left arm 114L reciprocates between the back side (angle position of 0°) and the front side (angle position of 130°) of the head 10 by being swing-rotated while pushing the contact group L, which is massage-turned at a substantially constant period, against the head 10 with the instructed pushing force.

The entire head 10 thus can be massaged and washed while acting the massaging operation by the contact group L on the head 10. In this case, the water washing, shampoo washing, and rinse washing can be realized by appropriately instructing the opening/closing of the water system valve 216, the washing agent system valve 217, and the conditioner system valve 218.

An example shown in FIG. 25 will now be described. In FIG. 25, a waveform 2500L shows a mode of change in the command value $\theta_{SLref}$ of the swing-rotating angle of the left arm 114L, a waveform 2501L shows a mode of change in the command value $\theta_{PLref}$ of the push-rotating angle of the left arm 114L, and a waveform 2502L shows a mode of change in the command value $\theta_{ELref}$ of the massage-rotating angle of the contact group L mounted on the left arm 114L.

As described above, the swing-rotating angle $\theta_{SL}$ and the push-rotating angle $\theta_{PL}$ of the left arm 114L, and the massage-rotating angle $\theta_{EL}$ of the contact group L substantially match each command value $\theta_{SLref}$, $\theta_{PLref}$, and $\theta_{ELref}$.

The operation from time 0 to time t25(3) is similar to the operation from time 0 to time t24(3) in FIG. 24, and thus the description will be omitted.

From time t25(3) to time t25(4), the left arm 114L is swing-rotated towards the back side of the head 10 while pushing the contact group L against the head 10 with the instructed pushing force as the push-rotating angle is adjusted by the function of the control loop. Meanwhile, the contact group L is operated to reciprocate between the massage-rotating angle of 0° and 60° at a substantially constant period.

At time t25(4), the left arm 114L is swing-rotated to the backside (angle position of 0°) of the head 10, and then the swing-rotating of the left arm 114L is once waited until time t25(5). Meanwhile, the control mode switching section 903L switches the control loop to the reference symbol A side in FIG. 16, and turns OFF the pushing control system, so that the left arm 114L is push-rotated in the releasing direction (open direction). At time t25(4), the reciprocating operation of the contact group L is stopped, and the contact group L is waited at the massage-rotating angle of 0°.

Similar to the operation from time t25(1) to time t25(2), the left arm 114L is swing-rotated to the front side (angle position of 130°) of the head 10 while maintaining the arm push-rotating angle at 0° and the massage-rotating angle of the contact group L at 0° from time t25(5) to time t25(6). In this case, a state in which the contact group L is distant from the head 10 can be maintained since the push-rotating angle is maintained at 0°. Therefore, the left arm 114L can be safely swing-rotated to the front side of the head 10 without the contact group L reversely stroking the hair of the head 10.

In the operation example shown in FIG. 25, when the left arm 114L is swing-rotated from the front side (angle position of 130°) to the back side (angle position of 0°) of the head 10, the pushing control system is turned ON, and the left arm 114L is swing-rotated while pushing the contact group L against the head 10. On the contrary, when the left arm 114L is swing-rotated from the back side (angle position of 0°) to the front side (angle position of 130°) of the head 10, the pushing control system is turned OFF, and the left arm 114L is swing-rotated with the contact group L released (opened) from the head 10. Generally, the direction from the front towards the back of the head 10 is the normal direction with respect to the growing manner of the person's hair, and the direction from the back towards the front is the reverse direction. Thus, if the head 10 is stroked from the back towards the front, the hair is reversely stroked and thus the hair may be entangled or the person being stroked may feel a sense of discomfort. In order to avoid this drawback, a state in which the contact group L is distant from the head 10 is maintained when the left arm 114L is swing-rotated to the front side in the operation example shown in FIG. 25. The operation of prohibiting the reverse stroke is very useful particularly when the hair is dry such as at the beginning of the washing operation.

An example shown in FIG. 26 will now be described. In the operation example shown in FIG. 26, the swing-rotating (waveform 2500L) and the push-rotating (waveform 2501L) are performed similar to the operation shown in FIG. 25, but the massage-rotating angle of the contact group L is fixed at a predetermined value shown with a waveform 2602L. The fixed value of the massage-rotating angle is, for example, set to 30°, which is the center of the movable range. When the left arm 114L is swing-rotated while pushing the contact group L having a fixed massage-rotating angle against the head 10, the operation like brushing from the front towards the back of the head 10 can be realized. With this operation, the untidy hair after the washing can be fixed.

Figure 27:
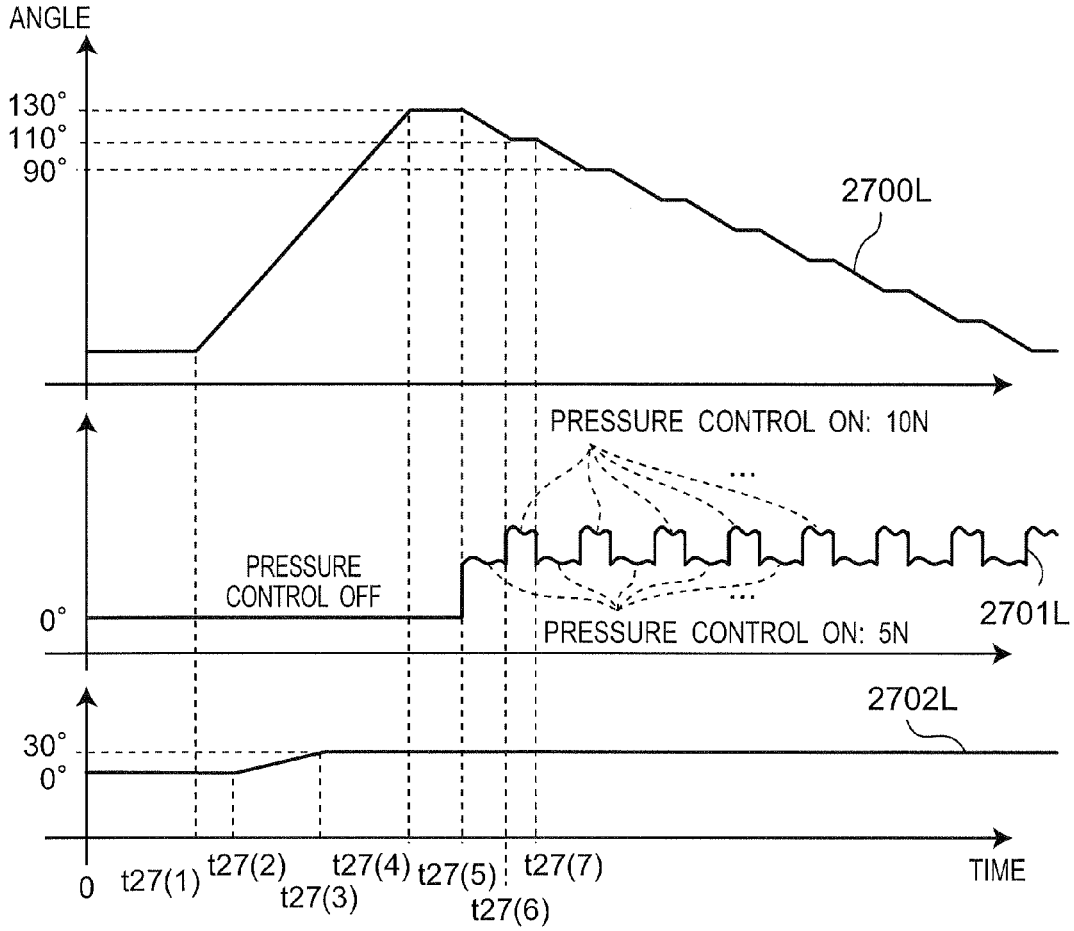
FIG. 27 is a ninth waveform diagram of a control command value generated in the control device of the automatic hair washing apparatus according to the first embodiment.

An example shown in FIG. 27 will now be described. In FIG. 27, a waveform 2700L shows a mode of change in the command value $\theta_{SLref}$ of the swing-rotating angle of the left arm 114L, a waveform 2701L shows a mode of change in the command value $\theta_{PLref}$ of the push-rotating angle of the left arm 114L, and a waveform 2702L shows a mode of change in the command value $\theta_{ELref}$ of the massage-rotating angle of the contact group L mounted on the left arm 114L.

As described above, the swing-rotating angle $\theta_{SL}$ and the push-rotating angle $\theta_{PL}$ of the left arm 114L, and the massage-rotating angle $\theta_{EL}$ of the contact group L operate to substantially match each command value $\theta_{SLref}$, $\theta_{PLref}$, and $\theta_{ELref}$.

In the operation shown in FIG. 27, the swing-rotating, the push-rotating, and the massage-rotating are all fixed at the angle position of 0° from time 0 to time t27(1). From time t27(1) to time t27(4), the left arm 114L is swing-rotated to the front side (angle position of 130°) of the head 10 while maintaining a state spaced apart to a maximum from the head 10 with respect to the pushing direction, similar to the operation examples shown in FIGS. 24-26. During the swing-rotating to the front side, the massage-rotating angle of the contact group L is changed from 0° to 30° from time t27(2) to time t27(3), and the massage-rotating angle is fixed at 30° after time t27(3).

After a short waiting time from time t27(4) to time t27(5), the left arm 114L is swing-rotated while linearly reducing the swing angle by a predetermined angle (e.g., about 20°) from time t27(5) to time t27(6). After a relatively small swing-rotating, the left arm 114L once stops the swing-rotating and waits from time t27(6) to time t27(7). After time t27(7), the left arm 114L repeats the swing-rotating of the predetermined angle and the once stopping (waiting state) of the swing-rotating until the angle position of the swing-rotating reaches the position of 0°.

At time t27(5), the pushing control system of the left arm 114L is turned ON. After time t27(5), predetermined pushing force Pa (e.g., pressure of 5N) is instructed in the pushing control system of the left arm 114L from time t27(5) to time t27(6) in which the left arm 114L is swing-rotated by a predetermined angle. Pushing force Pb (e.g., pressure of 10N) greater than the pushing force Pa is then instructed in the pushing control system of the left arm 114L from time t27(6) to time t27(7) in which the swing-rotating of the left arm 114L is in the waiting state.

According to the operation example shown in FIG. 27, the operation like performing finger pressing can be realized by slowly sliding down the head 10 from the front side towards the back side. Therefore, a more comfortable washing can be provided by mixing the operation shown in FIG. 27 in the operation during the washing.

Figure 28:
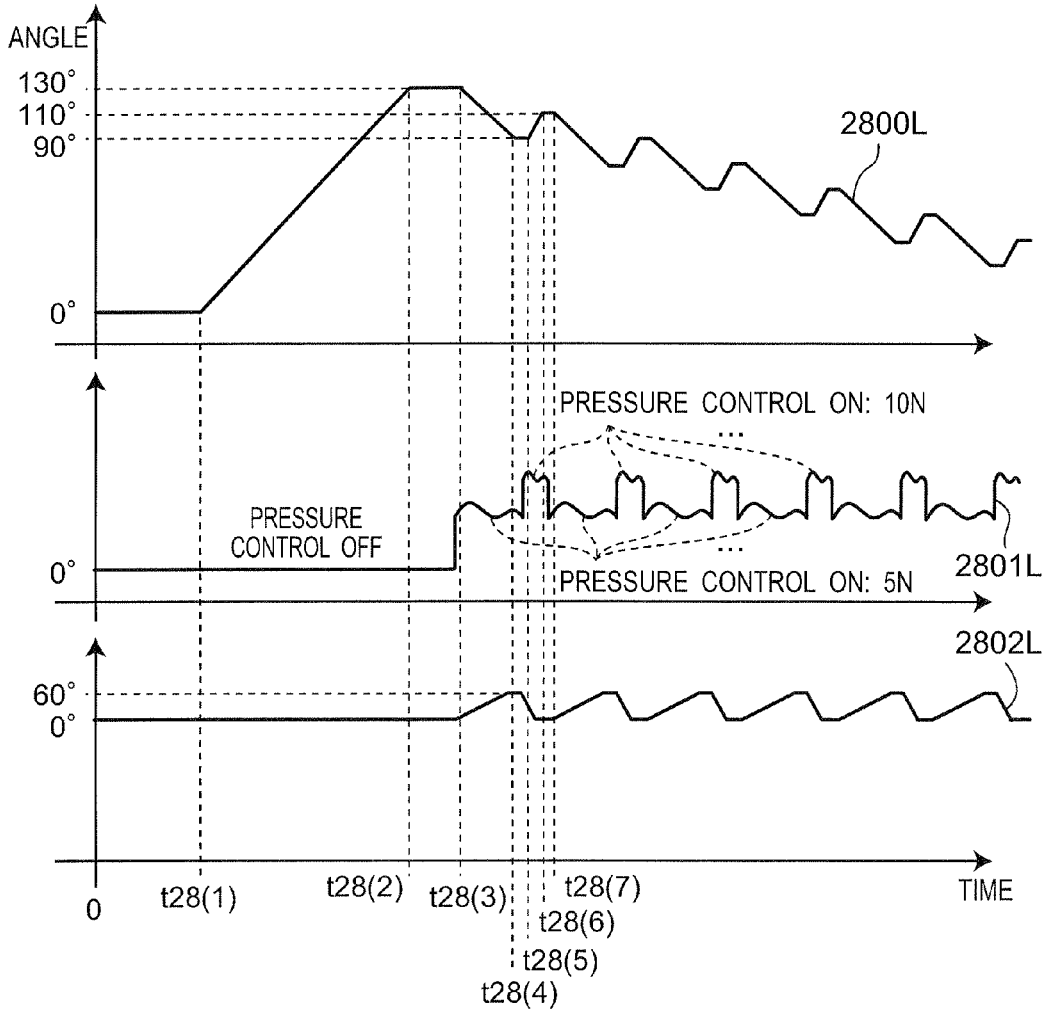
FIG. 28 is a tenth waveform diagram of a control command value generated in the control device of the automatic hair washing apparatus according to the first embodiment.

An example shown in FIG. 28 will now be described. In FIG. 28, a waveform 2800L shows a mode of change in the command value $\theta_{SLref}$ of the swing-rotating angle of the left arm 114L, a waveform 2801L shows a mode of change in the command value $\theta_{PLref}$ of the push-rotating angle of the left arm 114L, and a waveform 2802L shows a mode of change in the command value $\theta_{ELref}$ of the massage-rotating angle of the contact group L mounted on the left arm 114L.

As described above, the swing-rotating angle $\theta_{SL}$ and the push-rotating angle $\theta_{PL}$ of the left arm 114L, and the massage-rotating angle $\theta_{EL}$ of the contact group L operate to substantially match each command value $\theta_{SLref}$, $\theta_{PLref}$, and $\theta_{ELref}$.

In the operation shown in FIG. 28, the swing-rotating, the push-rotating, and the massage-rotating are all fixed at the angle position of 0° from time 0 to time t28(1). From time t28(1) to time t28(2), the left arm 114L is swing-rotated to the front side (angle position of 130°) of the head 10 while maintaining a state spaced apart to a maximum from the head 10 with respect to the pushing direction, similar to the operation examples shown in FIGS. 24-27.

After a short waiting time from time t28(2) to time t28(3), the left arm 114L is swing-rotated towards the back side while linearly reducing the swing angle by a predetermined angle (e.g., abut 20°) from time t28(3) to time t28(4), and period from time t28(4) to time t28(5) is a short waiting time in which the swing-rotating is once stopped. From time t28(5) to time t28(6), the left arm 114L is swing-rotated in the opposite direction (direction of returning to front side) while linearly increasing the swing angle by a predetermined angle (e.g., abut 10°), and period from time t28(6) to time t28(7) is a short waiting time in which the swing-rotating is once stopped. After time t28(7), the left arm 114L repeats a series of operations of sequentially carrying out the swing-rotating towards the back side, the once stopping of the swing-rotating (waiting state), the swing-rotating in the direction of returning to the front side, and the once stopping of the swing-rotating (waiting state) until the angle position of the swing-rotating reaches the position of 0°.

At time t28(3), the pushing control system of the left arm 114L is turned ON. After time t28(3), predetermined pushing force Pc (e.g., pressure of 5N) is instructed in the pushing control system of the left arm 114L from time t28(3) to time t28(4) in which the left arm 114L is swing-rotated towards the back side. The instructed value of the pushing force in the pushing control system of the left arm 114L is switched to pushing force Pd (e.g., pressure of 10N) greater than the pushing force Pc from time t28(4) to time t28(5) in which the swing-rotating of the left arm 114L is once stopped. From time t28(5) to time t28(6) in which the left arm 114L is swing-rotated to returning to the front side, the instructed value of the pushing force in the pushing control system of the left arm 114L is maintained at the pushing force Pd (e.g., pressure of 10N). Furthermore, from time t28(6) to time t28(7) in which the swing-rotating of the left arm 114L is once stopped, the instructed value of the pushing force in the pushing control system of the left arm 114L is again switched to the pushing force Pc (e.g., pressure of 5N). The switching of the instructed value of the pushing force is similarly performed after time t28(7) in accordance with the timing of switching the operation related to the swing-rotating described above.

The massage-rotating angle of the contact group L is controlled to change from 0° to 60° from time t28(3) to time t28(4) in which relatively small pushing force Pc (e.g., 5N) is instructed in the pushing control system. The massage-rotating angle of the contact group L is controlled to change from 60° to 0° from time t28(5) to time t28(6) in which relatively large pushing force Pc (e.g., 10N) is instructed in the pushing control system.

According to the operation example shown in FIG. 28, control is performed to invert the swing-rotating of the left arm 114L every predetermined time while slowly sliding down as a whole from the front side towards the backside of the head 10, and strengthen the pushing force of the left arm 114L during the inversion of the swing-rotating. The direction of the massage-rotating of the contact group L is controlled to be switched in synchronization with the switching of the pushing force. The operation like performing the massaging operation while performing the finger pressing thus can be realized. Therefore, a more comfortable washing can be provided by mixing the operation shown in FIG. 27 in the operation during the washing.

One example of a cooperative control of the swing-rotating, the push-rotating, and the massage-rotating has been described above for the left arm 114L, but similar cooperative control can be performed for the right arm 114R. Various washing operations can be provided by arbitrarily combining the similar operation of the right arm 114R to the operation of the left arm 114L described above. In this case, variety of combinations can be realized by synchronizing or shifting the operation phases of the left and right arms 114L and 114R.

A system operation flow managed by the system control section 708 will now be described.

Figure 29:
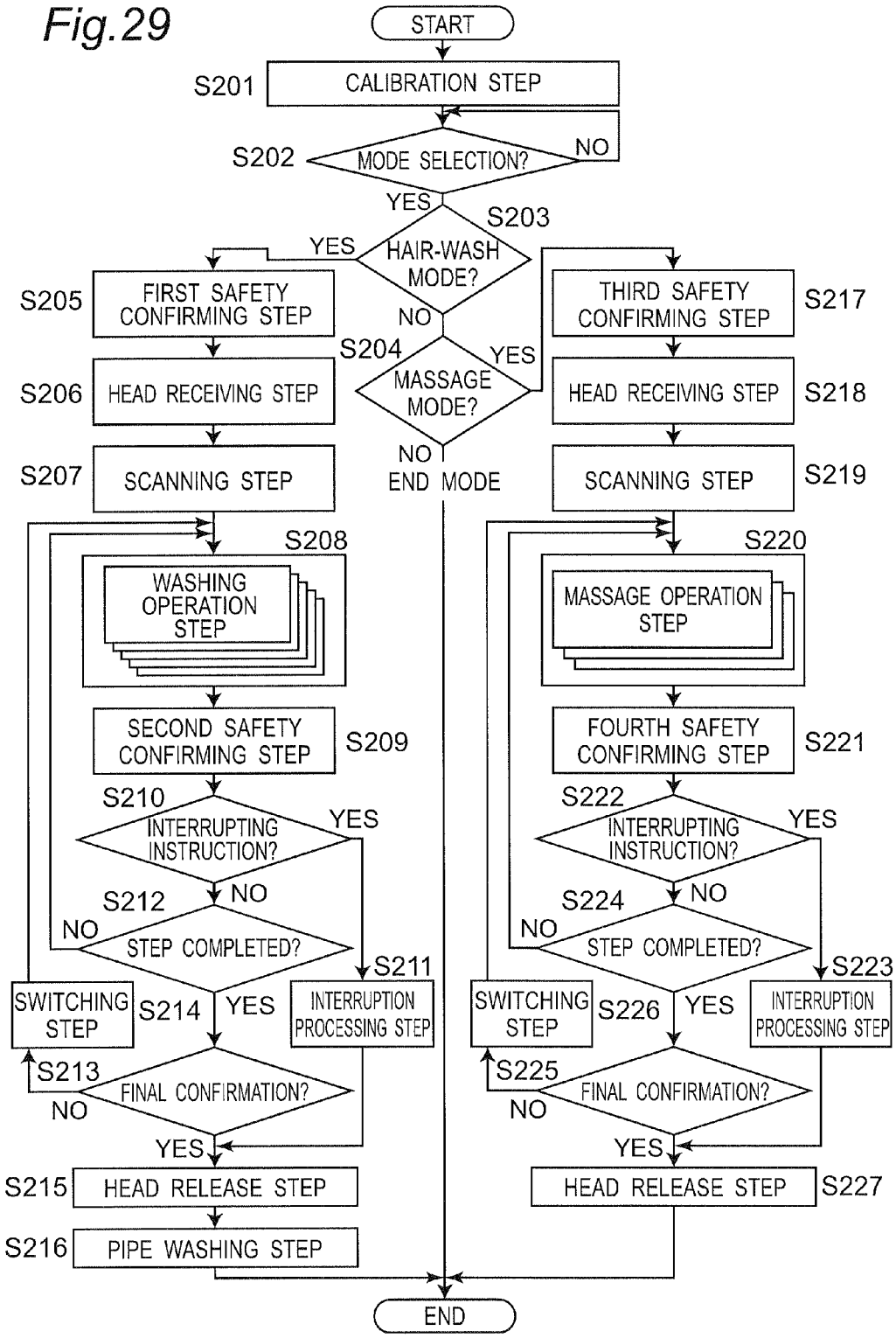
FIG. 29 is a flowchart showing a system operation flow of the control device of the automatic hair washing apparatus according to the first embodiment.

FIG. 29 is a system operation flow of the control device 700 of the automatic hair washing apparatus 100 according to the first embodiment of the present invention. The system operation shown in FIG. 29 is started when the control device 700 of the automatic hair washing apparatus 100 is started.

When the control device 700 is started, a calibration step S201 is first executed. In the calibration step S201, the tables 902L (see FIG. 18) and 902R holding the values indicated by the pressure sensors 211L and 211R in a state where the contact groups L and R are distant from the head 10 are acquired for a predetermined plurality of combinations of the swing-rotating angle and the push-rotating angle of the left and right arms 114L and 114R, and stored in a storage unit 708I.

In the calibration step S201, the values of the pressure sensors 211L and 211R are measured for every combination of the swing-rotating angle and the push-rotating angle without the head 10 inserted in the bowl 101, and the tables 902L and 902R are created based on the measurement values. The specific measuring operation is as described above. The obtained tables 902L and 902R are used to make a correction such that the influence of the gravity with respect to the members interposed between the pressure sensor 211L and 211R and the head 10 exerted on the output value of the pressure sensor 211L and 211R is excluded in the subsequent steps. In other words, the offset values corresponding to the various positions of the arms 114L and 114R are calculated based on the values of the tables 902L and 902R.

In a mode selecting operation confirming step S202, whether or not one of the hair-wash mode, the massage mode, and the end mode is selected with the operation by the user is determined. The hair-wash mode is a mode in which the opening/closing of the water system valve 216, the washing agent system valve 217, and the conditioner system valve 218 is controlled to perform washing. The massage mode is a mode in which the head 10 is massaged with the left and right arms 114L and 114R and the contact groups L and R. The end mode is a mode in which the system operation of the control device 700 is ended.

If confirmed that the selecting operation of one of the modes is performed in the mode selecting operation confirming step S202, the process proceeds to the next step.

In a next wash mode selection confirming step S202, whether or not the mode selected by the user is the hair-wash mode is determined. If the selection of the hair-wash mode is confirmed according to such determination, the hair-wash mode to be described later is executed. If confirmed that the mode selected by the user is the mode other than the hair-wash mode in the wash mode selection confirming step S202, the process proceeds to a massage mode selection confirming step S204.

In the massage mode selection confirming step S204, whether or not the mode selected by the user is the massage mode or the end mode is determined. If the selection of the massage mode is confirmed according to such determination, the massage mode to be described later is executed. The system operation is ended if the selection of the end mode is confirmed.

The hair-wash mode will now be described.

In the hair-wash mode, the necessary confirming operation is first executed before the user's head 10 is inserted in the bowl 101 in a first safety confirming step S205. Specifically, for example, presence/absence of attachments such as hairpins, hair bands, and etc. in the hair of the user's head 10 is confirmed, and the user is called to attention to remove the attachments if there are any attachments. Whether or not the water shield 510 shown in FIG. 10 is attached to the user's head 10 is confirmed, and the user is asked to attach the water shield 510 if not attached.

In the first safety confirming step S205, the confirmation on the presence/absence of attachments such as head accessories and the confirmation on the attachment of the water shield 510 are performed, for example, by a detection of the attachment or the water shield 510 by a camera. If a communicator such as a IC tag is mounted on the water shield 510, the attachment of the water shield 510 can be confirmed by the wireless communication with the communicator. Furthermore, information for calling the attention of the user to remove the attachment or to attach the water shield 510 may be notified to the user by being displayed on the touch panel type operating section 707 or a separately arranged display section as visual information or by being output from an audio device as audio information.

In a head receiving step S206, a preparation operation for inserting the user's head 10 to the bowl 101 is executed. Specifically, the left and right support columns 102L and 102R are slidably moved so that the spacing between the support column 102L supporting the left arm 114L and the support column 102R supporting the right arm 114R are spread to a maximum. In the head receiving step S206, the left and right arms 114L and 114R operate such that the push-rotating angle is 0°. The contact groups L and R are thereby arranged spaced apart from the head 10 at a maximum. In the head receiving step S206, the left and right arms 114L and 114R also operate such that the swing-rotating position is the position (angle position of 0°) on the back side of the head 10.

The left arm 114L and the right arm 114R operating in such manner are in a state the spacing in between is opened to a maximum, and are positioned on the bottom side of the bowl 101. Therefore, the user's head 10 is safely placed in the bowl 101 without being inhibited by the left and right arms 114L and 114R.

Furthermore, in the head receiving step S206, when the insertion of the head 10 in the bowl 101 is confirmed, the width adjustment between the left and right support columns 102L and 102R and the position adjustment of the head support 112 in accordance with the shape and size of the head 10 are executed. The confirmation on the insertion of the head 10 is performed based on the detection by various sensors. After the adjustment operation in accordance with the shape and the like of the head 10 is completed, the process proceeds to the next scanning step S207.

In the scanning step S207, the tables 901L and 901R described above are acquired and stored in the storage unit 708I. As described above, the tables 901L and 901R hold the value of the push-rotating angle with respect to the swing-rotating angle of each arm 114L and 114R in a case where the contact group L and R of the arm 114L and 114R is pushed against the head 10 at predetermined pushing force.

In the scanning step S207, the push-rotating angle $\theta_{PL}$ is scanned while gradually increasing the swing-rotating angle $\theta_{SL}$ and $\theta_{SR}$ of each arm 114L and 114R from 0° with the left and right arms 114L and 114R pushed against the head 10 at a substantially constant pressure. The value of the push-rotating angle $\theta_{PL}$ with respect to each value of the swing-rotating angle $\theta_{SL}$ is acquired by scanning in such manner, and the tables 901L and 901R are created based on the acquired value.

Figure 30:
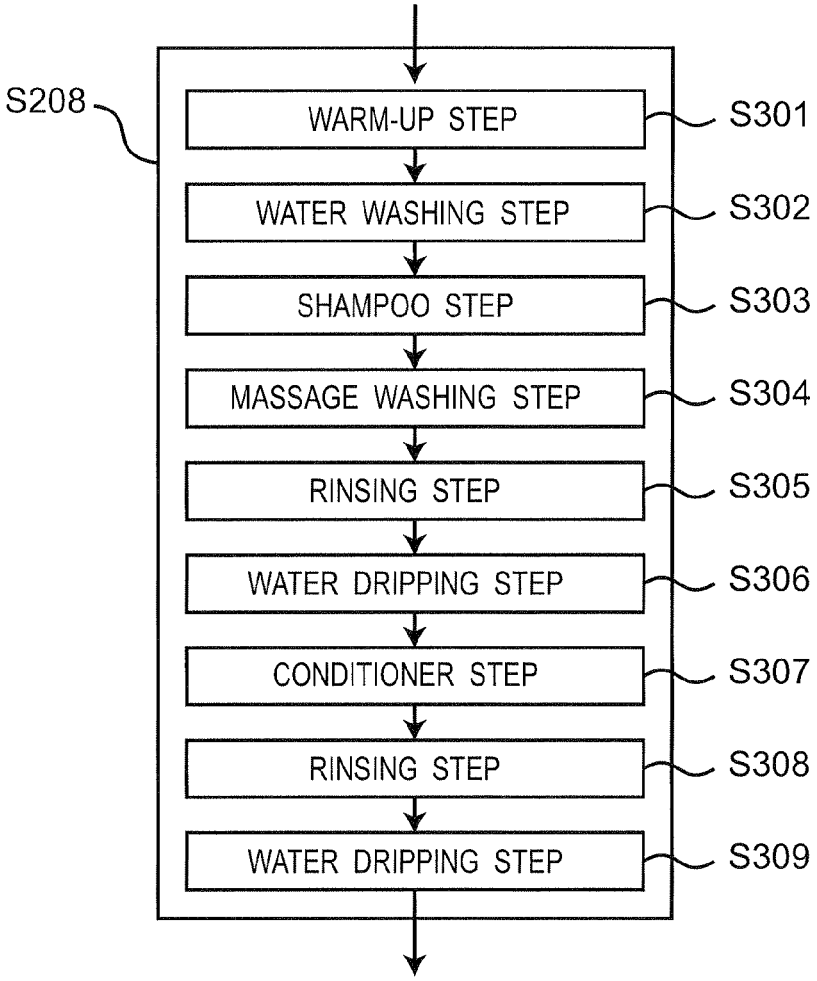
FIG. 30 is a flowchart showing the details of a hair-washing operation mode step of the control device of the automatic hair washing apparatus according to the first embodiment.

A washing operation step S208 is then executed. As shown in FIG. 30, in the washing operation step S208, a warm-up step S301, a water washing step S302, a shampoo step S303, a massage washing step S304, a rinsing step S305, a water dripping step S306, a conditioner step S307, a rinsing step S308, and a water dripping step S309 are sequentially executed.

In the warm-up step S301, the preparation operation to become a state in which a hot water of an appropriate temperature can be supplied is executed. Specifically, the water system valve 216 is opened by a slight amount and then waited until the hot water becomes an appropriate temperature with the hot water supplied from a water heater (not shown) connected to the automatic hair washing apparatus 100 being flowed by a small amount. Thus, the cold water is avoided from suddenly ejecting on the user's head 10 thus causing the user to feel a sense of discomfort.

In the warm-up step S301, the temperature of the hot water supplied from the water heater is preferably detected with a temperature sensor arranged at an appropriate location so that the hot water at an appropriate temperature can be supplied. In the washing operation step S208, a step of discharging water, washing agent or the like remaining in the pipes 111L and 111R may be provided before the warm-up step S301 or at the end of the washing operation step S208. Thus, the water and the washing agent remaining in the pipes 111L and 111R is avoided from firstly ejecting on the user's head 10 and causing the user to feel a sense of discomfort. In this case, a drain valve may be arranged at an appropriate location of the automatic hair washing apparatus 100.

After the warm-up step S301 is finished, the water washing step S302 is executed.

In the water washing step S302, the left and right arms 114L and 114R are first swing-rotated to the front side (angle position of 130°) of the head 10 while maintaining the push-rotating angle at the angle position of 0° (release state). The water system valve 216 is then opened while maintaining the swing-rotating angle of the arms 114L and 114R on the front side (angle position of 130°) of the head 10, and the hot water is ejected from a plurality of nozzles 110 of the pipes 111L and 111R to the hair of the head 10. In this case, the opening degree of the water system valve 216 is set to be gradually widened so that a great amount of hot water is not suddenly ejected on the head 10. The left and right arms 114L and 114R are reciprocated and swing-rotated over plural times in the angle range from 0° to 130°. The hot water is thereby ejected on the entire head 10 and the hot water soaks into the hair.

Furthermore, in the water washing step S302, the hair is massage-washed by ejecting the hot water towards the head 10 while operating, in a composite manner, the swing-rotating angle and the push-rotating angle of the left and right arms 114L and 114R, and the massage-rotating angle of the contacts L and R, as described above. As shown in FIG. 26, it is first desirable to use the operation of fixing the contact groups L and R at the position of 30°, and turning ON the pushing force control only during the swing-rotating from the position (angle position of 130°) on the front side towards the position (angle position of 0°) on the back side of the head 10. The operation like brushing from the front towards the back of the head 10 can be realized.

After the water washing step S302 is finished, the shampoo step S303 is executed.

In the shampoo step S303, the left and right arms 114L and 114R are first swing-rotated to the front side (angle position of 130°) of the head 10 while maintaining the push-rotating angle at 0°. The washing agent system valve 217 is then opened with the swing-rotating angle of the arms 114L and 114R maintained at the position (angle position of 130°) on the front side of the head 10, and the washing liquid such as shampoo is ejected from the plurality of nozzles 110 of the pipes 111L and 111R to the hair of the head 10. As previously described, in the automatic hair washing apparatus 100, the washing agent is formed into a mousse form by mixing the diluted washing liquid, in which the commercially available shampoo is diluted with water, and the compressed air in the mixing unit 220, and then the washing agent in the mousse form is ejected from the nozzle 110.

In this case, the opening degree of the washing agent system valve 217 is set to be gradually widened so that a great amount of washing agent is not suddenly ejected on the head 10. The left and right arms 114L and 114R are reciprocated and swing-rotated over plural times in the angle range from 0° to 130°, so that the washing agent is applied on the entire head 10. In the shampoo step 303, the left and right arms 114L and 114R are desirably operated in phase, as shown in FIG. 19. The washing agent thus can be evenly applied on the entire head 10.

The massage washing step S304 is then executed. In the massage washing step S304, the swing-rotating angle and the push-rotating angle of the left and right arms 114L and 114R and the massage-rotating angle of the contact groups L and R are operated, in a composite manner, as shown in FIGS. 19-28, so that the massage washing is performed over the entire head 10 by the contact groups L and R. In the massage washing step S304, the pushing force command value of the pushing force control of the left and right arms 114L and 114R is desirably set low at first, and made stronger gradually or in a stepwise manner. The massaging operation comfortable to the user thus can be introduced, and the washing operation that does not cause the user to feel a sense of discomfort can be executed.

After the massage washing step S304 is finished, the rinsing step S305 is executed.

In the rinsing step S305, the water system valve 216 is opened, and the swing-rotating angle of the push-rotating angle of the left and right arms 114L and 114R and the massage-rotating angle of the contact groups L and R are operated, in a composite manner, while ejecting the hot water from the nozzles 110, similar to the water washing step S302. In the rinsing step S305, the pushing control system of the left and right arms 114L and 114R is first turned OFF to apply hot water in a release state and roughly wash off the washing agent. The pushing control system is thereafter turned ON, and the contact groups L and R are reciprocated for massage-rotating to efficiently rinse the head 10.

As shown in FIG. 26, at the end of the rinsing step S305, it is desirable to copiously use the operation of fixing the contact groups L and R at the position of 30°, and turning ON the pushing force control only during the swing-rotating from the front side (angle position of 130°) towards the back side (angle position of 0°) of the head 10. The effect like brushing untidy hair from the massage washing step S304 or the like thus can be obtained.

After the rinsing step S305 is finished, the water dripping step S306 is executed.

In the water dripping step S306, the water system valve 216 is closed, and the ejection of hot water from the nozzles 110 is stopped. The left and right arms 114L and 114R are reciprocated and swing-rotated with the massage-rotating angle of the contact groups L and R fixed. Specifically, as shown in FIGS. 25 and 26, for example, the pushing force control is preferably turned ON only during the swing-rotating from the position (angle position of 130°) on the front side towards the position (angle position of 0°) on the back side of the head 10, and the pushing force control is preferably turned OFF to the release state during the swing-rotating from the position (angle position of 0°) on the back side towards the position (angle position of 130°) on the front side. According to such operation, the effect like squeezing out the hot water contained in the hair while avoiding the reverse stroking of the hair can be obtained.

After the water dripping step S306 is finished, the conditioner step S307 is executed.

In the conditioner step S307, the left and right arms 114L and 114R are first swing-rotated to the position (position of 130°) on the front side of the head 10 while maintaining the push-rotating angle in the release state. The conditioner system valve 218 is then opened with the arms 114L and 114R stopped on the front side (angle position of 130°) of the head 10, and the conditioner such as rinse is ejected from the plurality of nozzles 110 of the pipes 111L and 111R to the hair of the head 10.

In this case, the opening degree of the conditioner system valve 218 is set to be gradually widened so that a great amount of conditioner is not suddenly ejected on the head 10. The left and right arms 114L and 114R are then reciprocated and swing-rotated over plural times in the angle range from 0° to 130°, so that the conditioner is applied on the entire head 10. In the conditioner step S307, the left and right arms 114L and 114R are desirably operated in phase, as shown in FIG. 19. The conditioner thus can be evenly applied on the entire head 10.

Furthermore, the conditioner system valve 218 is closed at the end of the conditioner step S307, and the ejection of the conditioner from the nozzles 110 is stopped. As shown in FIGS. 25 and 26, the pushing force control is preferably turned ON only during the swing-rotating from the position (angle position of 130°) on the front side towards the position (angle position of 0°) on the back side of the head 10, and the pushing force control is preferably turned OFF to the release state during the swing-rotating from the position (angle position of 0°) on the back side towards the position (angle position of 130°) on the front side. The conditioner is thus blended in the hair and the effect like brushing can be obtained.

After the conditioner step S307 is finished, the rinsing step S308 similar to the rinsing step S305 and the water dripping step S308 similar to the water dripping step S306 are executed, sequentially. The rinsing time in the rinsing step S308 following the conditioner step S307 is preferably set to be shorter than the rinsing step S305 following the shampoo step S303 in order to avoid the conditioner effect from reducing caused by excessive rinsing. When using the conditioner that does not need to be rinsed, the rinsing step S308 and the water dripping step S309 after the conditioner step S307 may be omitted.

A second safety confirming step S209 shown in FIG. 29 is sequentially executed during the execution of the above warm-up step S301, the water washing step S302, the shampoo step S303, the massage washing step S304, the rinsing step S305, the water dripping step S306, the conditioner step S307, the rinsing step S308, and the water dripping step S309 in the washing operation step S208.

Returning back to FIG. 29, in the second safety confirming step S209, the state of the automatic hair washing apparatus 100 during the execution of the washing operation step S208 is monitored. Specifically, for example, the current value, the operation angle, or the like of each motor of the automatic hair washing apparatus 100 is monitored, and notification is made to the user and an instruction is made to forcibly interrupt the washing operation if abnormality is found.

In an interruption confirming step S210, whether or not an interrupting instruction of the washing operation by the operation of the user or the forcible interrupting instruction in the second safety confirming step S209 is made is confirmed during the washing operation step S208. If either one of the interrupting instruction is confirmed, an interruption processing step S211, to be described later, is executed, and the overall operation is terminated after a head release step S215 to be described later and a pipe washing step S216 to be described later. If the interrupting instruction is not confirmed, the process proceeds to a washing operation completion confirming step S212.

In the washing operation confirming step S212, whether each step of the warm-up step S301, the water washing step S302, the shampoo step S303, the massage washing step S304, the rinsing step S305, the water dripping step S306, the conditioner step S307, the rinsing step S308, and the water dripping step S309 in the washing operation shown in FIG. 30 is completed is confirmed. If each step is not completed as a result of the confirmation, the execution of the relevant step is continued. If the completion of each step is confirmed, the process proceeds to the next final washing operation confirming step S213. If the final step (water dripping step S309 shown in FIG. 30) in the washing operation is not completed according to the determination in the final washing operation confirming step S213, the process switches to the next step in the washing operation shown in FIG. 30 in the washing operation switching step S214.

If the completion of the final step (water dripping step S309 shown in FIG. 30) of the washing operation step S208 is confirmed in the final washing operation confirming step S213, the process proceeds to the head release step S215.

The interruption processing step S211 will be described. In the interruption processing step S211, the swing-rotating operation and the push-rotating operation of the left and right arms 114L and 114R and the massage rotating operation of the contact groups L and R are first stopped, and the water system valve 216, the washing agent system valve 217, and the conditioner system valve 218 are all closed. When stopping the push-rotating operation, the control mode switching section 903L and 903R is forcibly switched to the reference symbol A side of FIG. 16, the pushing force control is turned OFF, and switch is made to the position control mode of holding the angle position in this case. Thereafter, the left and right arms 114L and 114R are pushed and rotated to the limit in the release direction so that the contact groups L and R are spaced apart from the head 10 at a maximum.

The head release step S215 will be described. In this step S215, the swing-rotating operation and the push-rotating operation of the left and right arms 114L and 114R and the massage-rotating operation of the contact groups L and R are stopped, and the water system valve 216, the washing agent system valve 217, and the conditioner system valve 218 are all closed, similar to the interruption processing step S211. When stopping the push-rotating operation, the control mode switching section 903L and 903R is forcibly switched to the reference symbol A side of FIG. 16, the pushing force control is turned OFF, and switch is made to the position control mode of holding the angle position in this case. Thereafter, the left and right arms 114L and 114R are pushed and rotated to the limit in the release direction so that the contact groups L and R are spaced apart from the head 10 at a maximum. Furthermore, in the head release step S215, the left and right arms 114L and 114R where the push-rotating in the release direction has been completed are swing-rotated to the back side (angle position of 0°) of the head 10.

Thus, similar to the head receiving step S206, the left arm 114L and the right arm 114R are positioned on the bottom side of the bowl 101 with a spacing in between. The operation of the person to remove the head 10 outside the bowl 101 can be safely performed.

When confirmed that the head 10 is outside the bowl 101 in the head release step S215, the next pipe washing step S216 is executed. The confirmation that the head 10 is outside the bowl 101 can be detected with various sensors.

In the pipe washing step S216, the water system valve 216 is opened, so that the conditioner and the like remaining in the pipes 111L and 111R can be washed away.

Thus, when performing the hair washing operation the next time, the conditioner and the like remaining in the pipes 111L and 111R can be prevented from being ejected on the user's head 10 first. Furthermore, the conditioner and the like remaining in the piping can be prevented from hardening, so that clogging of the piping 219 can be prevented.

After the pipe washing step S216 is finished, all operations of the hair-wash mode are terminated.

The massage mode will now be described.

In the massage mode, the presence/absence of attachments such as a hairpin or a hair band in the hair of the user's head 10 is confirmed in the third safety confirming step S217, and the user is urged to remove the attachment if there is any attachment. The specific operation is similar to the first safety confirming step S205 in the hair-wash mode other than that the attachment confirmation of the water shield 510 is not necessary.

In the head receiving step S218, the operation similar to the head receiving step S206 in the hair-wash mode is executed.

In the following scanning step S219, the operation similar to the scanning step S207 in the hair-wash mode is executed.

After the scanning step S219 is completed, a massage operation step S220 is executed.

Figure 31:
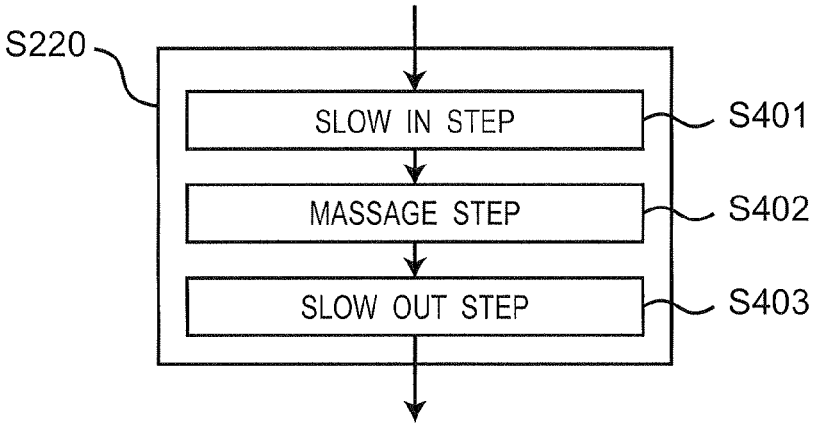
FIG. 31 is a flowchart showing the details of a massage operation mode step of the control device of the automatic hair washing apparatus according to the first embodiment.

As shown in FIG. 31, in the massage operation step S220, a slow in step S401, a massage step S402, and a slow out step S403 are sequentially executed. In the slow in step S401, the massage step S402, and the slow out step S403, the swing-rotating angle and the push-rotating angle of the left and right arms 114L and 114R and the massage rotating angle of the contact groups L and R are controlled, in a composite manner, as shown in FIGS. 19-28 to massage the entire head 10 with the contact groups L and R. With respect to the setting of the pushing force command value of the pushing force control of the left and right arms 114L and 114R, the pushing force is set relatively weak in the slow in step S401, the pushing force is set relatively strong in the massage step S402, and the pushing force is again set relatively weak in the slow out step S403. The massage operation at the time of introduction and at the time of finishing thus becomes the massage operation gentle to the user, and thus a massage operation comfortable to the user can be executed.

In the massage mode, the water system valve 216, the washing agent system valve 217, and the conditioner system valve 218 are all closed.

Returning back to FIG. 29, the state of the automatic hair washing apparatus 100 during the execution of the massage operation step S220 (each step S401, S402, S403 shown in FIG. 31) is monitored by a fourth safety confirming step S221. Specifically, for example, the current value, the operation angle, or the like of each motor of the automatic hair washing apparatus 100 is monitored, and notification is made to the user and an instruction is made to forcibly interrupt the massage operation if abnormality is found.

In the interruption confirming step S222, whether or not interrupting instruction of the massage operation by the operation of the user during the execution of the massage operation step S220 or the forcible interrupting instruction by the fourth safety confirming step S221 is made is confirmed. If either one of the interrupting instruction is confirmed, an interruption processing step S223, to be described later, is executed, and the overall operation is terminated after the head release step S227, to be described later. If the interrupting instruction is not confirmed, the process proceeds to a massage operation completion confirming step S224.

In the massage operation confirming step S224, whether or not each step of the slow in step S401, the massage step S402, and the slow out step S403 in the massage operation shown in FIG. 31 is completed is confirmed. If each step is not completed as a result of the confirmation, the execution of the relevant step is continued. If the completion of each step is confirmed, the process proceeds to the next final massage operation confirming step S225. A switch is made to the next step in the massage operation shown in FIG. 31 in a massage operation switching step S226 if the final step (slow out step S403 shown in FIG. 31) in the massage operation is not completed according to the determination of the final massage operation confirming step S225.

If the completion of the final step (slow out step S403 shown in FIG. 31) of the massage operation step S220 is confirmed in the final massage operation confirming step S225, the process proceeds to the head release step S227.

The interruption processing step S223 will now be described. In the interruption processing step S223, the swing-rotating operation and the push-rotating operation of the left and right arms 114L and 114R, and the massage rotating operation of the contact groups L and R are first stopped. When stopping the push-rotating operation, the control mode switching sections 903L and 903R are forcibly switched to the reference symbol A side of FIG. 16, the pushing force control is turned OFF, and switch is made to the position control mode of holding the angle position in this case. Thereafter, the left and right arms 114L and 114R are pushed and turned to the limit in the release direction so that the contact groups L and R are spaced apart from the head 10 at a maximum.

The head release step S227 will now be described. In the head release step S227, the swing-rotating operation and the push-rotating operation of the left and right arms 114L and 114R, and the massage-rotating operation of the contact groups L and R are first stopped, similar to the interruption processing step S223. When stopping the push-rotating operation, the control mode switching sections 903L and 903R are forcibly switched to the reference symbol A side of FIG. 16, the pushing force control is turned OFF, and switch is made to the position control mode of holding the angle position in this case. Thereafter, the left and right arms 114L and 114R are pushed and rotated to the limit in the release direction so that the contact groups L and R are spaced apart from the head 10 at a maximum. Furthermore, in the head release step S215, the left and right arms 114L and 114R where the push-rotating in the release direction has been completed are swing-rotated to the back side (angle position of 0°) of the head 10.

Thus, the left arm 114L and the right arm 114R are positioned on the bottom side of the bowl 101 with a spacing in between, similar to the head receiving step S218. The person can thus safely carry out the operation of taking the head 10 out of the bowl 101.

After the head release step S227 is completed, the entire operation of the massage mode is terminated.

As described above, according to the automatic hair washing apparatus 100, the left arm 114L and the right arm 114R including the contact groups L and R positioned on the left and the right of the head are arranged. The swing-rotating angle and the push-rotating angle of the left and right arms 114L and 114R and the massage-rotating angle of the contact groups L and R, as well as the water system valve, the washing agent system valve, and the conditioner system valve can be controlled in a composite manner. The washing operation thus can be safely executed without placing a strain on the user's neck. Moreover, not only the washing, but the head massage can also be executed.

The control operation of the massage-rotating angles $\theta_{EL}$ and $\theta_{ER}$ of the left and right contact groups L and R will be further described with reference to FIG. 32 to FIG. 35.

As described above, the contact groups L and R are basically controlled to reciprocately rotate over the entire angle range (angle range from 0° to 60°) of the massage-rotating angles $\theta_{EL}$ and $\theta_{ER}$ during the massage-rotating operation. However, if the push-rotating angles $\theta_{PL}$ and $\theta_{PR}$ of the arms 114L and 114R are large, the ends of the left and right arms 114L, and 114R may become very close. Thus, the contacts 109 of the left and right contact groups L and R may interfere with each other at the central part of the head 10 if the basic control is constantly performed with respect to the massage-rotating angles $\theta_{EL}$ and $\theta_{ER}$. In order to avoid such interference of the contacts 109, the massage-rotating angles $\theta_{EL}$ and $\theta_{ER}$ are controlled in the following manner as necessary.

Figure 32:
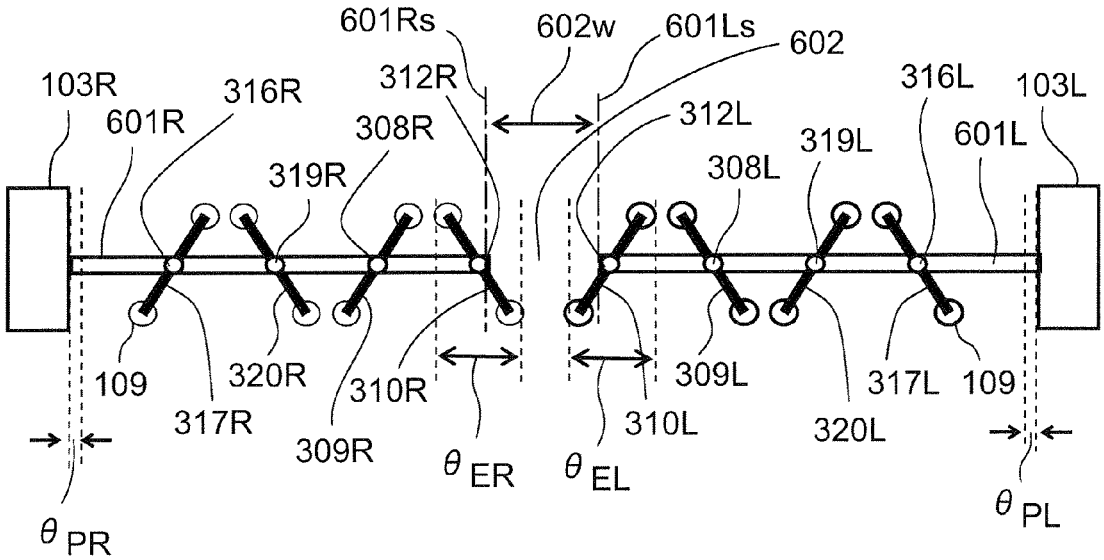
FIG. 32 is a diagram showing an arrangement state when the swing angles $\theta_{SL}$ and $\theta_{SR}$ of the left and right arm sections of the automatic hair washing apparatus according to the first embodiment are 130°.

FIG. 32 is a view showing an arrangement state of the contact 109 when the swing-rotating angles $\theta_{SL}$ and $\theta_{SR}$ of the left and right arms 114L and 114R are both 130°. In FIGS. 32-35, the unit where the first arm 105L, the second arm 106L, and the third arms 107L and 108L of the left arm 114L are combined is collected to one and schematically shown as a left arm section 601L. Similarly, the unit where the first arm 105R, the second arm 106R, and the third arms 107R and 108R of the right arm 114R are combined is collected to one and schematically shown as a right arm section 601R.

The state shown in FIG. 32 is a state in which the left and right arm sections 601L and 601R are swing-rotated to the front side of the head 10, and the contact 109 is arranged to make contact with the vicinity of the forehead of the user. Generally, the distance from the support shaft 104L and 104R of the arm section 601L and 601R to the forehead of the user is large compared to the distance from the support shaft 104L and 104R to the top of the head 10, and thus the push-rotating angles $\theta_{PL}$ and $\theta_{PR}$ in this case become relatively small. In the state shown in FIG. 32, the width of a gap 602 (hereinafter referred to as "central gap width 602*w*") between the ends of the left and right arm sections 601L and 601R becomes relatively large. Therefore, the possibility that the contacts 109 positioned at the ends of the left and right arm sections 601L and 601R interfere with each other is low, and the massage-rotating angles $\theta_{EL}$ and $\theta_{ER}$ can be controlled by basic control.

Figure 33:
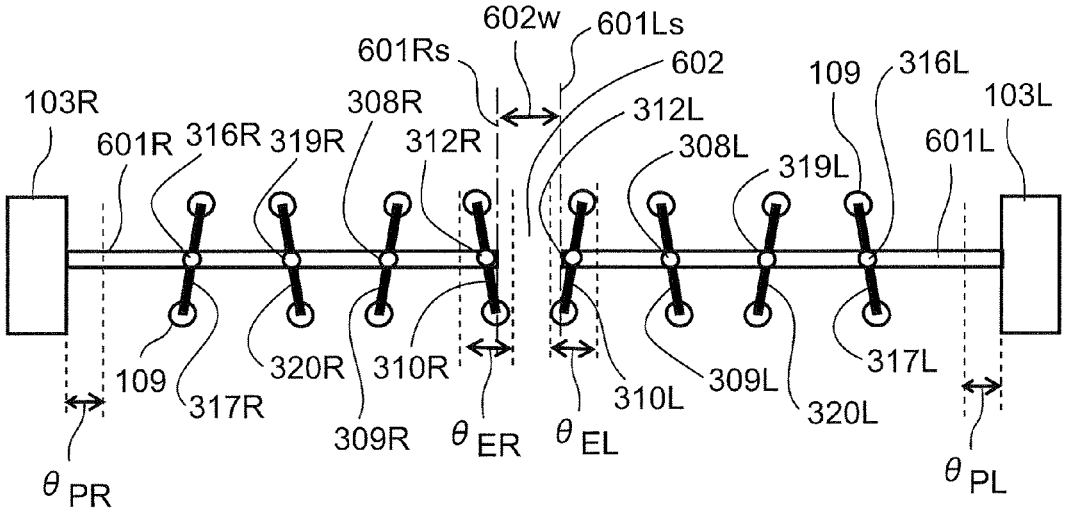
FIG. 33 is a diagram showing a state when the swing angles $\theta_{SL}$ and $\theta_{SR}$ of the left and right arm sections of the automatic hair washing apparatus according to the first embodiment are 90°.

FIG. 33 is a view showing an arrangement state of the contact 109 when the swing-rotating angles $\theta_{SL}$ and $\theta_{SR}$ of the left and right arms 601L and 601R are both 90°. In this case, the contact 109 is arranged to make contact with the vicinity of the top of the head 10. Since the distance from the support shaft 104L and 104R of the arm section 601L and 601R to the top of the head 10 is relatively small, the push-rotating angles $\theta_{PL}$ and $\theta_{PR}$ in this case become relatively large. The central gap width 602*w* becomes relatively narrow, and the contacts 109 positioned at the ends of the left and right arm sections 601L and 601R may possibly interfere with each other if the massage-rotating angles $\theta_{EL}$ and $\theta_{ER}$ are controlled by basic control.

In order to solve the above problem, the movable range of the massage-rotating angles $\theta_{PL}$ and $\theta_{ER}$ is limited to a range where the interference of the contacts 109 at the end of the arms can be avoided according to the magnitude of the push-rotating angles $\theta_{PL}$ and $\theta_{PR}$ when the push-rotating angles $\theta_{PL}$ and $\theta_{PR}$ are a predetermined angle or more.

Figure 34:
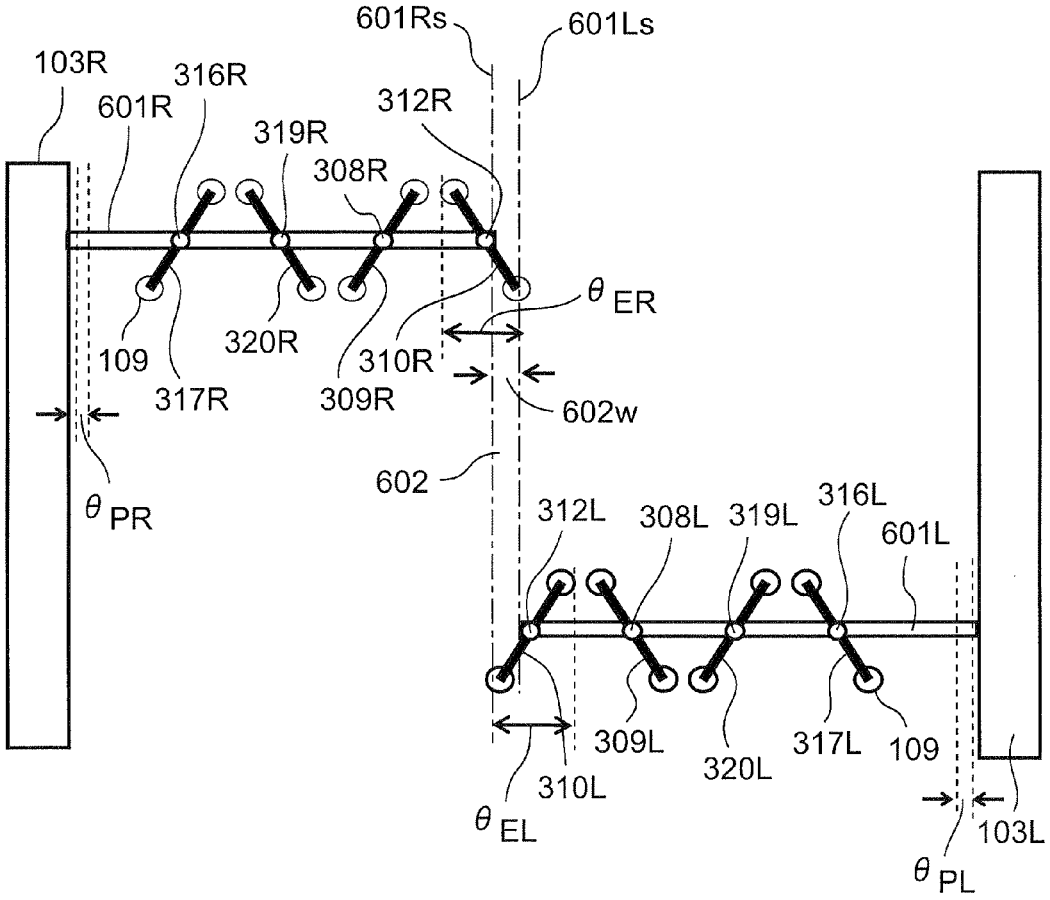
FIG. 34 is a diagram showing a state in which the swing angles $\theta_{SL}$ and $\theta_{SR}$ of the left and right arm sections of the automatic hair washing apparatus according to the first embodiment are different.

FIG. 34 is a view showing a state when the swing-rotating angle $\theta_{SL}$ of the left arm section 601L is 50° and the swing-rotating angle $\theta_{SR}$ of the right arm section 601R is 130° when the left and right arm sections 601L and 601R are swing-rotated with the phases shifted. When the phases of the swing-rotating of the left and right arm sections 601L and 601R are different, the contacts 109 do not interfere with each other at the central part of the head 10 even if the massage-rotating angles $\theta_{EL}$ and $\theta_{ER}$ are maximum angles (60°).

However, the swing-rotating is in phase at the timing the arm sections 601L and 601R pass each other even if the left and right arm sections 601L and 601R are swing-rotated with the phases shifted. Thus, at this timing, the contacts 109 may interfere with each other at the central part of the head 10 depending on the magnitude of the push-rotating angles $\theta_{PL}$ and $\theta_{PR}$.

Therefore, even when the left and right arm sections 601L and 601R are swing-rotated with the phase shifted, the movable range of the massage-rotating angles $\theta_{EL}$ and $\theta_{ER}$ is limited according to the magnitude of the push-rotating angles $\theta_{PL}$ and $\theta_{PR}$, similar to the above, if the difference in the swing-rotating angles $\theta_{SL}$ and $\theta_{SR}$ of the left and right arm sections 601L and 601R is a predetermined or less.

Figure 35:
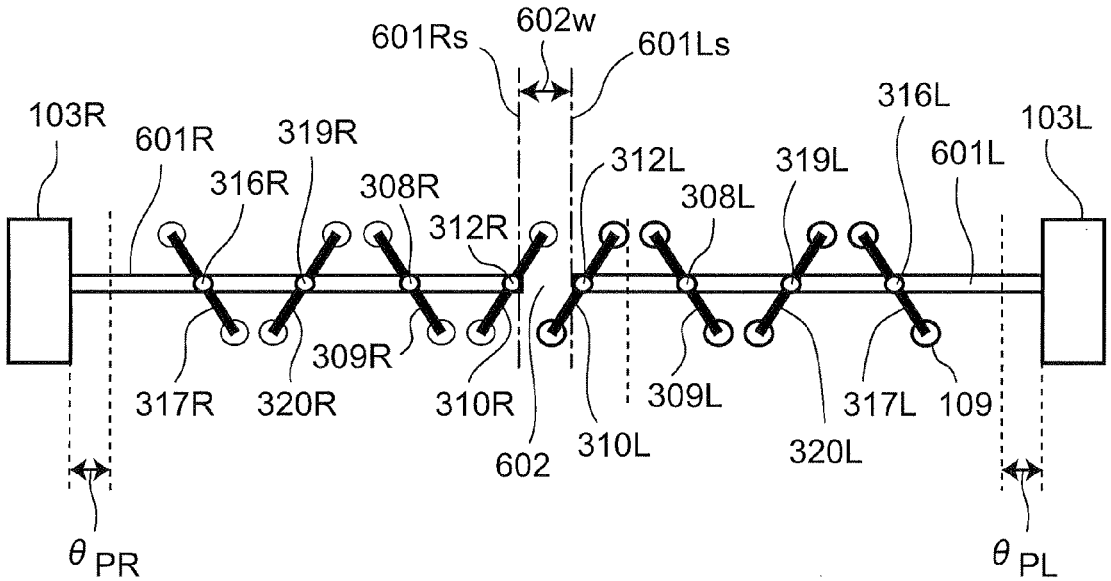
FIG. 35 is a diagram showing a state in which the massage-rotating operation of the fourth arm at the end of the left and right arm sections of the automatic hair washing apparatus according to the first embodiment is in phase.

In place of the control for limiting the movable range of the massage-rotating angles $\theta_{EL}$ and $\theta_{ER}$, the control for massage-rotating-operating the forth arm 310L positioned at the end of the left arm section 601L and the fourth arm 310R positioned at the end of the right arm section 601R in phase may be performed, as shown in FIG. 35. According to such a control as well, the interference of the adjacent contacts 109 can be avoided at the central part of the head 10.

Second Embodiment

An automatic hair washing apparatus according to a second embodiment of the present invention will be described. In the automatic hair washing apparatus according to the second embodiment, only the units different from the automatic hair washing apparatus 100 according to the first embodiment will be described, and the description on the configurations similar to the automatic hair washing apparatus 100 will be omitted by denoting the same reference numerals.

Figure 36:
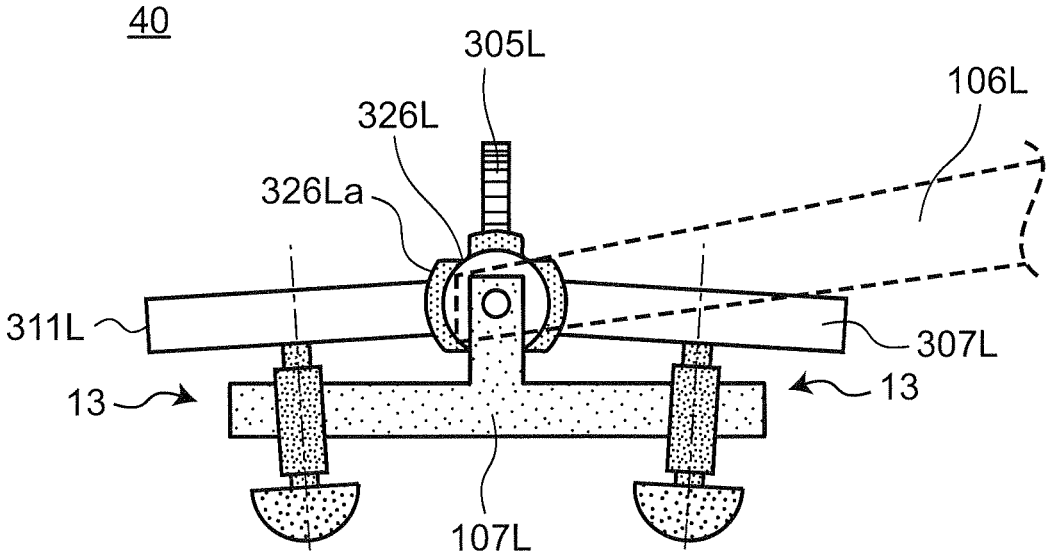
FIG. 36 is a side view showing apart of a head care unit of an automatic hair washing apparatus according to a second embodiment of the present invention.

FIG. 36 is a side view showing apart of a head care unit of an automatic hair washing apparatus according to the second embodiment. As shown in the drawing, in the automatic hair washing apparatus according to the second embodiment, a cylindrical rack 326L is used in place of the cylindrical racks 306L and 314L forming one part of the head care unit 40 of the automatic hair washing apparatus 100. The cylindrical rack 326L has a rack mechanism 326La formed at the outer periphery thereof, the rack mechanism 326La being formed only at the engaging units with the gear 305L attached to the drive shaft 304L, and the gears 307L and 311L of the contact unit 13. This makes it possible to reduce the weight of the cylindrical rack 326L and reduce the cost of the apparatus.

Third Embodiment

An automatic hair washing apparatus according to a third embodiment of the present invention will be described. In the automatic hair washing apparatus according to the third embodiment, only the units different from the automatic hair washing apparatus 100 according to the first embodiment will be described, and the description on the configurations similar to the automatic hair washing apparatus 100 will be omitted by denoting the same reference numerals.

Figure 37:
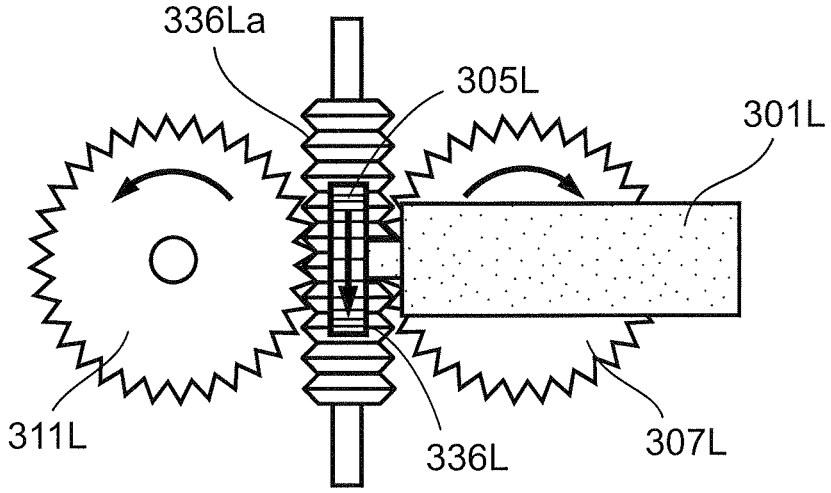
FIG. 37 is a plan view showing a part of a head care unit of an automatic hair washing apparatus according to a third embodiment of the present invention.

FIG. 37 is a plan view showing a part of a head care unit of an automatic hair washing apparatus according to the third embodiment. As shown in the drawing, in the automatic hair washing apparatus according to the third embodiment, a cylindrical rack 336L comprising a rack mechanism 336*a* formed shorter is used, the gear 305L that engages with the cylindrical rack 336L is directly driven by the motor 301L, and the motor 301L is arranged at the upper part of the gear 307L of the contact unit 13. The usage of the head care unit 40 makes it possible to reduce the width of the head care unit 40 and miniaturize the head care unit 40. The motor 301L is arranged at the upper part of the gears 307L and 318L of the contact unit 13 even when the gear 305L that engages with the cylindrical rack 336L is driven by the motor 301L through the drive shaft 304L.

Fourth Embodiment

An automatic hair washing apparatus according to a fourth embodiment of the present invention will be described. In the automatic hair washing apparatus according to the fourth embodiment, only the units different from the automatic hair washing apparatus 100 according to the first embodiment will be described, and the description on the configurations similar to the automatic hair washing apparatus 100 will be omitted by denoting the same reference numerals.

Figure 38A:
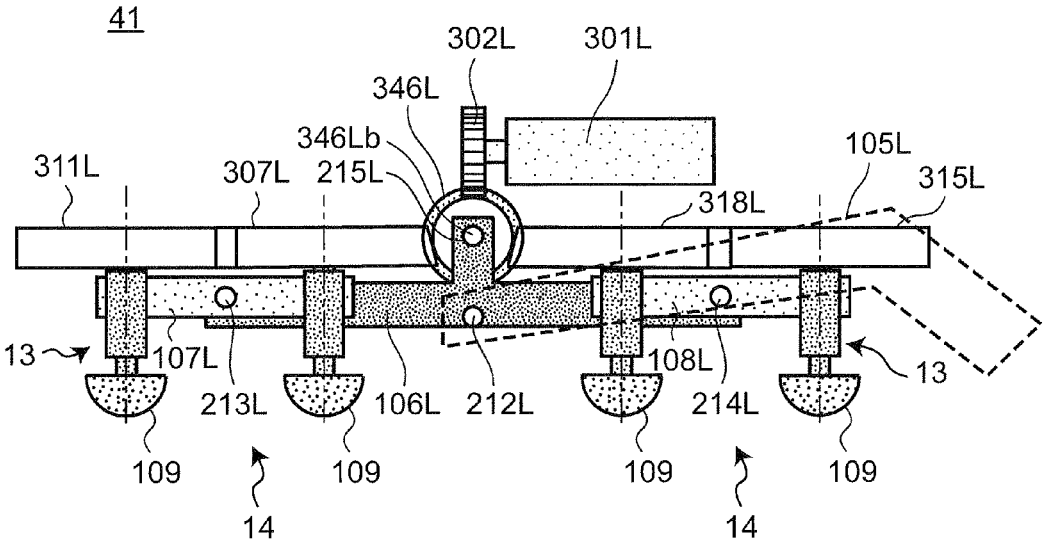
FIGS. 38A and 38B are diagrams showing a part of a head care unit of an automatic hair washing apparatus according to a fourth embodiment of the present invention.
Figure 38B:
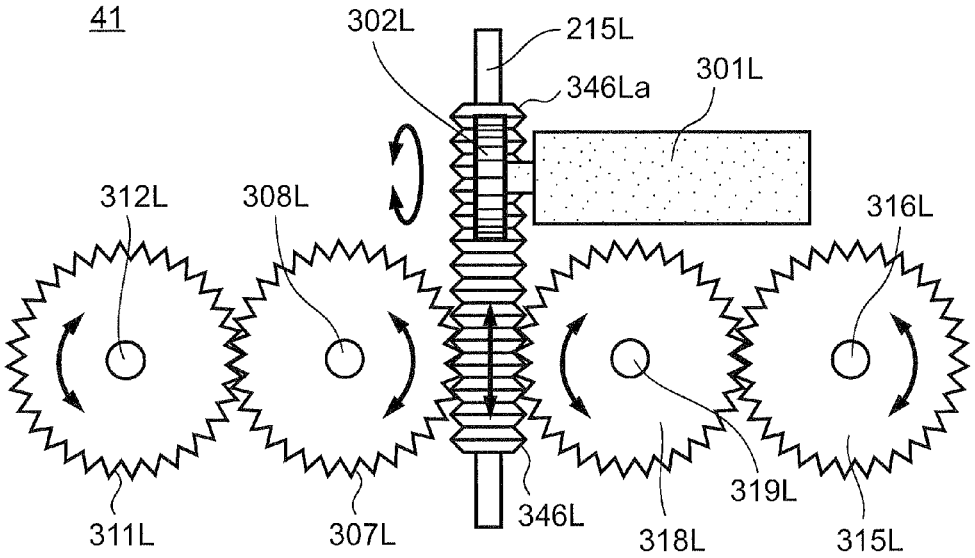

FIGS. 38A and 38B are diagrams showing a part of a head care unit of an automatic hair washing apparatus according to the fourth embodiment. FIG. 38A is a side view showing the part of the head care unit, and FIG. 38B is a plan view showing the part of the head care unit. As shown in the drawings, in the automatic hair washing apparatus according to the fourth embodiment, one cylindrical rack 346L is used in place of the two cylindrical racks 306L and 314L forming one part of the head care unit 40 of the automatic hair washing apparatus 100.

The cylindrical rack 346L comprises rack mechanism 346La defined on its longitudinal opposite side surfaces in a symmetric manner with respect to the longitudinal axis of the rack, and are rotatably supported by the second arm 106 through the support shaft 215L that coincides with the central axis 346Lb of the cylindrical rack 346L. The second arm 106L is rotatably supported by the first arm 105L through the support shaft 212L. The second arm 106L rotatably supports the third arms 107L and 108L, which rotatably supports two contact units 13, through the support shafts 213L and 214L.

A rotation of the motor 301L is transmitted to gears 307L and 318L of the contact unit 13 rotatably mounted on the third arms 107L and 108L through a gear 302L mounted on the motor output shaft and a cylindrical rack 346L interposed between the gear 302L and the gears 307L and 318L. The gear 307L is designed to rotate about the rotational shaft 308L and the gear 318L is designed to rotate about the rotational shaft 319L.

The gears 307L and 318L engaged with the cylindrical rack 346L are designed to engage with the gears 311L and 315L of the contact unit 13 rotatably mounted on the third arms 107L and 108L, respectively. The gear 311L is designed to rotate about the rotational shaft 312L and the gear 315L is designed to rotate about the rotational shaft 316L. In the head care unit so constructed, the adjacent gears 307L, 311L, 315L and 318L, and the adjacent contacts 109 are rotated in the opposite directions to each other when rotating the motor 301L.

In the head care unit 40 shown in FIGS. 38A and 38B, the second arm 106L rotatably supports the third arms 107L and 108L through the support shafts 213L and 214L, and thus rotatably supports the two split units 14. The second arm 106L is moved in the direction approaching person's head 10 when moving the first arm 105L.

When the second arm 106L is moved in a direction approaching person's head 10, the third arms 107L and 108L are moved in the direction approaching person's head 10, which causes the two split units 14 attached to the second arm 106L to be pressed against the scalp 10*a* of person's head 10. In this way, the respective contacts 109 of the two contact units 13 make contact with the scalp 10*a* of person's head 10.

In the head care unit 40 shown in FIGS. 38A and 38B, four contact units 13 are arranged in the direction along the scalp 10*a* of person's head 10, which makes it possible to wash a wider range of person's head 10 at one time, and hence wash person's head 10 in an effective manner, compared with two contact units 13 arranged in the direction along the scalp 10*a* of person's head 10.

Fifth Embodiment

An automatic hair washing apparatus according to a fifth embodiment of the present invention will be described. In the automatic hair washing apparatus according to the fifth embodiment, only the units different from the automatic hair washing apparatus 100 according to the first embodiment will be described, and the description on the configurations similar to the automatic hair washing apparatus 100 will be omitted by denoting the same reference numerals.

Figure 39:
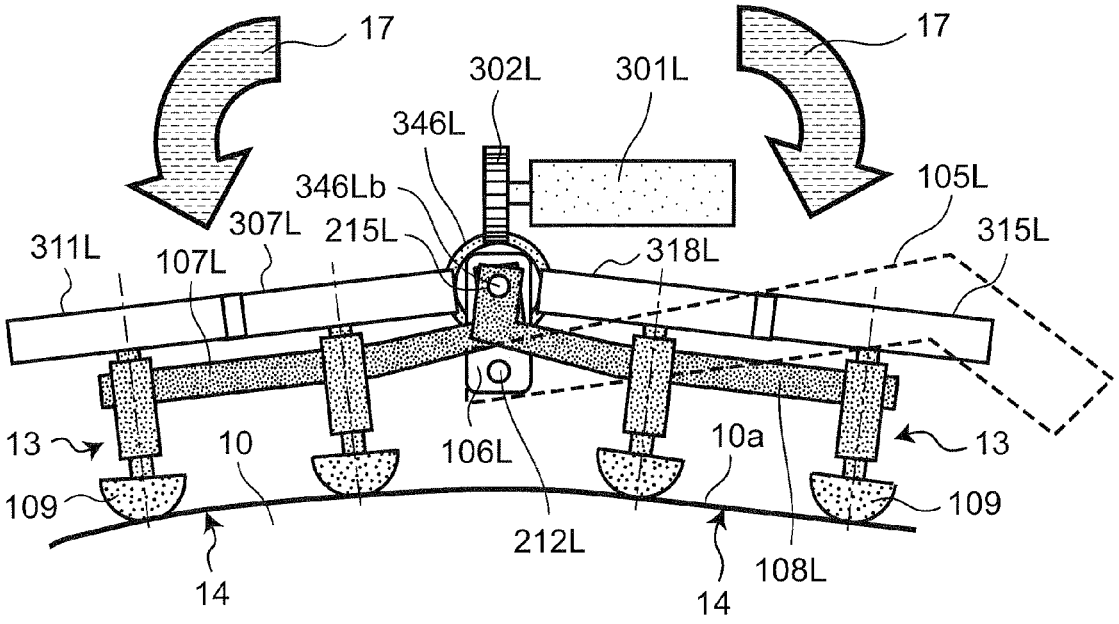
FIG. 39 is a side view showing a part of a head care unit of an automatic hair washing apparatus according to a fifth embodiment of the present invention.

FIG. 39 is a side view showing a part of a head care unit of an automatic hair washing apparatus according to the fifth embodiment. As shown in the drawing, the automatic hair washing apparatus according to the fifth embodiment is designed so that the one ends of the third arm 107L and 108L are supported by the support shaft 215L that coincides with the central axis 346Lb of the cylindrical rack 346L, and the cylindrical rack 346L is rotatably supported by the second arm 106L through the support shaft 215L, in the automatic hair washing apparatus according to the fourth embodiment.

In the head care unit shown in FIG. 39, the third arms 107L and 108L rotatably support the two split units 14, the third arms 107L and 108L are coupled to the second arm 106L. The second arm 106L is moved in the direction approaching person's head 10 by moving the first arm 105L.

When the second arm 106L is moved in a direction approaching person's head 10, the third arms 107L and 108L are moved in the direction approaching person's head 10, as indicated by an arrow 17, which causes the contact units 13 to be pressed against the scalp 10*a* of person's head 10. In this way, the respective contacts 109 of the contact units 13 make contact with the scalp 10*a* of person's head 10.

In the head care unit so constructed, the adjacent gears 307L, 311L, 315L and 318L, and the adjacent contacts 109 are rotated in the opposite directions to each other when rotating the motor 301L, which makes it possible to wash person's head 10 in an effective manner. In the automatic hair washing apparatus according to the fifth embodiment, the configuration associated with the second arm 106L and the third arms 107L and 108L can be simplified compared to the automatic hair washing apparatus according to the fourth embodiment.

Sixth Embodiment

An automatic hair washing apparatus according to a sixth embodiment of the present invention will be described. In the automatic hair washing apparatus according to the sixth embodiment, only the units different from the automatic hair washing apparatus 100 according to the first embodiment will be described, and the description on the configurations similar to the automatic hair washing apparatus 100 will be omitted by denoting the same reference numerals.

Figure 40:
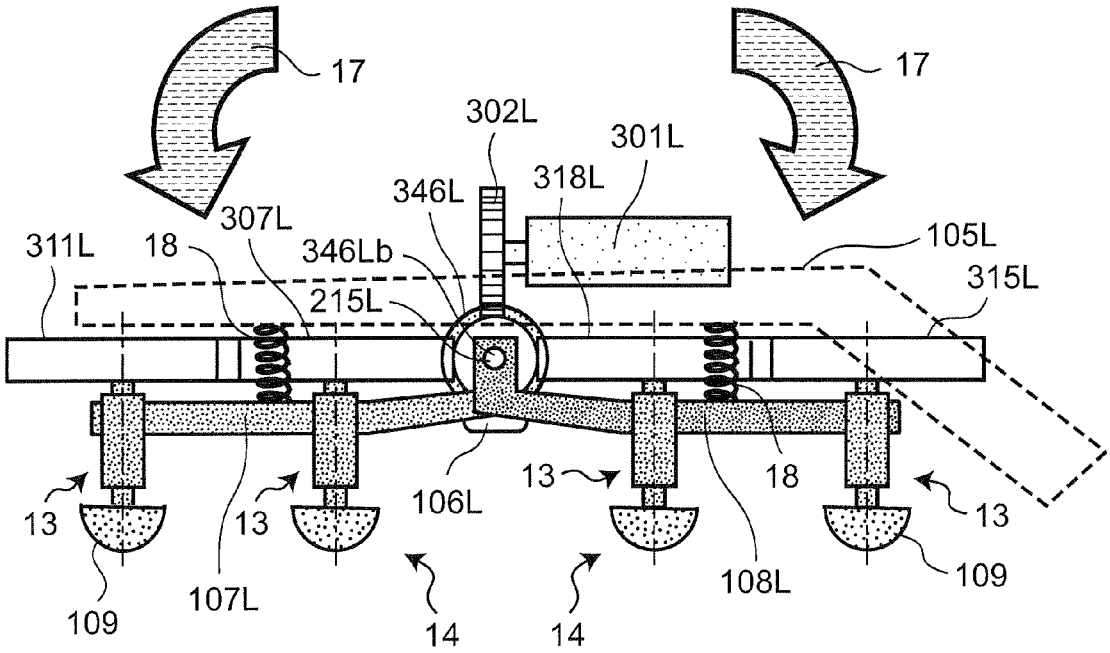
FIG. 40 is a side view showing a part of a head care unit of an automatic hair washing apparatus according to a sixth embodiment of the present invention.

FIG. 40 is a side view showing apart of a head care unit of an automatic hair washing apparatus according to the sixth embodiment. As shown in the drawing, the automatic hair washing apparatus according to the sixth embodiment is designed so that the first arm 105L and the third arms 107L and 108L are connected with coil springs 18, in the automatic hair washing apparatus according to the fourth embodiment.

In the head care unit shown in FIG. 40, one ends of the third arm 107L and 108L are supported by the support shaft 215L that coincides with the central axis 346Lb of the cylindrical rack 346L, and the cylindrical rack 346L is rotatably supported by the second arm 106L through the support shaft 215L. In the head care unit shown in FIG. 40, the third arms 107L and 108L are connected to the first arm 105L with coil springs 18.

In the head care unit so constructed, when the first arm 105L is moved in a direction approaching person's head 10, the third arms 107L and 108L are moved in the direction approaching person's head 10, as indicated by the arrow 17, which causes the contact units 13 to be pressed against person's head 10. In this way, the respective contacts 109 of the contact units 13 make contact with the scalp 10*a* of person's head 10.

In the automatic hair washing apparatus according to the sixth embodiment, when the contacts 109 of the contact units 13 make contact with the scalp 10*a* of person's head 10, the contacts 109 of the contact units 13 make contact with person's head 10 under the elasticity of the coil spring 18. This makes it possible to reduce the impact on person's head 10 and hence reduce the strain applied on person's head 10.

Seventh Embodiment

An automatic hair washing apparatus according to a seventh embodiment of the present invention will be described. In the automatic hair washing apparatus according to the seventh embodiment, only the units different from the automatic hair washing apparatus 100 according to the first embodiment will be described, and the description on the configurations similar to the automatic hair washing apparatus 100 will be omitted by denoting the same reference numerals.

Figure 41:
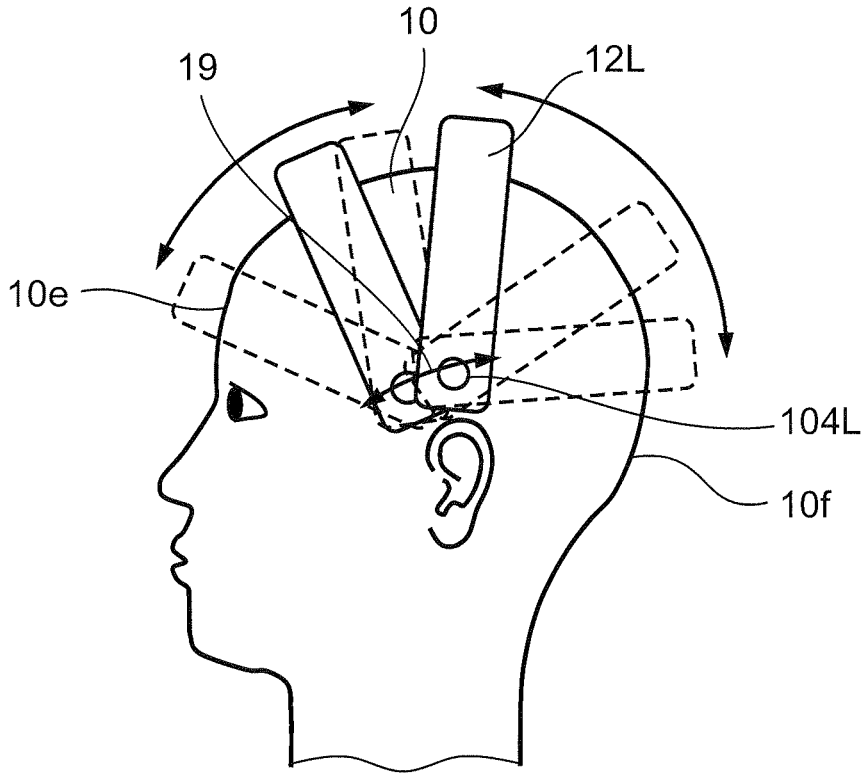
FIG. 41 is a diagram showing a washing unit of an automatic hair washing apparatus according to a seventh embodiment of the present invention.

FIG. 41 is a diagram showing a washing unit of an automatic hair washing apparatus according to the seventh embodiment. As shown in the drawing, the automatic hair washing apparatus according to the seventh embodiment is designed so that the support shaft 104L of the left washing unit 12L is movable in a direction orthogonal to the support shaft 104L as indicated by an arrow 19, in the automatic hair washing apparatus 100. The support shaft 104L is coupled to the support column 102L so as to be movable in a direction orthogonal to the support shaft 104L.

When washing the unit adjacent to the forehead 10*e* of person's head 10, or a back 10*f* of person's head 10, the support shaft 104L is moved in accordance with the shape of person's head 10, which cause the washing unit 12L to move in accordance with the shape of person's head 10. This makes it possible to perform the washing of person's head 10 in accordance with the shape of person's head 10 in a further effective manner.

Eighth Embodiment

An automatic hair washing apparatus according to a eight embodiment of the present invention will be described. In the automatic hair washing apparatus according to the eight embodiment, only the units different from the automatic hair washing apparatus 100 according to the first embodiment will be described, and the description on the configurations similar to the automatic hair washing apparatus 100 will be omitted by denoting the same reference numerals.

Figure 42:
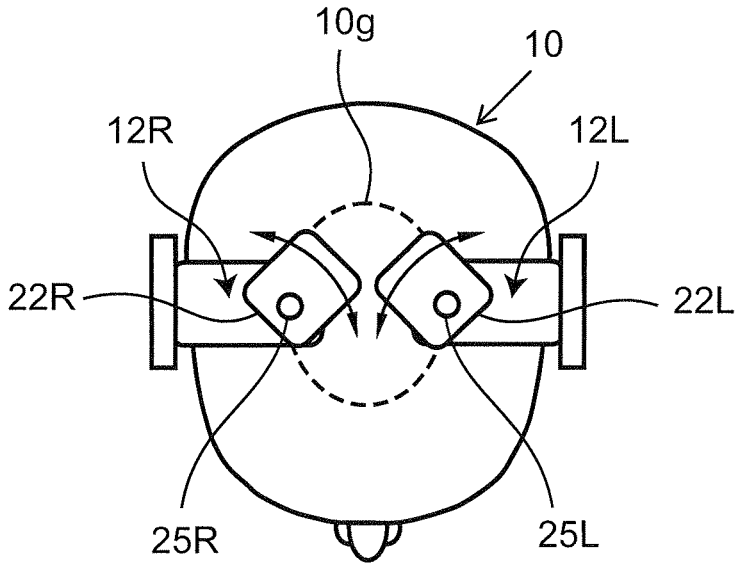
FIG. 42 is a diagram showing a washing unit of an automatic hair washing apparatus according to an eighth embodiment of the present invention.

FIG. 42 is a diagram showing a washing unit of an automatic hair washing apparatus according to the eighth embodiment. As shown in the drawing, the automatic hair washing apparatus according to the eighth embodiment comprises auxiliary washing units 22L and 22R, which are attached to the washing units 12L and 12R at the ends thereof, in order to wash the unit 10*g* of the head 10 that is difficult to wash by the pair of the washing units 12 in an effective manner, in the automatic hair washing apparatus 100. The auxiliary washing units 22L and 22R are constructed to wash the person's head 10.

The auxiliary washing units 22L and 22R are designed to rotate about connection shafts 25L and 25R that connect the auxiliary washing units 22L and 22R and the washing units 12L and 12R. For example, a motor (not shown) is mounted to the washing units 12L and 12R, and the auxiliary washing units 22L and 22R are mounted on the output shaft of the motor, so that the auxiliary washing units 22L and 22R rotate about connection shafts 25L and 25R with respect to the washing units 12L and 12R.

Figure 43A:
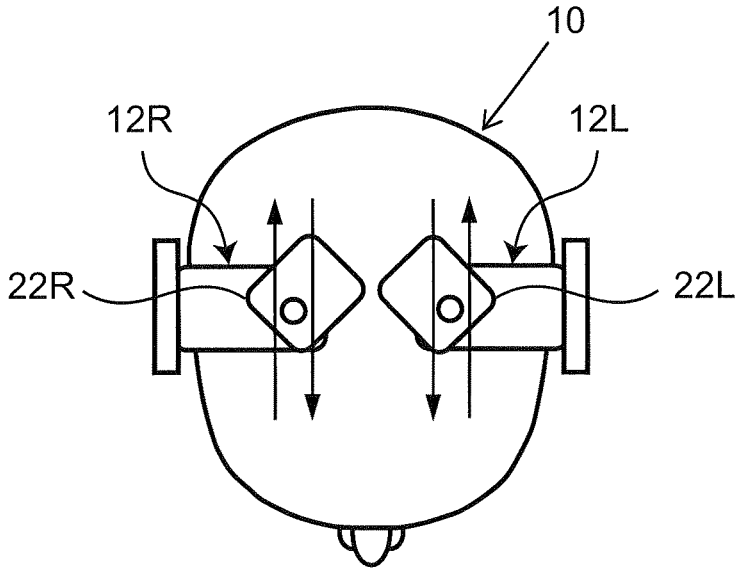
FIGS. 43A and 43B are diagrams describing an operation of the washing unit of the automatic hair washing apparatus according to the eighth embodiment.
Figure 43B:
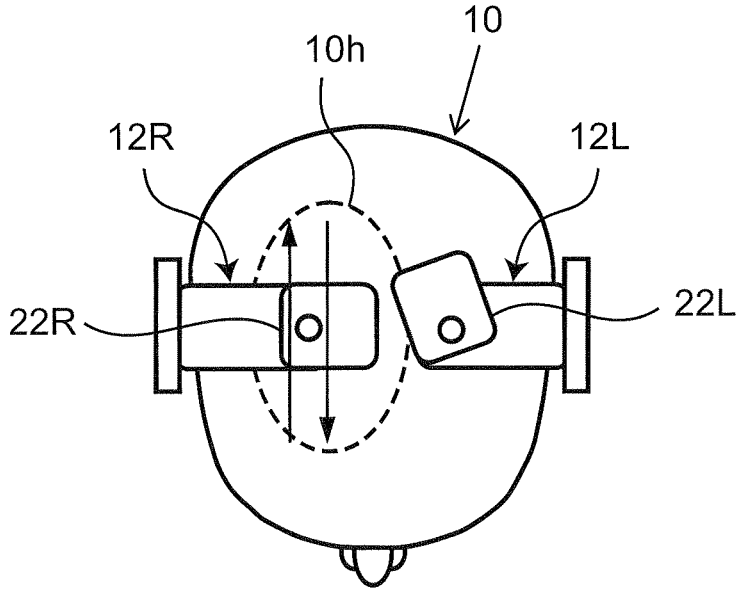
Figure 44:
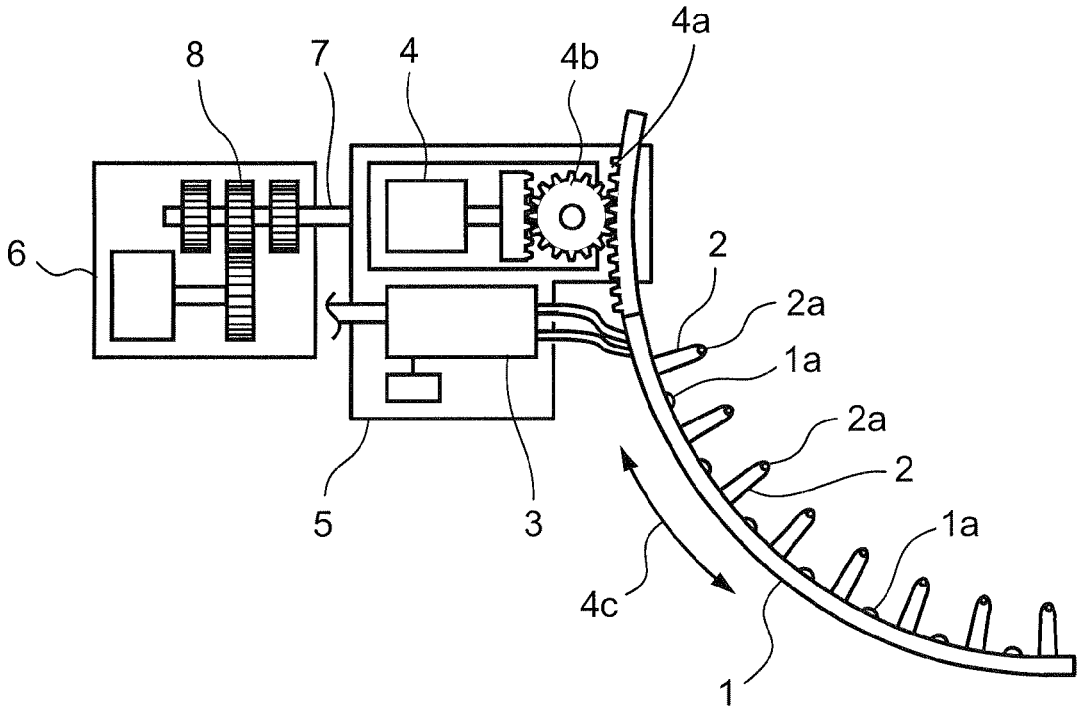
FIG. 44 is a partial schematic diagram of the conventional automatic hair washing apparatus.

FIGS. 43A and 43B are diagrams describing an operation of the washing unit of the automatic hair washing apparatus according to the eighth embodiment. FIG. 43A shows the washing of person's head using two auxiliary washing units and FIG. 43B shows the washing of person's head using one auxiliary washing unit.

In the automatic hair washing apparatus according to the eighth embodiment, when washing person's head 10 using two auxiliary washing units 22L and 22R, as shown in FIG. 43A, the auxiliary washing units 22L and 22R are rotated so that the auxiliary washing units 22L and 22R are positioned in a substantially symmetric manner, and after that the washing units 12L and 12R and the auxiliary washing units 22L and 22R are moved to wash person's head 10.

In the automatic hair washing apparatus, when washing person's head 10 using one auxiliary washing unit, as shown in FIG. 43B, one auxiliary washing unit 22L is rotated to substantially overlap with the washing unit 12L and the other auxiliary washing unit 22R is rotated to project from washing unit 12R to the center of the person's head 10, and after that only the right washing unit 12R and the auxiliary washing unit 22R are moved to wash a predetermined unit 10*h* of person's head 10.

When moving only the right washing unit 12R and the auxiliary washing unit 22R, the left washing unit 12L and the auxiliary washing unit 22L may be designed to hold the person's head 10 at a predetermined load. Alternatively, when moving only the left washing unit 12L and the auxiliary washing unit 22L, the right washing unit 12R and the auxiliary washing unit 22R may be designed to hold person's head 10 at a predetermined load.

In the automatic hair washing apparatus 100 without the auxiliary washing units 22L and 22R, it may be designed so that one washing unit is moved in the direction of rotation of the washing unit while the other washing unit holding person's head 10 at a predetermined load. This makes it possible to wash a predetermined unit of person's head 10 intensively, which causes person's head 10 to be washed in a cleaner manner.

INDUSTRIAL APPLICABILITY

The automatic hair washing apparatus of the present invention can be widely used in a medicare, such as nursing care, industry or hairdressing and beauty industry.

EXPLANATION OF NUMERALS

11 head support
12 washing unit
12L left washing unit
12R right washing unit
13 contact unit
14 split unit
40 head care unit
100 automatic hair washing apparatus
101 bowl
104L, 104R, 212L, 212R, 213L, 213R, 214L, 214R, 215L, 215R support shaft
105L, 105R first arm
106L, 106R second arm
107L, 107R, 108L, 108R third arm
109 contact
110 nozzle
111L, 111R pipe
115 cover
201L, 201R, 206L, 206R, 301L, 301R motor
211L, 211R pressure sensor
216 water system valve
217 washing agent system valve
218 conditioner system valve
304L drive shaft
306L, 314L, 326L, 336L, 346L cylindrical rack
309L, 309R, 310L, 310R, 317L, 317R, 320L, 320R forth arm
309Lb branch
510 water shield
700 control device
701L left arm swing angle control section
701R right arm swing angle control section
702L left arm pushing angle control section
702R right arm pushing angle control section
703L left contact group angle control section
703R right contact group angle control section
704 water system valve control section
705 washing liquid system valve control section
706 conditioner system valve control section
707 operating section
708 system control section
708A angle command generating unit
708B state variable managing unit
708C pressure control calculating unit
708D system flow control unit
708E operation receiving unit
708F display control unit
708G valve opening/closing command generating unit
708H safety managing unit
708I storage unit

The invention claimed is:

1. An automatic hair washing apparatus comprising:

a base having a head support for supporting a person's head;

first and second washing units for washing the person's head, being arranged with the head support interposed therebetween, and the support shafts thereof being attached to the base;

a driving section for rotating the first and second washing units about the respecive support shafts; and a control section for controlling the driving of the driving section; wherein each of the first and second washing units comprises a plurality of contacts on a surface opposite to the surface supported by the support shaft, each of the contacts is rotatably driven about rotational shaft provided to the first or second washing unit, and the control section moves the second washing unit in the direction of rotation of the second washing unit while holding the person's head supported by the head support at a predetermined load by the first washing unit.

2. The automatic hair washing apparatus according to claim 1, wherein the contacts are made of rubber material.

3. The automatic hair washing apparatus according to claim 1, wherein each of the first and second washing units has a plurality of split units in a longitudinal direction of the respective washing units, each split unit comprising a plurality of contacts.

4. The automatic hair washing apparatus according to claim 1, wherein the supporting shafts of the first and second washing units are arranged parallel to a centerline of the head support.

5. The automatic hair washing apparatus according to claim 1, wherein a pressure sensor for detecting contact with the person's head is arranged in the contacts; and the control section controls the driving of the driving section based on a detection signal from the pressure sensor.

6. The automatic hair washing apparatus according to claim 3, wherein a distance sensor for detecting a distance with the person's head is arranged in the split unit; and the control section controls the driving of the driving section based on a detection signal from the distance sensor.

7. The automatic hair washing apparatus according to claim 5, wherein the control section includes a pressure control unit for applying a predetermined pressure on the person's head based on the detection signal from the pressure sensor.

8. The automatic hair washing apparatus according to claim 7, further comprising:

a swing-rotating angle detecting section for detecting swing-rotating angles of the first washing unit and the second washing unit; and a push-rotating angle detecting section for detecting a push-rotating angles of the first washing unit and the second washing unit; wherein the control section includes a storage unit for storing a relation of the swing-rotating angle and the push-rotating angle for applying a predetermined pressure on the person's head in accordance with a shape of the person's head.

9. The automatic hair washing apparatus according to claim 8, wherein the storage unit stores information associated with influence of gravity in accordance with swing-rotating operations of the first washing unit and the second washing unit as a function of the swing-rotating angle.

10. The automatic hair washing apparatus according to claim 1, wherein the first washing unit and the second washing unit comprise a pipe with a nozzle for ejecting at least one of cold water, hot water, washing agent, and conditioner, the nozzle being arranged on a surface opposing the head support of the pipe.

11. The automatic hair washing apparatus according to claim 1, wherein the first washing unit and the second washing unit comprise a cover for covering the plurality of contacts.

12. The automatic hair washing apparatus according to claim 1, further comprising:

a water supplying unit for supplying cold water or hot water to the first washing unit and the second washing unit;

a washing solution supplying unit for supplying washing solution to the first washing unit and the second washing unit; and a conditioner supplying unit for supplying conditioner to the first washing unit and the second washing unit.

13. The automatic hair washing apparatus according to claim 1, wherein the contacts are arranged at both ends of an arm that rotates about the rotational shaft.

14. The automatic hair washing apparatus according to claim 13, wherein the adjacent arms are rotated in opposite directions.

* * * * *